United States Patent [19]

Landa

[11] 4,435,068

[45] Mar. 6, 1984

[54] APPARATUS FOR ELECTROPHOTOGRAPHY

[75] Inventor: Benzion Landa, Edmonton, Canada

[73] Assignee: Savin Corporation, Stamford, Conn.

[21] Appl. No.: 268,261

[22] Filed: May 29, 1981

[51] Int. Cl.[3] ..... G03G 15/14

[52] U.S. Cl. ..... 355/3 R; 355/3 TR; 355/3 SH

[58] Field of Search ..... 355/3 R, 3 TR, 3 SH

[56] References Cited

U.S. PATENT DOCUMENTS

| | | | |
|---|---|---|---|
| 3,637,303 | 1/1972 | Komori et al. | 355/8 |
| 3,970,383 | 7/1976 | Honda et al. | 355/8 X |
| 4,116,557 | 9/1978 | Kushima et al. | 355/3 TR X |
| 4,214,833 | 7/1980 | Kono | 355/3 TR X |
| 4,341,456 | 7/1982 | Iyer et al. | 355/3 TR |
| 4,367,942 | 1/1983 | Ohtsuka | 355/3 TR X |

*Primary Examiner*—Fred L. Braun
*Attorney, Agent, or Firm*—Shenier & O'Connor

[57] ABSTRACT

A copier in which a processing unit carrying a photoconductor drum, an exposure system, a liquid developer applicator, an excess liquid removal member, and a cleaning member is mounted for reciprocating movement with a forward stroke and a return stroke below a platen supporting the original document and in which a drive translates the unit while rotating the drum in synchronism with the translatory movement of the unit. A paper handling unit carrying a pair of registration rolls, a transfer corona, a copy paper pick-off, and a pair of delivery rolls, is mounted for reciprocating movement between a registration position at which its registration rolls receive a sheet from a supply of copy material and a position adjacent to the delivery end of the machine. In operation, the processing unit moves from its home position toward the registration position as the initial part of the image of the original is formed and developed. As it moves through the registration location, the processing unit picks up the paper handling unit and automatically provides a drive for the rollers thereof as the two units move together toward the delivery end of the machine. As the leading edge of the copy reaches its terminal location in the tray, movement of the units reverses and the copy delivery operation is completed during this reverse movement, before the paper handling unit returns to the registration position.

10 Claims, 44 Drawing Figures

TO FIG.11
TO FIG.8
TO FIG.9
456
398
396
12
406
482
480
16
450
478
474
404
434
476
438
448
408
400
452
100
430
473
436
446
428
432
424
444
440
426
442
422
464
462
576
410
498
568
418
492
460
574
420
500
566
454
458

FIG.13
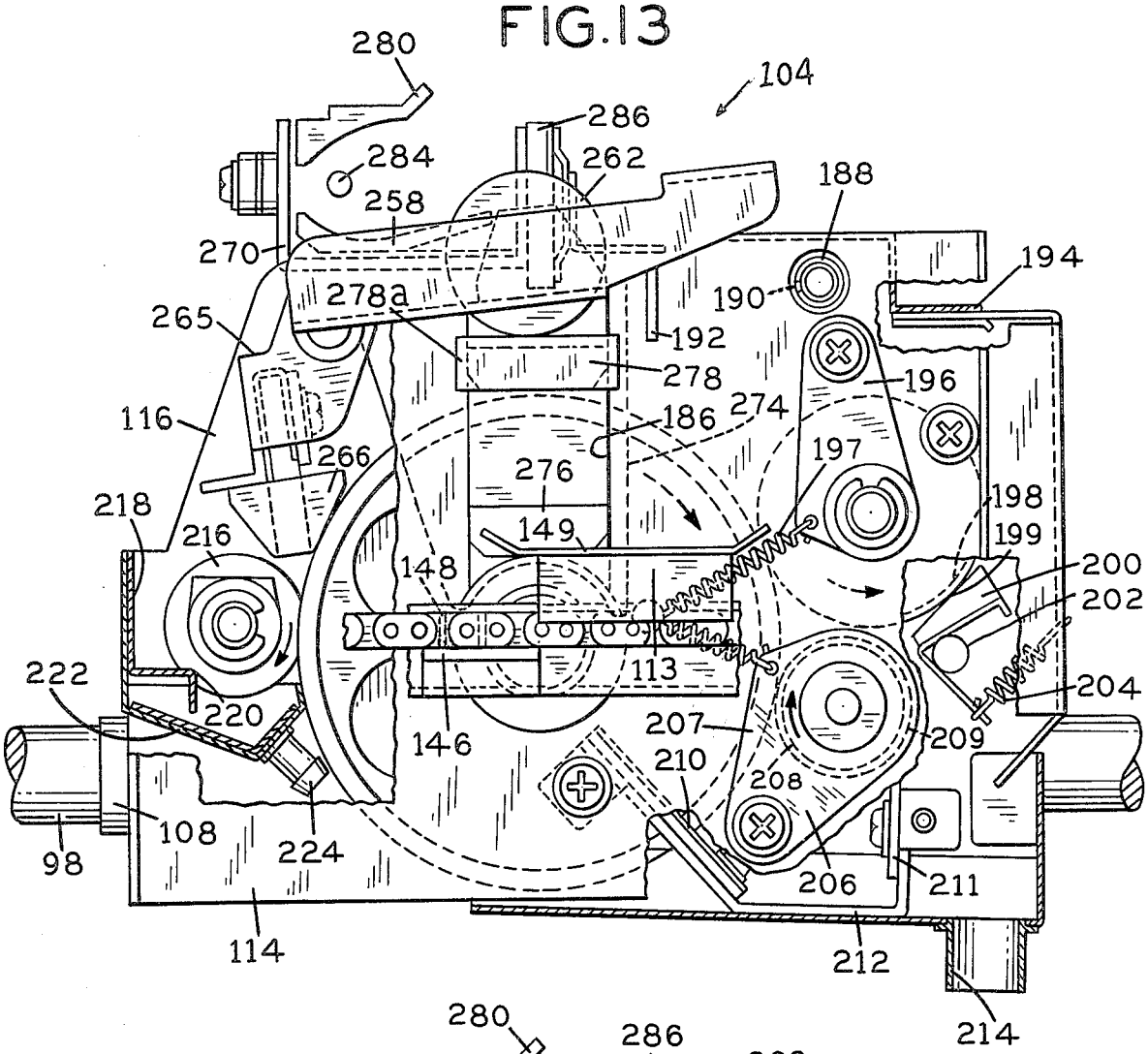
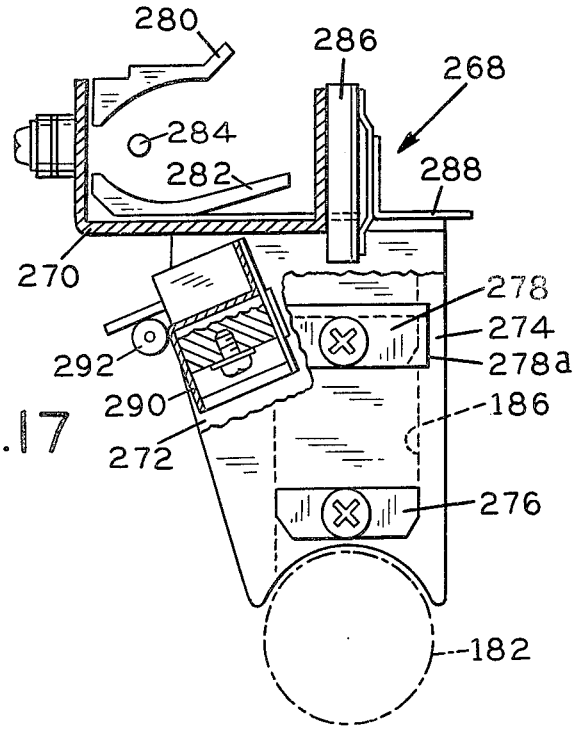
FIG.17

FIG.14
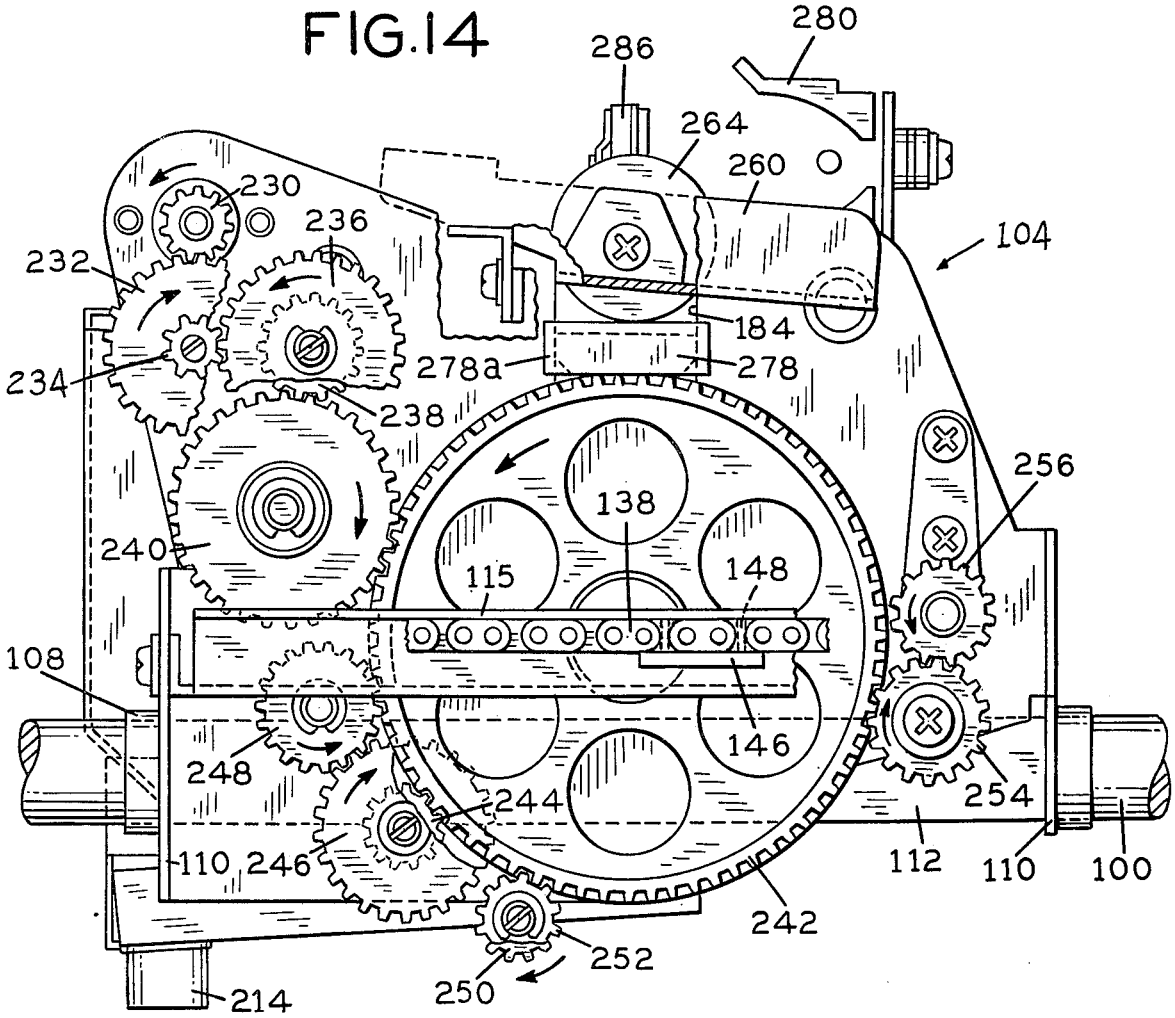
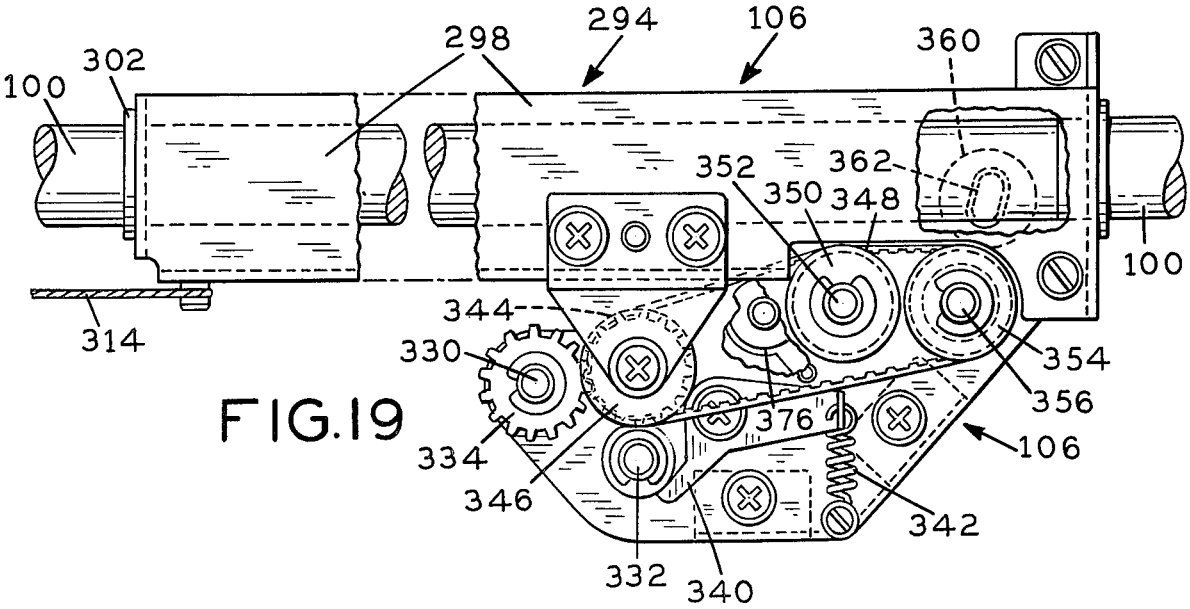
FIG.19

13
13
149
148
148
136
108
113
110
108
98
110
196
197
114
182
178
174
186
260
182a
293
188
192
190
190
172
216
104
228
199
180
176
180a
242
256
293
232
116
236
238
246
250
230
138
115
146
148
148
254
112
108
100
14
14

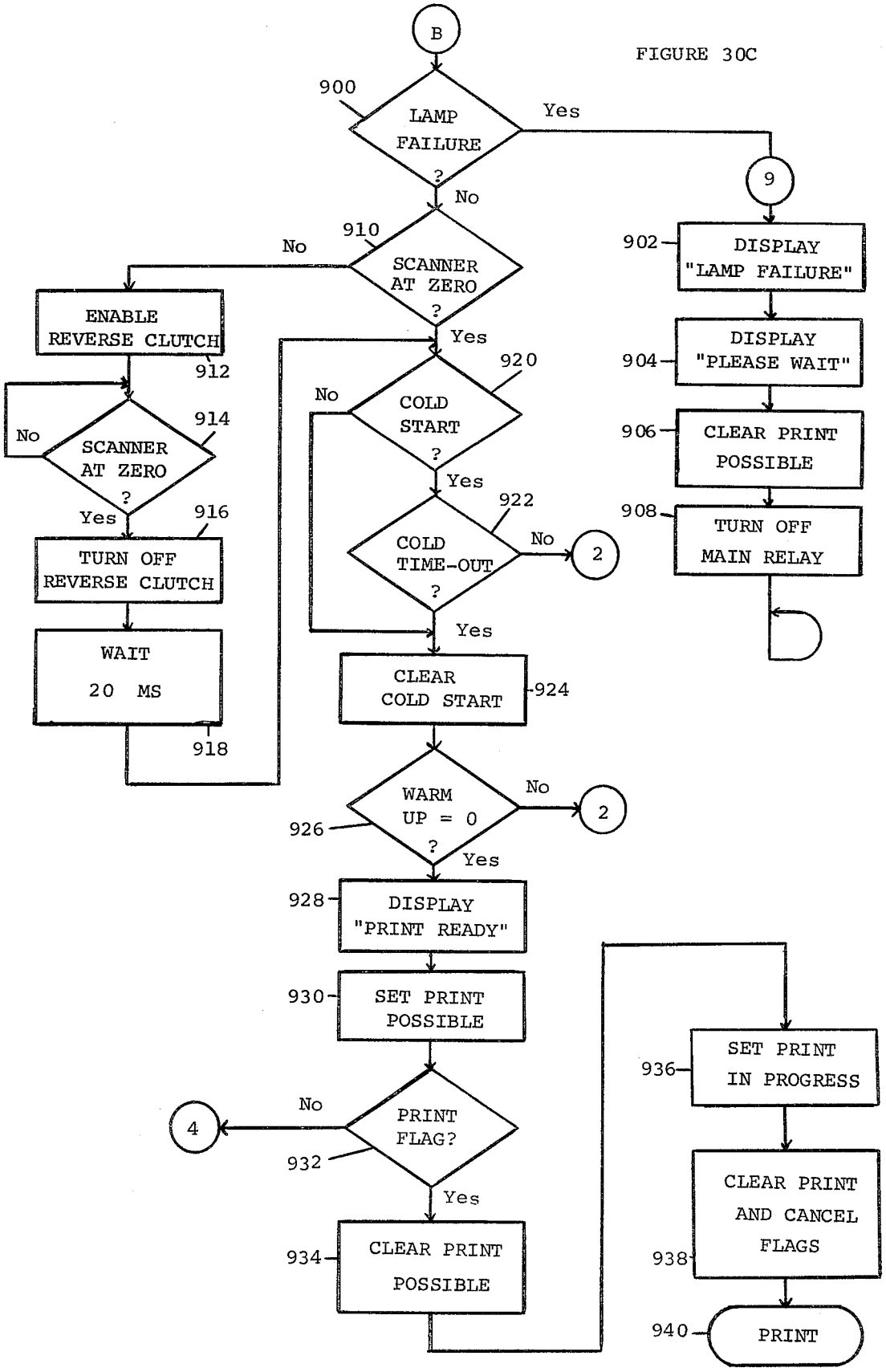
B
FIGURE 30C
900
LAMP FAILURE ?
Yes
No
9
910
SCANNER AT ZERO ?
No
Yes
902
DISPLAY "LAMP FAILURE"
904
DISPLAY "PLEASE WAIT"
906
CLEAR PRINT POSSIBLE
908
TURN OFF MAIN RELAY
ENABLE REVERSE CLUTCH
912
914
SCANNER AT ZERO ?
No
Yes
916
TURN OFF REVERSE CLUTCH
WAIT 20 MS
918
920
COLD START ?
No
Yes
922
COLD TIME-OUT ?
No
2
Yes
CLEAR COLD START
924
926
WARM UP = 0 ?
No
2
Yes
928
DISPLAY "PRINT READY"
930
SET PRINT POSSIBLE
932
PRINT FLAG?
No
4
Yes
934
CLEAR PRINT POSSIBLE
936
SET PRINT IN PROGRESS
938
CLEAR PRINT AND CANCEL FLAGS
940
PRINT

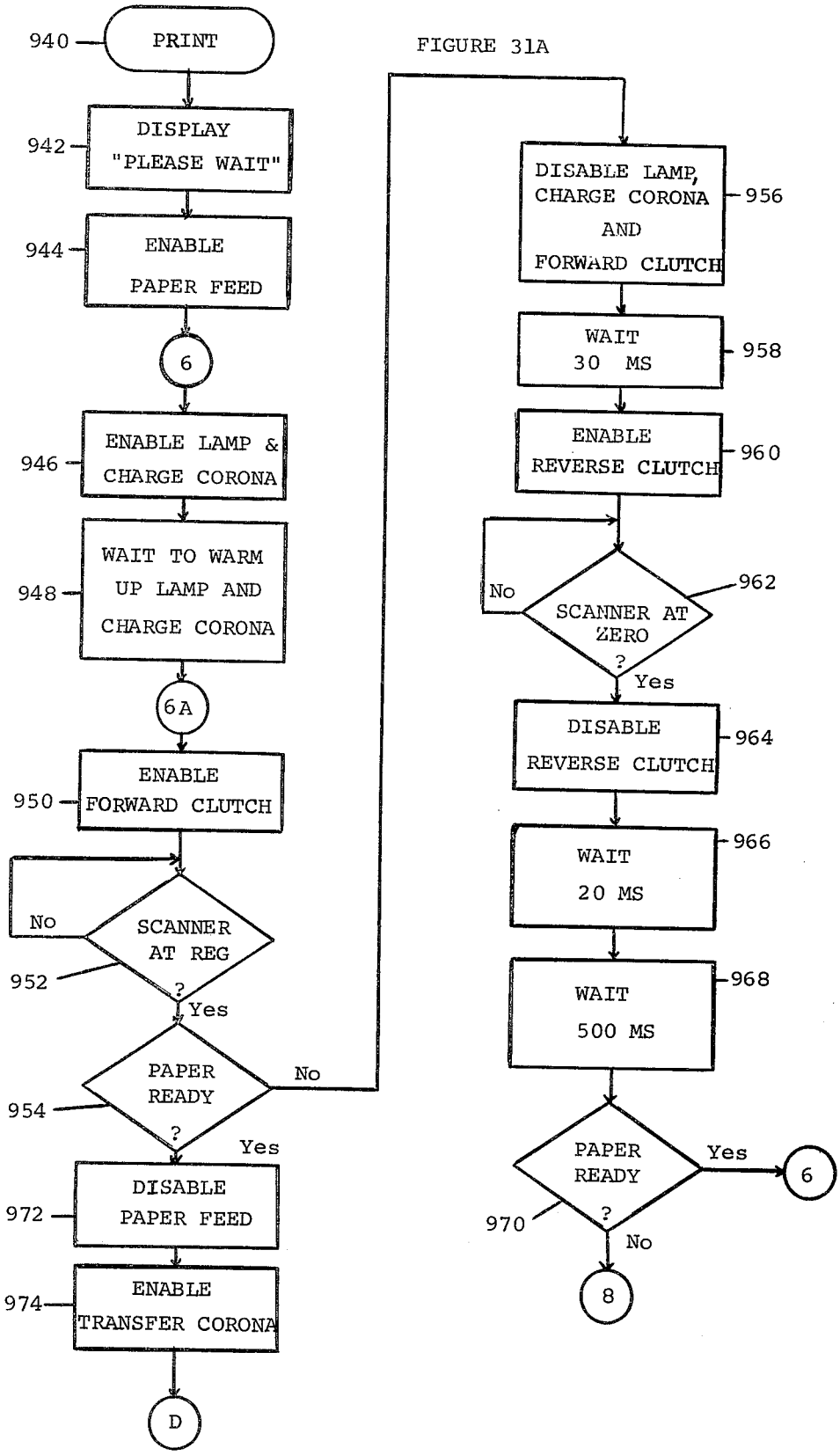
FIGURE 31A
940
PRINT
942
DISPLAY "PLEASE WAIT"
944
ENABLE PAPER FEED
6
946
ENABLE LAMP & CHARGE CORONA
948
WAIT TO WARM UP LAMP AND CHARGE CORONA
6A
950
ENABLE FORWARD CLUTCH
952
SCANNER AT REG ?
No
Yes
954
PAPER READY ?
No
Yes
972
DISABLE PAPER FEED
974
ENABLE TRANSFER CORONA
D
956
DISABLE LAMP, CHARGE CORONA AND FORWARD CLUTCH
958
WAIT 30 MS
960
ENABLE REVERSE CLUTCH
962
SCANNER AT ZERO ?
No
Yes
964
DISABLE REVERSE CLUTCH
966
WAIT 20 MS
968
WAIT 500 MS
970
PAPER READY ?
Yes
6
No
8

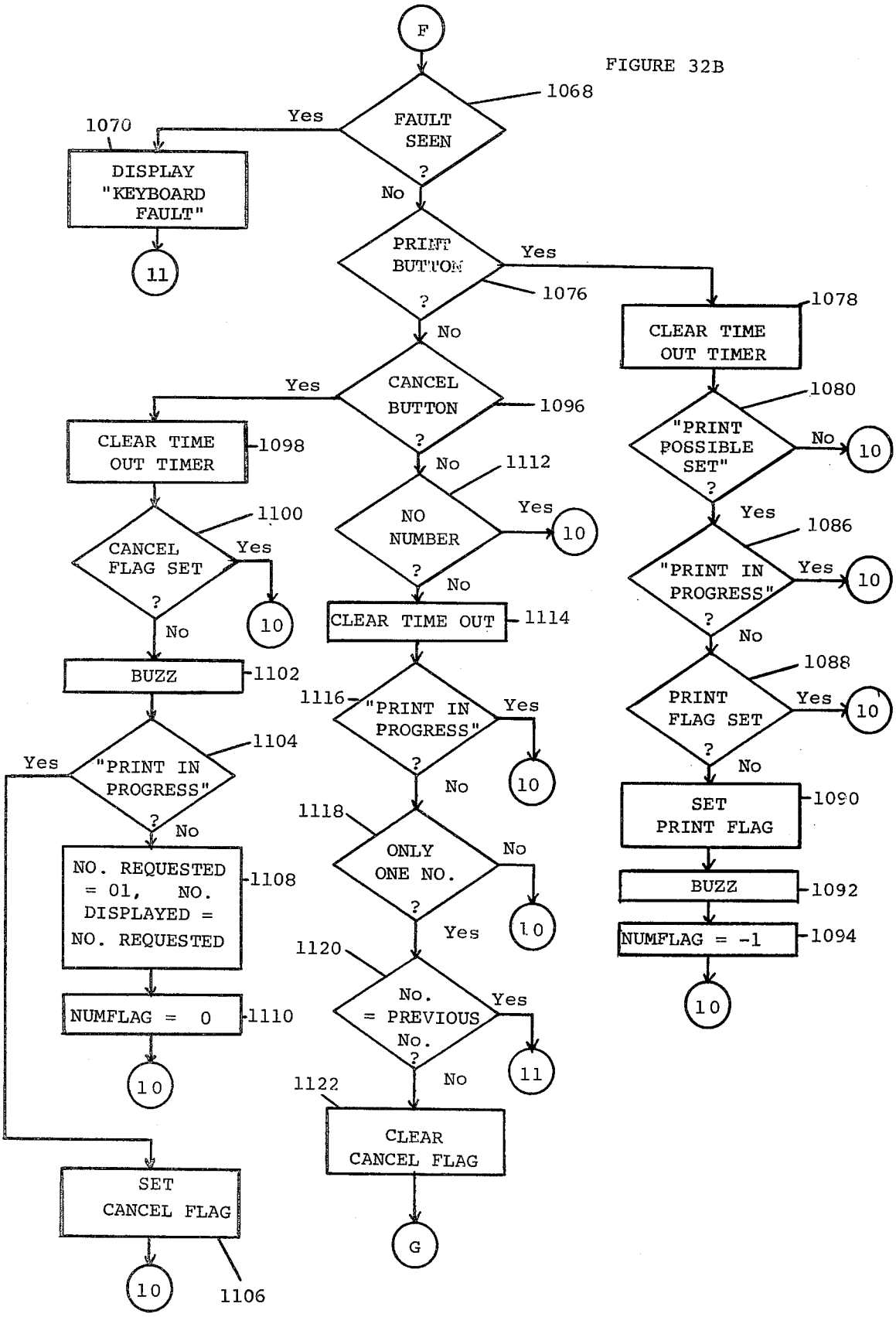
F
FIGURE 32B
FAULT SEEN ?
1068
Yes
1070
DISPLAY "KEYBOARD FAULT"
11
No
PRINT BUTTON ?
1076
Yes
1078
CLEAR TIME OUT TIMER
No
CANCEL BUTTON ?
1096
Yes
CLEAR TIME OUT TIMER
1098
1080
"PRINT POSSIBLE SET" ?
No
10
No
1112
NO NUMBER ?
Yes
10
1100
CANCEL FLAG SET ?
Yes
10
No
BUZZ
1102
Yes
1086
"PRINT IN PROGRESS" ?
Yes
10
No
CLEAR TIME OUT
1114
1116
"PRINT IN PROGRESS" ?
Yes
10
No
1088
PRINT FLAG SET ?
Yes
10
No
1104
Yes
"PRINT IN PROGRESS" ?
No
1118
ONLY ONE NO. ?
No
10
Yes
SET PRINT FLAG
1090
NO. REQUESTED = 01, NO. DISPLAYED = NO. REQUESTED
1108
BUZZ
1092
NUMFLAG = -1
1094
10
1120
No. = PREVIOUS No. ?
Yes
11
No
NUMFLAG = 0
1110
10
1122
CLEAR CANCEL FLAG
SET CANCEL FLAG
G
10
1106

APPARATUS FOR ELECTROPHOTOGRAPHY

BACKGROUND OF THE INVENTION

Various forms of electrophotographic copying machines are known in the prior art. Some of these machines are intended for that part of the copier market in which the price at which the machine can be sold is limited. One type of copier intended for this portion of the market employs a reciprocable platen which carries the original past stationary optics. Most of these copiers are intended for use with a supply of copy paper of only one size. Where a copy of a longer original is to be made, the supply of copy material must be replaced with copy material corresponding in size to the longer sized original. Copiers of the type employing a reciprocating platen are not adapted to copy the pages of, for example, a relatively heavy book. Neither do they accommodate semi-automatic or automatic document feeders.

Copying machines of the type just described, also are generally used as "convenience" copiers in that in most instances only a single copy at a time is being made It has been found that at a location for which such a convenience copier is useful, the average number of copies made for each use of the machine, is about 1.3 copies. It will readily be appreciated that a short first copy time is an extremely important consideration for a copier which will be used as a convenience copier.

Further desiderata, not only for copiers of the type discussed hereinabove, but for all copiers, include accessibility of all points on the paper path without removal of machine parts, so as to permit paper jams to be cleared by operating personnel to reduce the frequency of service calls. Parts or subassemblies of the machine should be readily removable and replaceable for ease of servicing. It is further desirable that the pick-off element of the machine not be in continuous engagement with the surface of the drum.

In all of the copying machines of the prior art of which applicant is aware, the copy is delivered to the output tray or the like of the machine by pushing or propelling the copy out of the machine toward the delivery tray. Such an operation results in an output stack made up of sheets the leading edges of which are not precisely aligned. If a further operation of, for example, stapling the stack of output copies, is to be performed, some auxiliary means must be provided for precisely aligning the leading edges of the sheets making up the output stack.

FIELD OF THE INVENTION

My invention relates to the field of electrophotography and, more specifically, to the field of electrophotography in which a photoconductive surface has both rotational and translatory movement in the course of a copying operation.

DESCRIPTION OF THE PRIOR ART

One of the factors contributing to first copy speed is the speed with which the copy material is transported from a supply to a point at which the leading edge of the finished copy terminates. Kushima et al U.S. Pat. No. 4,116,557 discloses an arrangement in which a carriage mounted for translatory movement from one end of a machine toward another, with a forward stroke and a return stroke, rotatably supports a drum on which an image is to be formed. Interengageable elements on the base of the machine cabinet and on the carriage provide the drive for rotating the drum as the carriage translates driving its forward stroke to permit a latent image to be formed thereon. This latent image is transferred to a length of copy material which advances through a transfer station synchronously with the movement of the drum surface, while at the same time being carried across the machine by the movement of the carriage.

After the carriage has reached the limit of its travel, the sheet carrying the latent image is moved through a stationary liquid developer system in which the latent image is developed before the copy is delivered to the user. While this arrangement provides an increase in the speed of movement of the length of copy paper from the supply to the liquid developer system over a machine in which there is no translatory movement of the drum, the total time for making a copy is not appreciably shortened owing to the necessity for carrying the length through the liquid developer system following the forward stroke of the carriage.

These patentees further suggest that the carriage might be provided with a dry developer system for developing the image. However, even if this were done, since the rotation of the drum is derived from the forward translatory movement of the carriage, the latter would have to be driven through a sufficient distance beyond that necessary for scanning to complete the development, transfer and delivery operations.

Akamatsu U.S. Pat. No. 4,077,711 discloses a copier of the type described hereinabove in which the original or document to be copied is moved relative to a stationary optical system comprising a fiber optic lens and in which a liquid developer is employed. This patentee finds it necessary to go through two complete cycles of operation for each copy to be made. In the course of the first cycle, the charging, exposure, development, and transfer operations take place. In the course of the second cycle, the drum cleaning operation is performed. The ostensible reason for requiring two such cycles for each copy to be made is that any other arrangement either would result in or would require a complex arrangement for preventing the flow of cleaning liquid to the transfer station at which the liquid might interfere with the transfer operation.

SUMMARY OF THE INVENTION

One object of my invention is to provide an improved method and apparatus for electrophotography which results in an extremely fast first copy time.

Another object of my invention is to provide an improved apparatus for electrophotography which is inexpensive to manufacture while at the same time readily adapting itself to being upgraded.

Yet another object of my invention is to provide an improved apparatus for electrophotography which is simple in its construction and in its operation.

A further object of my invention is to provide an improved liquid developer electrophotographic apparatus in which the transfer station is located below both the developing station and the cleaning station, while all operations are carried out in a single, continuous cycle of operation of the machine.

A still further object of my invention is to provide an improved electrophotographic apparatus in which all points along the copy paper path are readily accessible without removal of any of machine parts.

Yet another object of my invention is to provide an improved electrophotographic apparatus, all of the major components of which are readily removable and replaceable for servicing.

Still another object of my invention is to provide an improved electrophotographic copying machine in which movement of a copy sheet, the leading edge of which has engaged a stop on the output tray, is positively controlled until the copy is completely deposited in the tray.

Still another object of my invention is to provide an improved method and apparatus for electrophotography in which the leading edges of successive copies stacked in an output tray are precisely aligned, even where the copies are of mixed sizes.

A still further object of my invention is to provide an improved method and apparatus for electrophotography in which the copying process initiated during the forward stroke of a reciprocating processing unit is not completed until a point during the return stroke of the unit.

Yet another object of my invention is to provide an improved liquid developer eletrophotographic apparatus which incorporates a fiber optics lens while not requiring a separate cleaning cycle.

Still another object of my invention is to provide an improved electrophotographic apparatus incorporating a reciprocating processing unit in which reversal of the unit is achieved without appreciable vibration.

Another object of my invention is to provide an improved electrophotographic apparatus having means for automatically preventing the platen cover from falling away from the platen when the machine lid is moved to fully open position.

Other and further objects of my invention will appear from the following description.

In general, my invention contemplates the provision of an improved method and apparatus for electrophotography in which a processing unit carrying a photoconductor drum, an exposure system, a liquid developer applicator, an excess liquid removal member, and a cleaning member is mounted for reciprocating movement with a forward stroke and a return stroke below a platen supporting the original document and in which drive means is provided for translating the unit and for rotating the drum in synchronism with the translatory movement of the unit. A paper handling unit carrying a pair of registration rolls, a transfer corona, a copy paper pick-off, and a pair of delivery rolls, is mounted for reciprocating movement between a registration position at which its registration rolls receive a sheet from a supply of copy material and a position adjacent to the delivery end of the machine. In operation, the processing unit moves from its home position toward the registration position as the initial part of the image of the original is formed and developed. As it moves through the registration location, the processing unit picks up the paper handling unit and automatically provides a drive for the rollers thereof as the two units move together toward the delivery end of the machine. As the leading edge of the copy engages the end of the delivery tray, movement of the units reverses and the copy delivery operation is completed during this reverse movement, before the paper handling unit returns to the registration position.

BRIEF DESCRIPTION OF THE DRAWINGS

In the accompanying drawings to which reference is made in the instant specification and which are to be read in conjunction therewith, and in which like reference numerals are used to indicate like parts in the various views:

FIG. 13 is a front elevation of the traveling processing unit of my improved apparatus for electrophotography, with some parts broken away and with other parts shown in section.

FIG. 14 is a rear elevation of the traveling processing unit of my improved apparatus for electrophotography with parts broken away, showing the driving elements of the unit.

FIG. 17 is an end elevation of the optical system of my improved apparatus for electrophotography with parts broken away and with other parts shown in section.

FIG. 19 is a rear elevation of the traveling paper handing system of my improved apparatus for electrophotography with parts broken away.

FIG. 30C is a flow chart of the final portion of the idle portion of the program.

FIG. 31A is a flow chart illustrating the initial portion of the "print" program of operation of my improved apparatus for electrophotography.

FIG. 32B is a flow chart of an intermediate portion of the clock-interrupt program of operation of my improved apparatus for electrophotography.

DESCRIPTION OF THE PREFERRED EMBODIMENT

Figure 1:
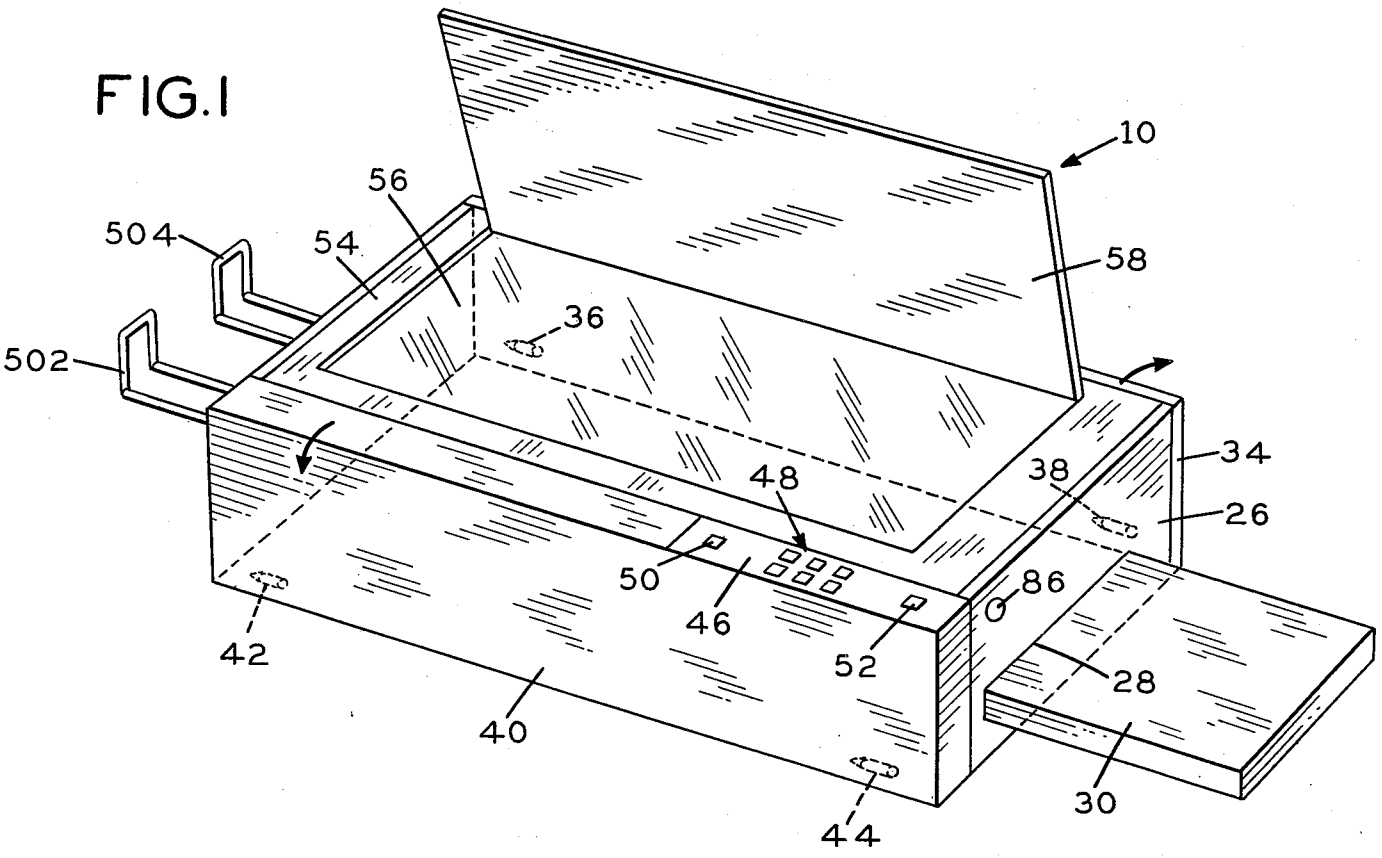
FIG. 1 is a perspective view of my improved apparatus for electrophotography illustrating the overall configuration thereof.
Figures 2, 2A, 2B:
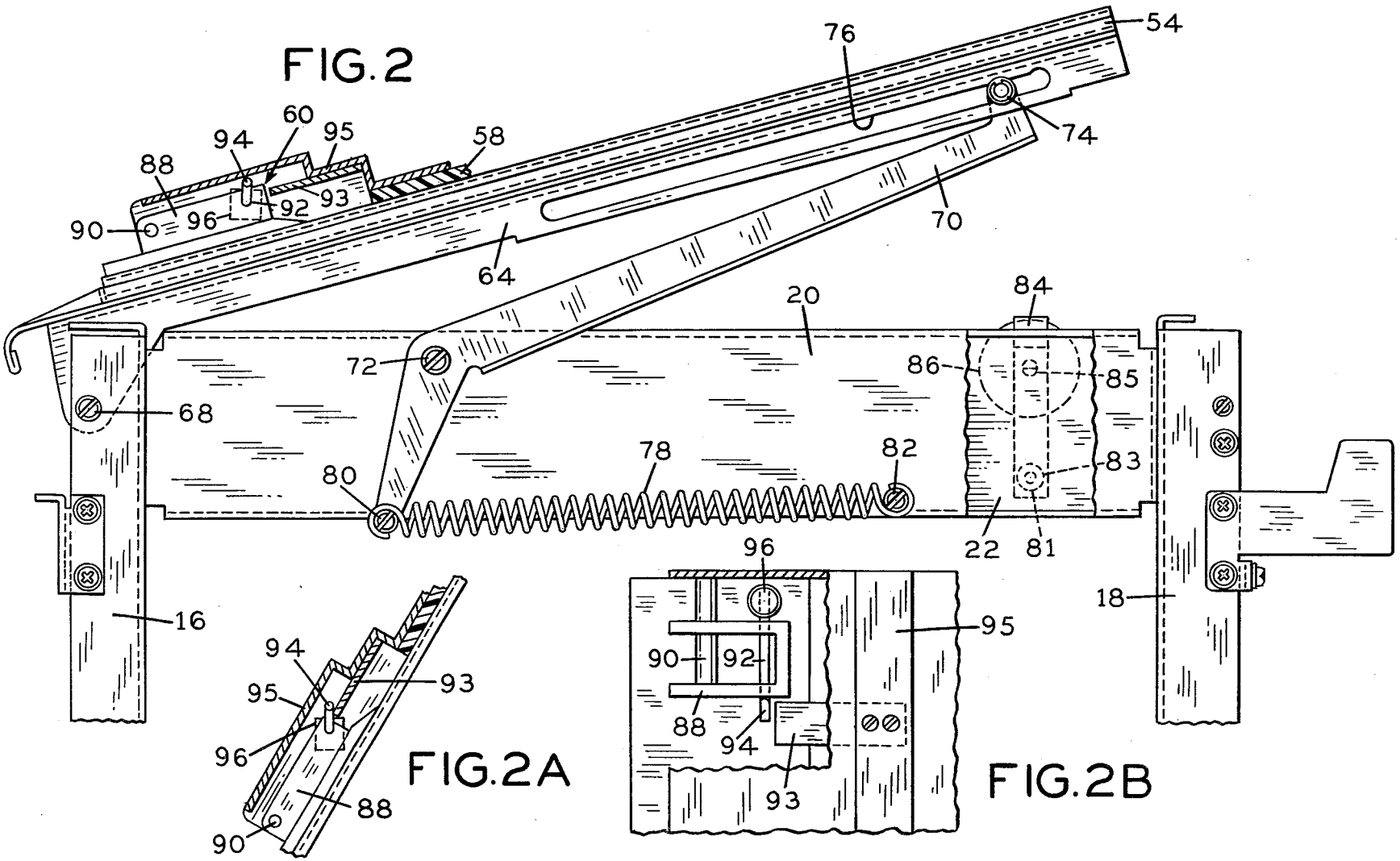
FIG. 2 is a fragmentary side elevation of my improved apparatus for electrophotography with parts broken away and with other parts shown in section to illustrate the details of the machine lid mounting and of the platen cover arrangement.
FIG. 2A is a fragmentary view of the lid of my improved electrophotographic apparatus illustrating the platen cover lock.
FIG. 2B is a fragmentary top plan of a portion of the lid of my improved electrophotographic apparatus with parts broken away and with other parts in section.

Referring now to FIGS. 1 to 8 of the drawings, my improved apparatus for electrophotography indicated generally by the reference character 10, includes a base 12 supported by a plurality of feet 14. A rear wall 16 and a front wall 18 extending upwardly from the base 12 are connected at the upper left ends thereof by a first crosspiece 20 and at the upper right ends thereof by a second crosspiece 22. Any suitable means, such for example as screws 24, may be employed to secure the crosspieces to the front and rear walls 18 and 16.

My machine includes a right end cover 26 secured to the front and rear walls by any suitable means such as screws or the like. Cover 26 has an opening 28 through which a cassette 30 containing a supply of paper can be inserted into the machine in a manner to be described hereinbelow. The cassette 30 includes a paper support plate 32 which normally rests on the bottom of the cassette and which is acted upon in a manner to be described hereinbelow to bring the uppermost sheet of paper in the cassette into engagement with a paper feed roll to be described.

A rear cover 34 of my machine 10 is pivotally supported on a pair of hinge pins 36 and 38, carried by brackets on rear wall, for movement between a closed position and an open position. Any suitable means known to the art, such for example as magnets (not shown) may be employed to hold the rear cover in its closed position. Similarly, any suitable means such for example as chains (not shown) may be employed to limit the opening movement of the rear cover.

My machine includes a front cover 40 pivotally supported on respective hinge pins 42 and 44 carried by the front wall 18. As with the rear cover 34, any suitable means such for example as magnets (not shown) may be employed to hold the front cover in its closed position while any means such for example as chains (not shown) may be employed to limit the movement of the cover to its open position.

In the particular embodiment of my invention illustrated in the drawings, the front cover 40 may act as a housing for the electronics package associated with the machine. The upper surface of the cover 40 carries a control panel 46 provided with suitable push buttons and the like for controlling the operation of the machine. For example, a first battery of buttons, indicated generally by the reference character 48, may be operated to set the machine to make a predetermined number of copies. A switch 50 in the keyboard 46 may be provided to permit the operator to select one of a number of cassettes associated with the machine in a manner to be described hereinbelow. A pushbutton 52 may be actuated to initiate the operation of the machine. In addition, panel 46 may be provided with a display for indicating various conditions, such as exhaustion of the paper supply, the condition of the developer and the like to be described.

My machine 10 includes a lid 54 carrying a glass platen 56 upon which the original to be copied may be placed face down during the copying operation. A platen cover 58 is supported by a pair of gravity locking hinges indicated generally by the respective reference characters 60 and 62 for movement between a position away from the platen to permit a document to be placed face down thereon and a position at which it covers the document. Respective lid supporting arms 64 and 66 receive pivot pins 68 carried at the respective ends of the rear bulkhead so as to support the lid and the platen carried thereby for movement from closed position, at which the lid lies flat, to an open position at which all of the operating parts of the machine are readily accessible in a manner to be described more fully hereinbelow.

The crosspieces 20 and 22 carry respective pivot pins 72 supporting bell cranks 70 associated with the respective arms 64 and 66. The end of one arm of each bell crank 70 carries a roller 74 which is adapted to ride in a slot 76 in its associated arm 64 or 66. Respective springs 78 extend between pins 80 on the other arms of the bell cranks and pins 82 on the respective crosspieces 20 and 22, so as to bias the lid 54 to a partially open position. A resilient catch 84 at the front of the machine normally engages arm 66 to hold the lid 54 closed against the action of springs 78. More specifically, a screw 81 and spacer 83 mount the spring finger catch 84 on crosspiece 22 at a position at which it engages in the slot 76 in arm 66 when lid 54 is closed releasably to hold the lid down against the action of springs 78. A pushbutton 86 mounted in a bezel in cover 26, is adapted to be actuated to cause a rod 85 to release the catch 84 to permit the springs 78 to move the lid 54 to its partially open position. When that occurs, the operator can readily manually move the lid to its fully open position as determined by the length of the slots 76 or by limit chains (not shown). With the lid in this position, the gravity responsive hinges 60 and 62 prevent the cover 58 from falling backwardly away from the platen 56.

Each of the gravity locking hinges 60 and 62 includes a bracket 88 secured to the lid 54. A pivot pin 90 on each bracket 88 is received in a bracket 95 secured to cover 58 so as normally to permit the operator to swing the platen cover 58 upwardly away from the platen 56. Each hinge 60 and 62 also includes a shaft 92 pivotally supported on the bracket 88 at a location forward of the pivot 90. One end of the shaft 92, extending outwardly of the bracket 88 is formed with an offset 94. The other end of the shaft 92 extending outwardly of the bracket carries a weight 96. I secure respective stop plates 93 to the underside of a step in bracket 95 to form pockets adjacent to the respective offsets 94.

When the lid 54 is in its normal closed position in which it is generally horizontal, as the platen cover 58 is swung upwardly around the pivot pins 90 offsets 94 clear the pockets formed by plates 93. It will readily be appreciated that when lid 54 together with cover 58 is swung open, weight 96 and the offset 94 tend to remain in the same position under the influence of gravity. Ultimately offsets 94 move into the pockets formed by plates 93 to prevent cover 58 from pivoting around the pins 90. Stated otherwise, as the lid 54 is moved to its fully open position the gravity locks 60 and 62 prevent the platen cover 58 from swinging away from the lid 54.

My machine includes a pair of front and rear main slide rods 98 and 100, supported on brackets 102 carried by the machine frame. As will more fully be explained hereinbelow, the main slide rods 98 and 100 support respective units indicated generally by the reference characters 104 and 106 for translatory movement left and right of the machine. The unit 104 is the processing unit comprising the machine optics, the photoconductor drum, the machine corona, the developer applicator, the reverse roller or metering roller, and the cleaning assembly. The paper handling unit 106 carries those parts which are involved in the registration, pick-off, transfer, and exiting functions.

Figure 4:
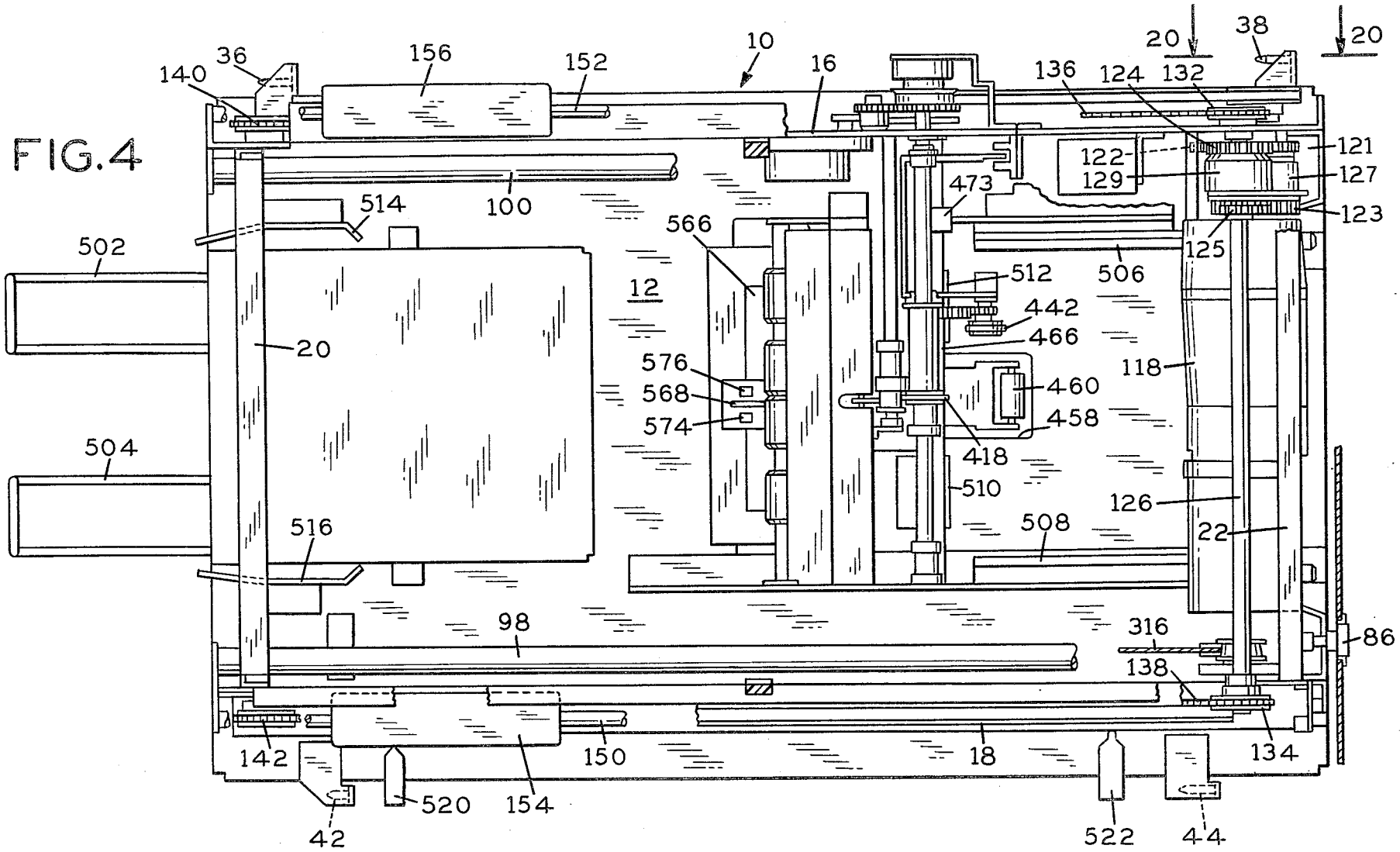
FIG. 4 is a top plan of my improved apparatus for electrophotography with parts removed to illustrate the relationship of the various driving components of the machine.
Figures 8, 9, 12:
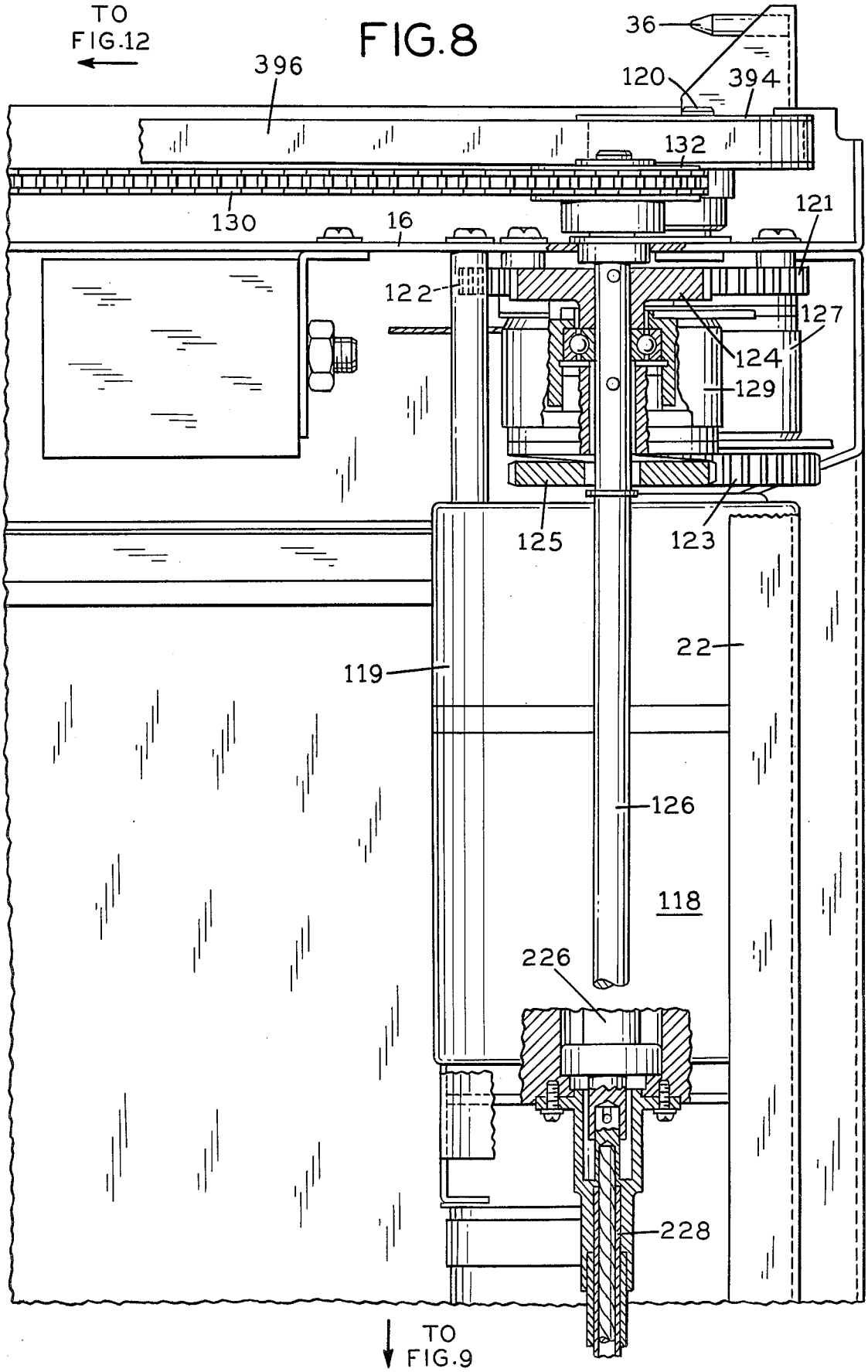
FIG. 8 is a fragmentary top plan of the rear right-hand portion of my improved apparatus for electrophotography illustrated in FIG. 3, drawn on an enlarged scale and with parts broken away.
FIG. 9 is a fragmentary top plan of the portion of my improved apparatus for electrophotography shown in the lower right-hand corner of FIG. 3 and drawn on an enlarged scale with some parts broken away.
FIG. 12 is a fragmentary top plan of my improved apparatus for electrophotography illustrating the upper central portion of the machine shown in FIG. 3 on a larger scale with some parts broken away and other parts shown in section.
Figure 9:
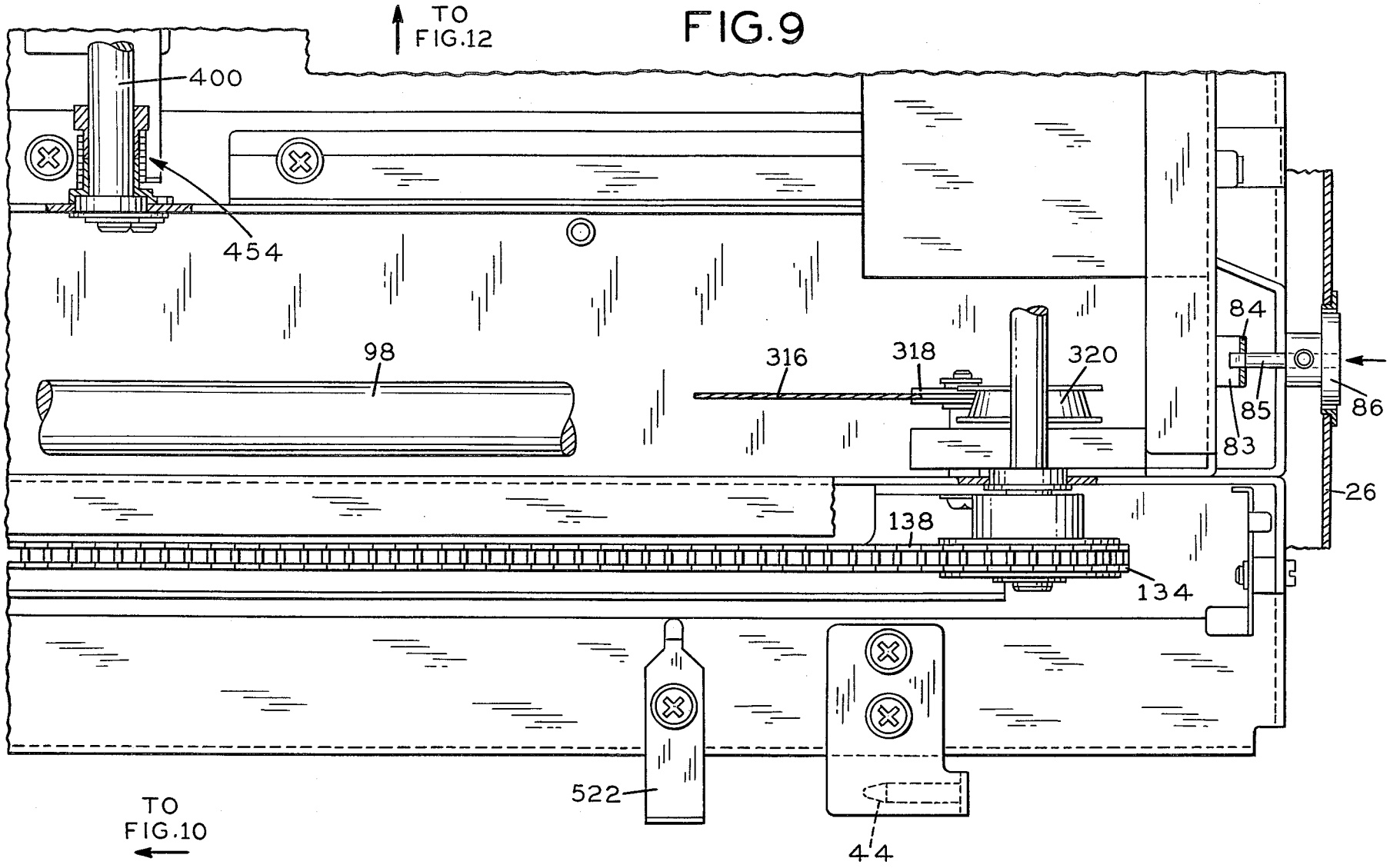
Figure 20:
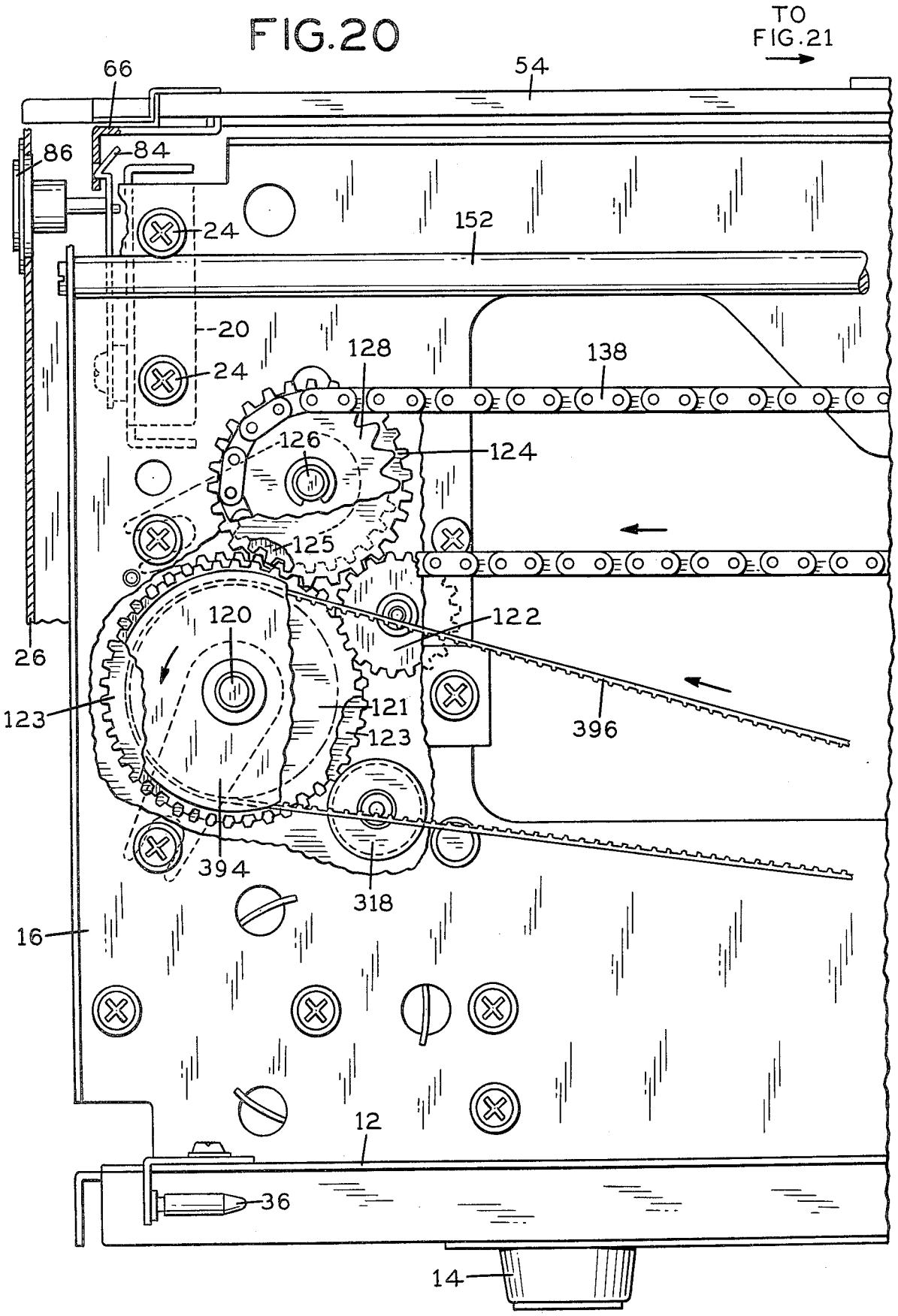
FIG. 20 is a fragmentary rear elevation of the right-hand side of my improved apparatus for electrophotography illustrating certain components of the drive system of the the machine.
Figure 21:
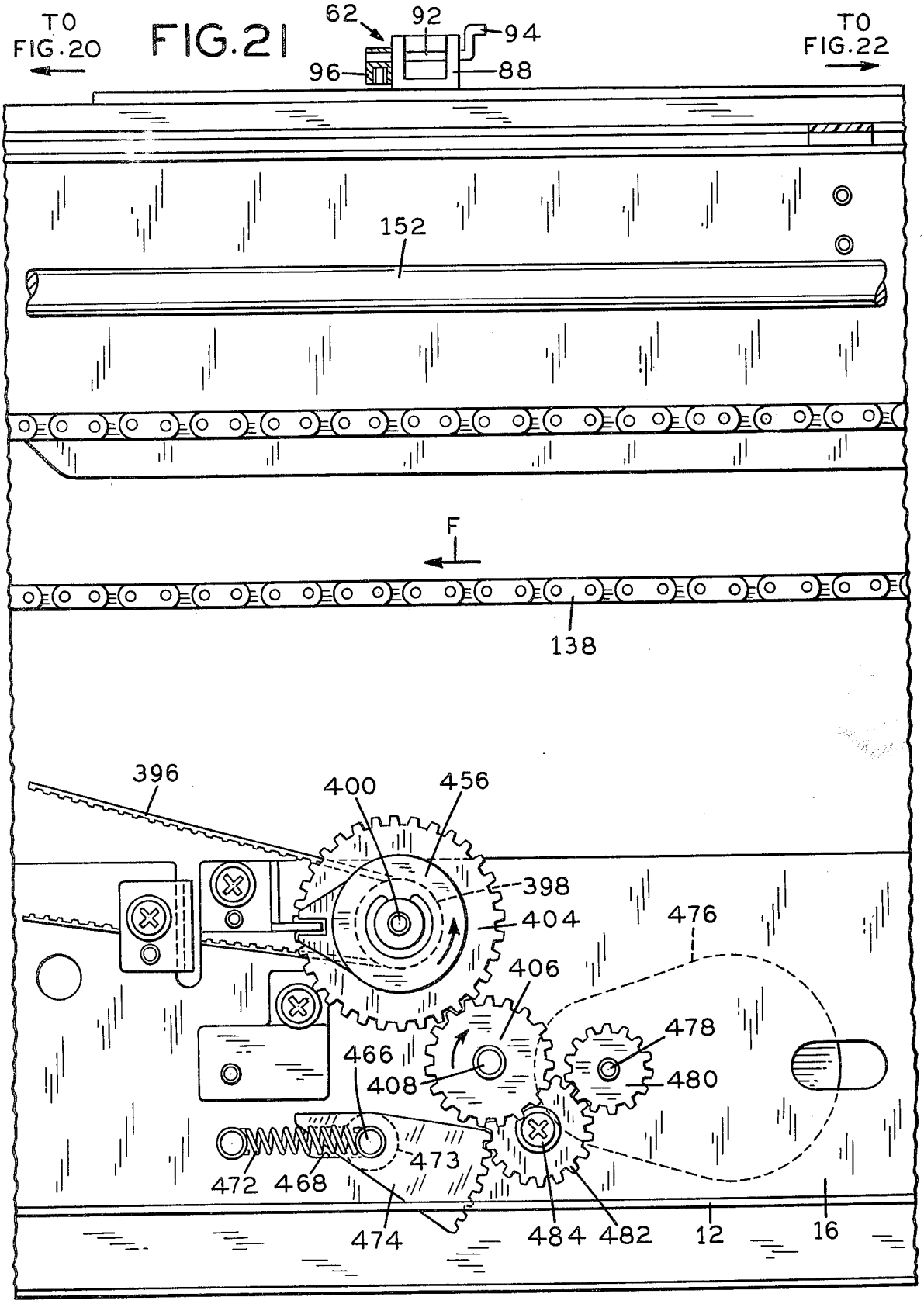
FIG. 21 is a fragmentary rear elevation of the central portion of my improved apparatus for electrophotography.
Figure 22:
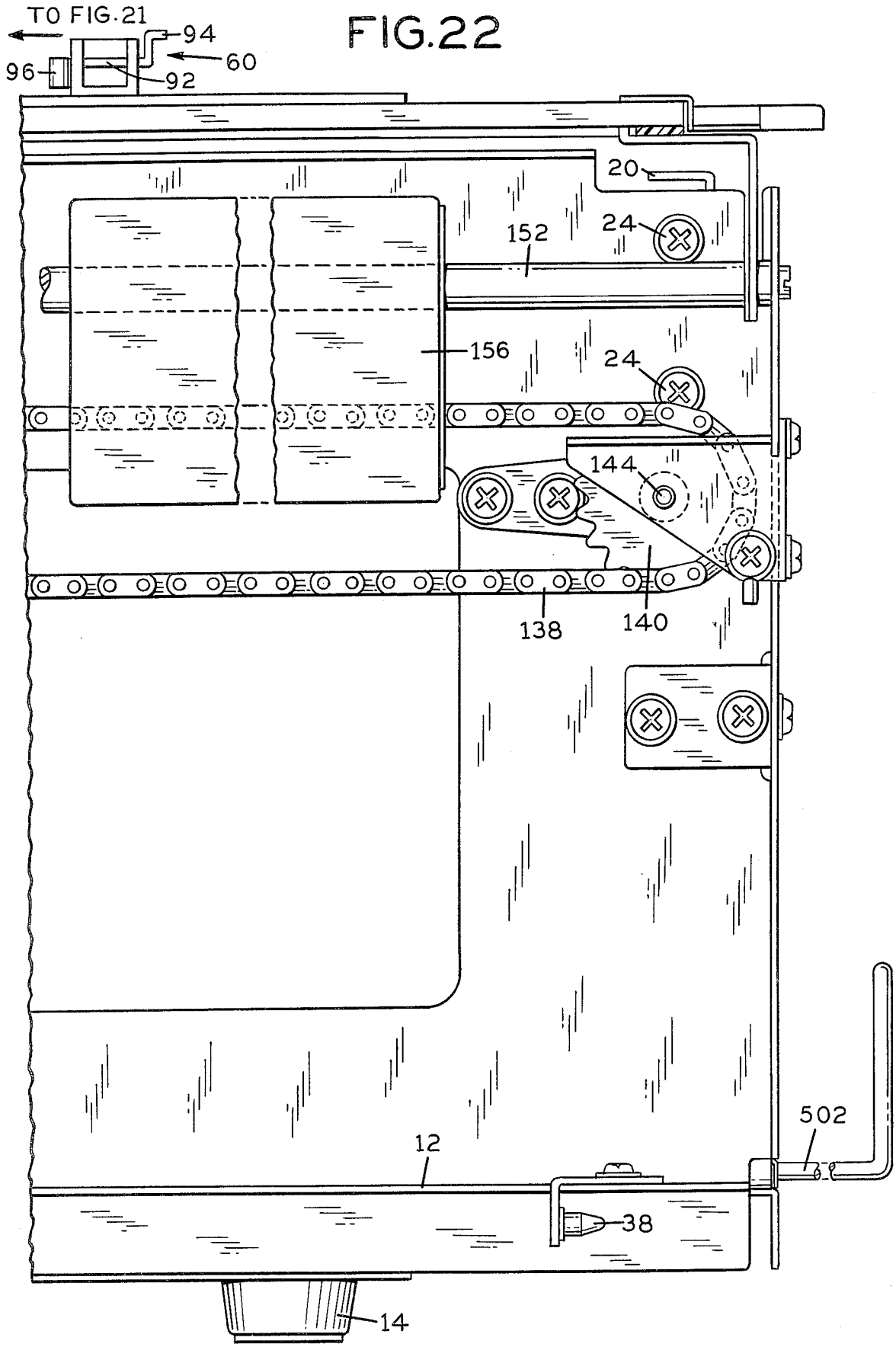
FIG. 22 is a fragmentary rear elevation of the left-hand side of my improved apparatus for electrophotography.

Referring now to FIGS. 4, 8, and 20, the drive system of my copier includes a main drive motor 118. It is to be understood that the forward scan drive direction is the direction of movement of the subassembly 104 from its initial position toward the discharge end of the machine and the reverse scan direction is from the exit end of the machine back toward the home position of the subassembly 104.

One end of the shaft of the main drive motor 118 provides the input to a speed reduction gear box 119, the output of which is at the main drive shaft 120 which loosely supports a forward clutch gear 121 and which carries for rotation therewith a reverse scan drive gear 123. Gear 121 engages a forward scan idler gear 122 which drives a forward scan driver gear 124 carried by a right-hand scan driver shaft 126 for rotation therewith. Gear 123 drives a reverse clutch gear 125 loosely carried on shaft 126.

When a forward scan clutch 127 is energized in a manner to be described gear 121 is clutched to shaft 120 so that gear 124 is driven through idler 122 to rotate shaft 126 in that direction which corresponds to the forward scanning direction. When a reverse scan clutch 129 is energized gear 125 is clutched to shaft 126 so that gear 123 drives gear 125 to rotate the shaft in a direction corresponding to the reverse scan direction.

The right-hand scanner shaft 126 which is rotatably supported in the front and rear walls 18 and 16 of the machine, carries respective sprocket wheels 132 and 134 which drive respective rear and front pitch chains 136 and 138. The chains 136 and 138 extend from right to left of the machine and engage left-hand sprocket wheels 140 and 142 carried by the left-hand scanning shaft 144 which is supported in the front and rear walls 18 and 16 of the machine in a manner similar to that in which shaft 126 is supported. As will be described in detail hereinbelow, unit 104 is connected to the chains 136 and 138 so as to be driven in reciprocating movement with a forward stroke and a return stroke.

Figure 7:
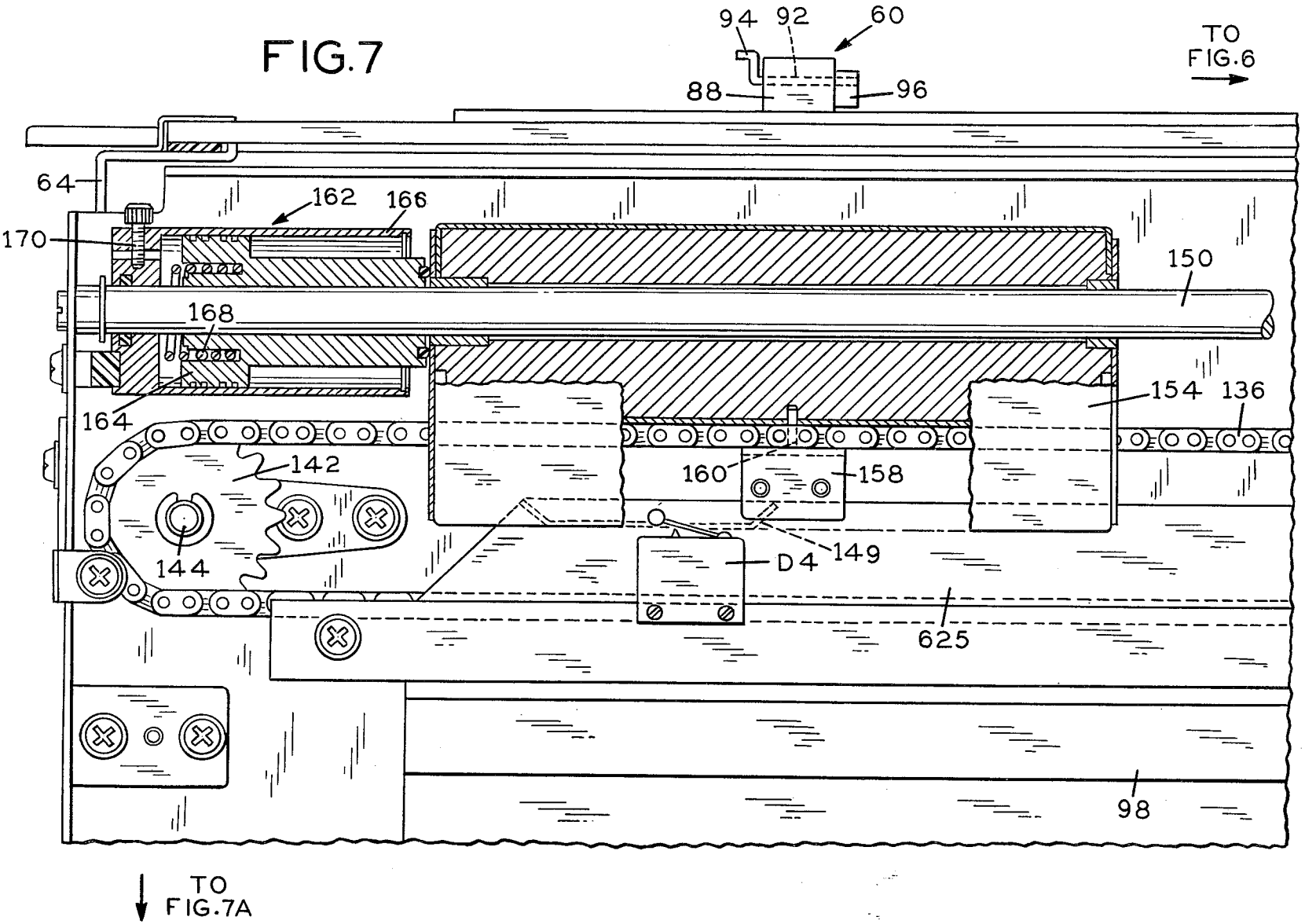
FIG. 7 is a fragmentary elevation of the upper left-hand portion of my improved apparatus for electrophotography drawn on an enlarged scale with parts broken away and with other parts shown in section.
Figure 7A:
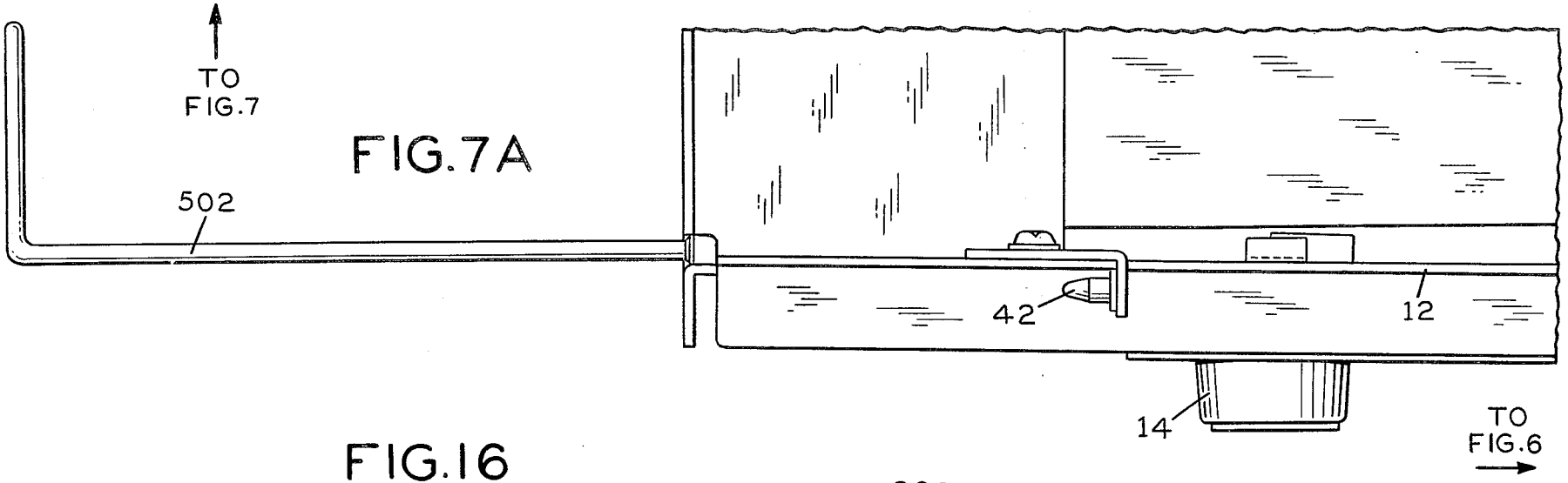
FIG. 7A is a fragmentary elevation of the lower left-hand front portion of my improved apparatus for electrophotography drawn on an enlarged scale.
Figure 16:
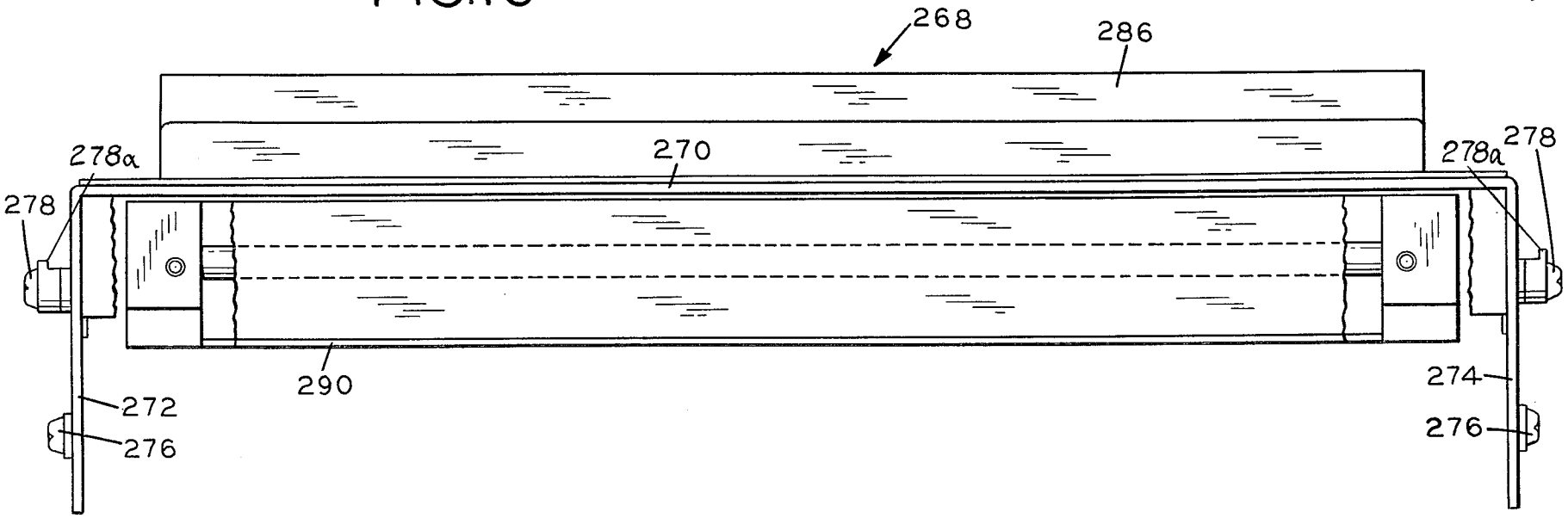
FIG. 16 is an elevation of the optical system of my improved apparatus for electrophotography with parts broken away.

Referring to FIGS. 4 and 7, I mount respective front and rear counterweight slide rods 150 and 152, in spaced relationship adjacent to the top of my machine. The slide rods 150 and 152 support respective counterweights 154 and 156. Each counterweight 154 and 156 carries a coupler 158 including a pin 160 adapted to engage the upper reach of one of the respective pitch chains 136 and 138. As will be apparent from the description hereinbelow, I so calculate the mass of each of the counterweights as to counteract the mass of the weight which must be driven by the lower reaches of the pitch chains 136 and 138. It will further be apparent from the description hereinbelow that when scanning is taking place in the forward direction, the counterweights are moving in the reverse direction and vice versa. Owing to the provision of these counterweights, I am able to accelerate and reverse the direction of movement of the parts with very little shock so as to avoid any distortion of the copy which might otherwise occur.

I provide a respective damper assembly indicated generally by the reference character 162, associated with each of the counterweights 154 and 156. One of the assemblies 162 includes a piston 164 having a rod portion which slides on its associated rod 150 or 152 and extends outwardly of a housing 166. A spring 168 normally urges the piston to a position at which its rod portion extends outwardly of the housing. As a counterweight moves into engagement with the rod portion, the piston head moves inwardly against the action of the spring 168. At the same time, it drives air out of the housing through a damper valve 170 to enhance the damping action.

Figure 15:
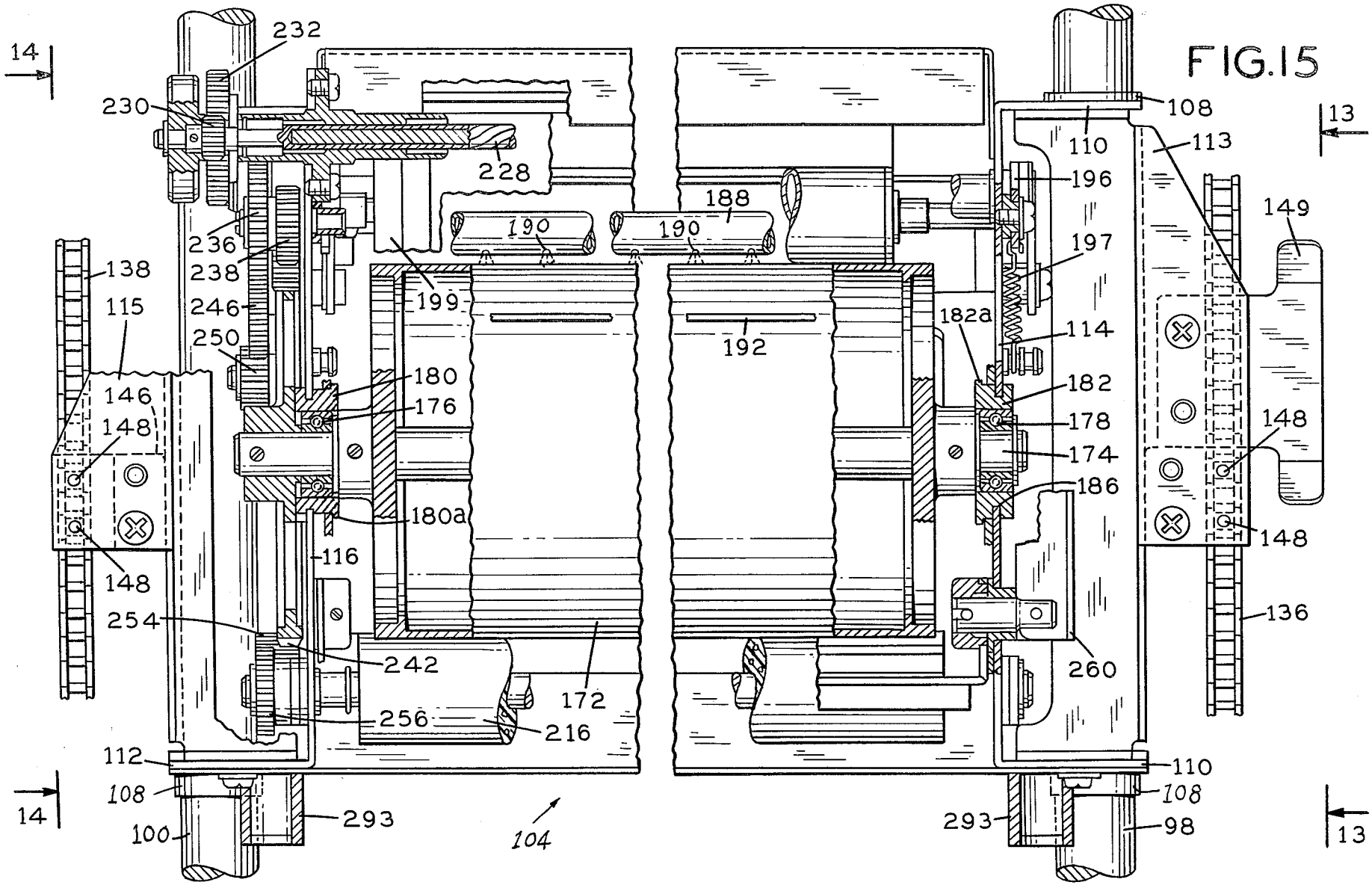
FIG. 15 is a top plan of the traveling processing unit of my improved apparatus for electrophotography with some parts removed, with other parts broken away, and with still other parts shown in section.

Referring now to FIGS. 13 to 15, considering first the unit 104, it is supported on the main slide rods 98 and 100 by a plurality of bushings 108 carried by a front flanges 110 on the front wall 114 and flanges 112 on the rear wall 116 of the processing subassembly 104. I provide the unit 104 with respective front and rear brackets 113 and 115 carrying respective couplers 146 having pairs of pins 148 which are adapted to engage the respective pitch chains 136 and 138 so as to provide a driving connection between the pitch chains and the subassembly 104. Bracket 113 carries a switch actuator 149.

The photoconductor drum 172 of my machine has a shaft 174 supported in respective bearings 176 and 178 carried by housings 182 and 184 adapted to be received in respective slots 184 and 186 of the end walls or plates 116 and 118 of the subassembly 104.

A tube 188 at the developer station extends across the subassembly 104 between the plates 114 and 116. Developer liquid is supplied to tube 188 in a manner to be described hereinbelow. The tube 188 is provided with a plurality of holes 190 which direct developer up against a distributor plate 192 so as to provide what is very nearly a continuous sheet of developer liquid which flows downwardly from the plate onto the surface of the drum 172. Preferably I provide the assembly with a cover 194. Respective arms 196 on the plates 114 and 116 rotatably support the developer roller 198. Springs 197 urge arms 196 to position spacer rings 199 on the ends of roller 198 against the drum to space the roller surface a predetermined distance from the drum surface. The spacing between the surface of roller 198 and the surface of drum 172 may, for example, be 0.5 mm. The developer roller wiper 200 is supported on a shaft 202 carried in the end plates 114 and 116 and biased by a spring 204 into engagement with the surface of the applicator roller 198.

A pair of reverse roller arms 206, carried on the plates 114 and 116 support the metering or reverse roller 208 which is spaced slightly from the surface of the drum 172 and which is driven with its surface moving in the direction opposite to the direction of movement of the drum surface, so as to reduce the thickness of the developer film on the drum surface to a predetermined thickness. Springs 207 act on arms 206 properly to position the roller 208 with ball bearings 209 or the like at the ends thereof in engagement with the drum surface. The outer rings of bearings 209 have outer diameters slightly greater than that of roller 208 to position the roller surface a predetermined distance from the drum surface in a manner known to the art. I provide the reverse roller 208 with a wiper 211. I provide my assembly with drum edge wipers 210 for ensuring that developer liquid at the edges of the drum is directed downwardly to a collector plate 212 leading to a discharge tube 214.

As will be explained more fully hereinbelow, after the imaged surface of the drum has moved away from the reverse roller, the images are transferred therefrom to a sheet of copy material such as plain paper. The imaged surface continues its rotational movement to the cleaning station at which I rotatably mount a cleaning roller 216 between the plates 114 and 116. A member 218 extends between the walls 114 and 116 at the cleaning station. I so form the member 218 as to provide a bend 220 which deforms the cleaning roller 216 which may be formed by relatively soft open or closed cell foam material. As the cleaning roller is driven in a manner to be described in a clockwise direction as viewed in FIG. 13, the foam roller is squeezed by bend 220 to cause liquid to drip from the squeezed roller into a catch tray 222 formed with an outlet 224 provided with a tube or the like for directing liquid from tray 222 to the collector plate 212 to flow from drain 214 back to the sump or developer tank to be described. It will readily be appreciated that the corner 220 which deforms the roll 216 squeezes the same so as to remove excess liquid therefrom and direct it into the catch tray 222.

I obtain the drive for the drum 172 and the parts of subassembly 104 from the motor 118. As can be seen by reference to FIGS. 8, 14, and 15, I connect motor rotor 226 to one end of a flexible shaft assembly 228, the other end of which carries a gear 230 which meshes with and drives a gear 232, which is unitary with a gear 234 which drives a gear 236 which is unitary with a gear 238 which drives the developer roller gear 240. Gear 240 drives the drum gear 242 so that the rotary movement of the drum 172 is synchronous with the translatory movement thereof. It will be noted further that drum 172 continues to be driven in the same direction after the translating movement of unit 104 reverses.

Gear 242 also drives the input gear 244 of a pair of unitary coaxial gears 244 and 246. Gear 246 drives gear 248 on the shaft of the reverse roller 208 to provide the correct direction of drive of the reverse roller.

Gear 242 also drives the input gear 250 of a pair of unitary gears 250 and 252. As will be explained more fully hereinbelow, gear 252 provides the drive for the registration roller system at the proper point in the cycle of operation of the machine.

The gear 242 also drives a gear 254 which drives a gear 256 on the cleaning roller shaft to drive the cleaning roller 216.

A pair of pressure levers 258 and 260 at the front and back of the subassembly 104 carry respective blade pressure eccentric discs 262 and 264 which rest in the upper ends of slots 184 and 186. I secure corresponding ends of levers 258 and 260 to the ends of a bracket 265 which carries the cleaning blade 266 (FIG. 13). These pressure levers 258 and 260 are positioned by the eccentric discs so as to bias the cleaning blade assembly into engagement with the surface of the drum with a predetermined pressure.

Referring now to FIGS. 13 to 17, the optical assembly indicated generally by the reference character 268 of my machine includes a generally U-shaped lens holder frame 270, having a pair of downwardly extending arms 272 and 274. The frame 270 supports the reflectors 280 and 282 associated with the exposure lamp 284 which direct light upwardly through the platen in the course of an exposure operation. I also mount a self-focusing fiber optic bar lens 286 on bracket 270 and provide it with a light shield 288. Bracket 270 carries the charging corona 290 and the quench lamps 292.

Each of the arms 272 and 274 carries a lower guide 276 and an upper guide 278. The optics assembly 268 is applied to the subassembly 104 before the arms carrying the cleaning blade 266 are positioned thereon. As the optics assembly 268 is positioned in place, arms 272 and 274 move downwardly inboard of rear wall 116 and front wall 114 of subassembly 104. As this takes place, the guides 276 and 278 ride downwardly along the slots 184 and 186 in the end plates 114 and 116 of the subassembly 104. Ultimately the recessed lower ends of arms 272 and 274 ride into the spaces between walls 116 and 114 and retaining flanges 180*a* and 182*a* on bearing housings 180 and 182. I also provide retainer flanges 278*a* on the outside of guides 278 when the optical system is thus positioned.

The convenience of the arrangement of the parts of the unit 104 just described is to be emphasized. Assuming that all of the parts thereof are in position, in order to disassemble the unit one first manually lifts the cleaning blade unit comprising arms 258 and 260 off the frame. Next the optical unit is manually removed by drawing the frame 270 vertically upwardly to slide the guides 276 and 278 out of the slots 184 and 186. When this has been done, the drum itself can be removed by sliding the bearing housings upwardly and out of the slots 184 and 186. It will readily be appreciated that the drive gear arrangement permits this to be accomplished without the use of tools. In this way any of the subassemblies can be removed and replaced with another subassembly without disabling the machine for any appreciable time such as might be required to repair or replace a damaged part. Moreover, the various units can be manually reassembled to restore the unit to operating condition.

Figure 18:
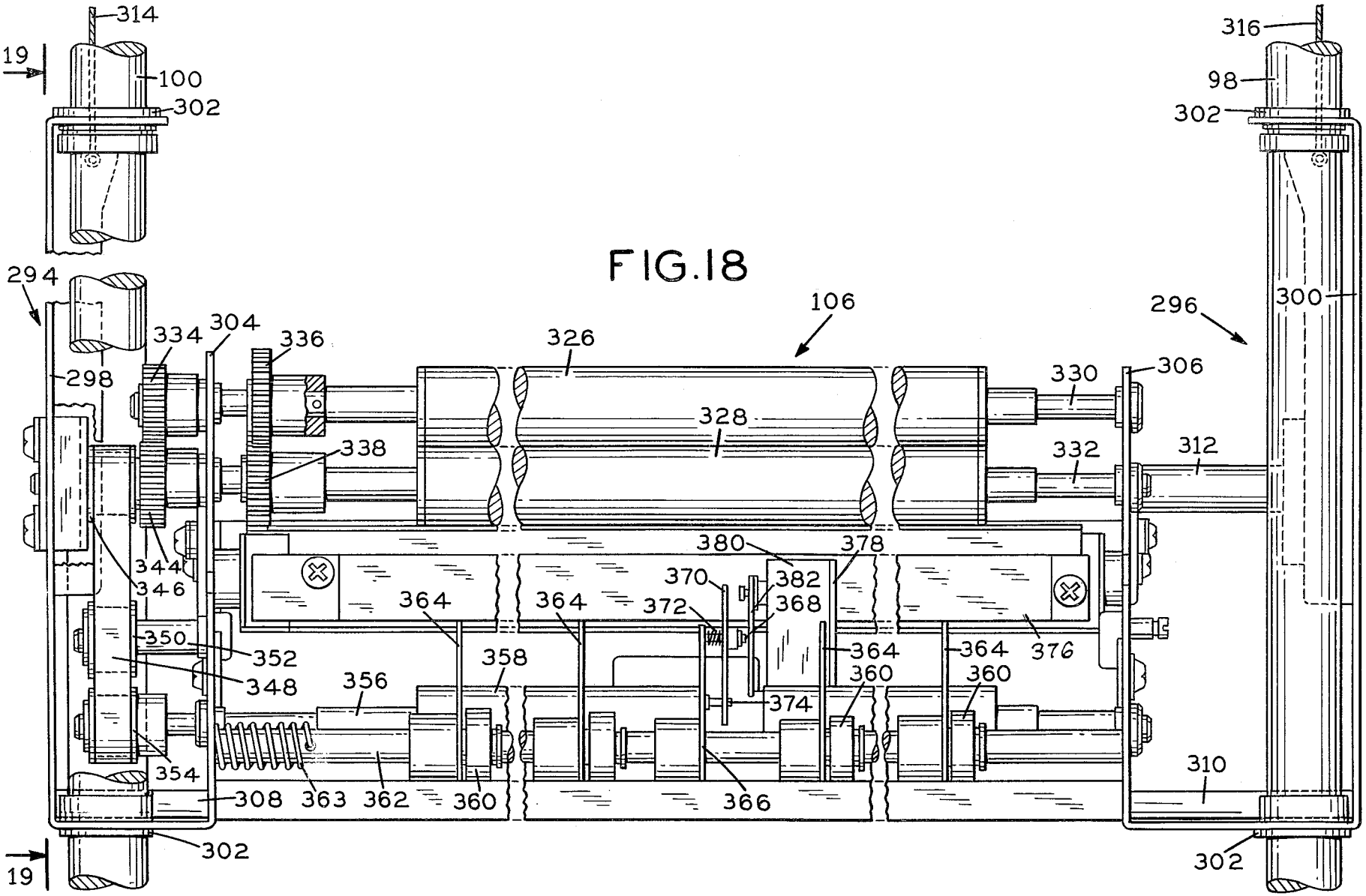
FIG. 18 is a top plan of the traveling paper handling unit of my improved apparatus for electrophotography with parts broken away and with other parts shown in section.

Referring now to FIGS. 18 and 19, as has been pointed out hereinbelow, the unit subassembly 106 likewise is supported for sliding movement on the main slide rods 98 and 100. More particularly, the unit 106 includes respective U-shaped front and rear walls, or brackets, indicated generally by the reference characters 294 and 296 having relatively longer legs 298 and 300, the ends of which receive bushings 302, which slidably support the members 294 and 296 on the rods 98 and 100. Respective shorter shaft supporting legs 304 and 306 of the members 294 and 296 are separated from the longer legs 298 and 300 by spacers 308 and 310 adjacent to the bases connecting the two legs of each of the members. In addition, a stud 312 separates the leg 306 from the leg 300 adjacent to the end of leg 306.

Figure 10:
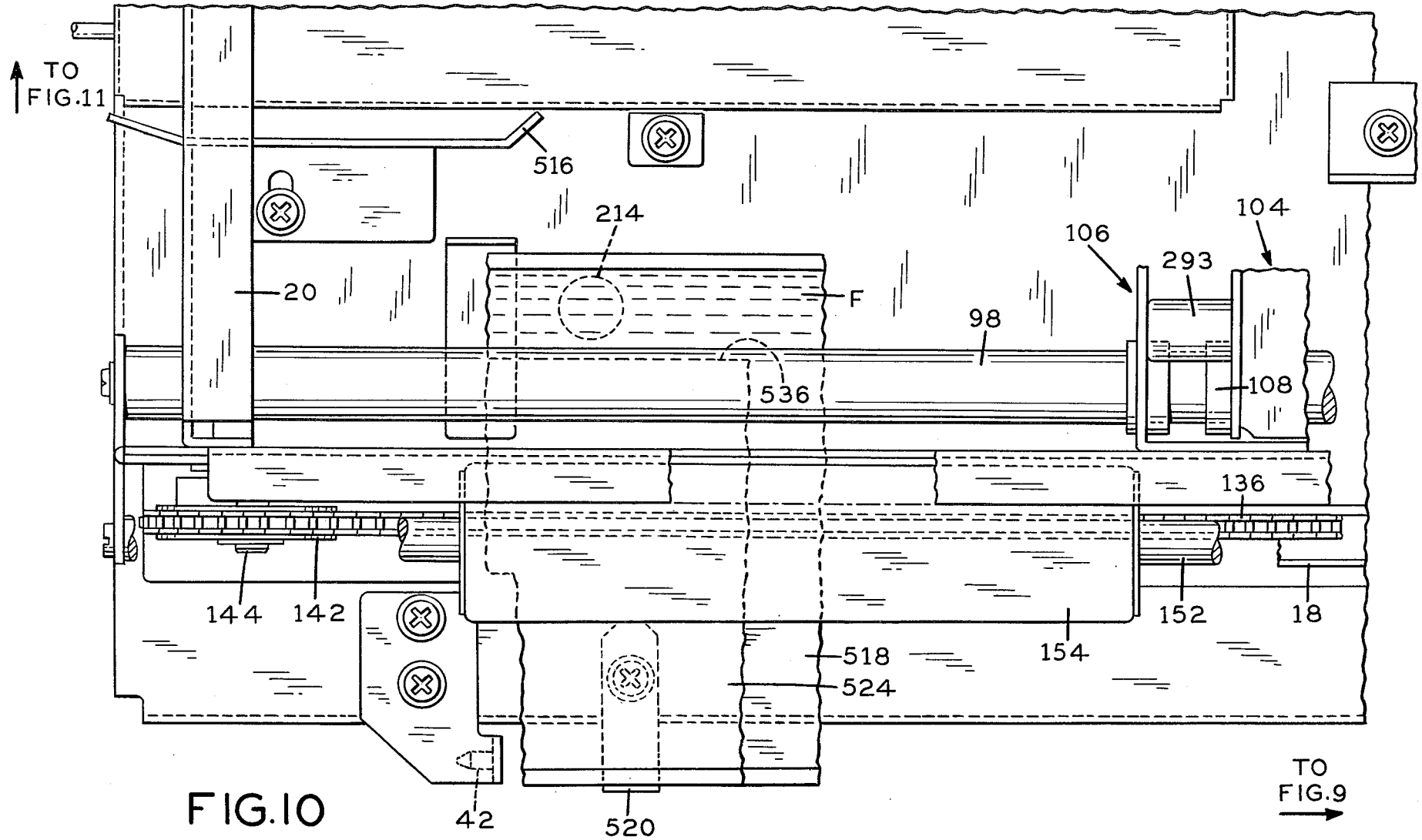
FIG. 10 is a fragmentary top plan of my improved apparatus for electrophotography illustrating the portion of the machine shown in the lower left-hand portion of FIG. 3 and drawn on an enlarged scale.
Figure 11:
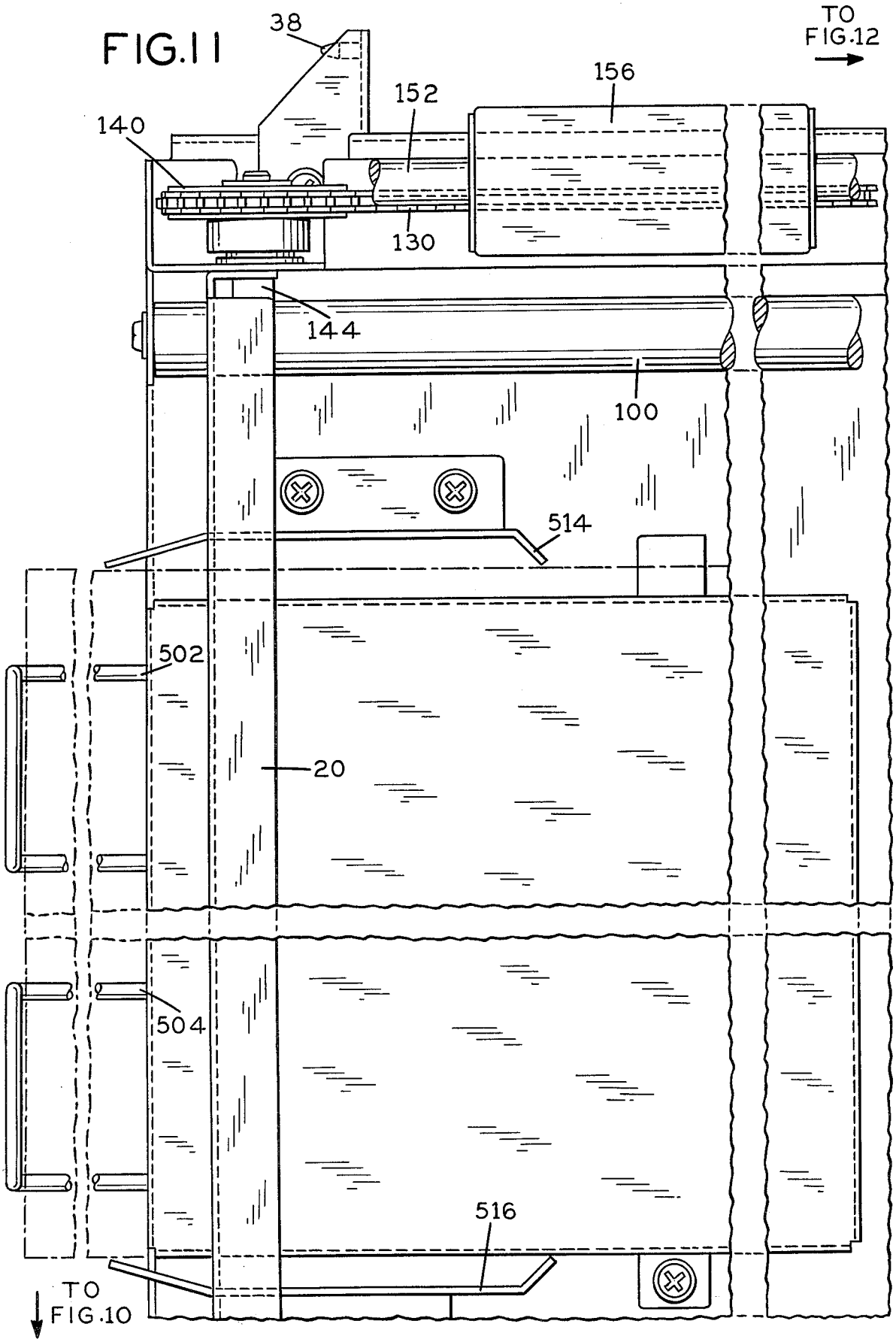
FIG. 11 is a fragmentary top plan of my improved apparatus for electrophotography illustrating the portion of the machine shown in the upper left-hand portion of FIG. 3 on an enlarged scale.
Figure 12:
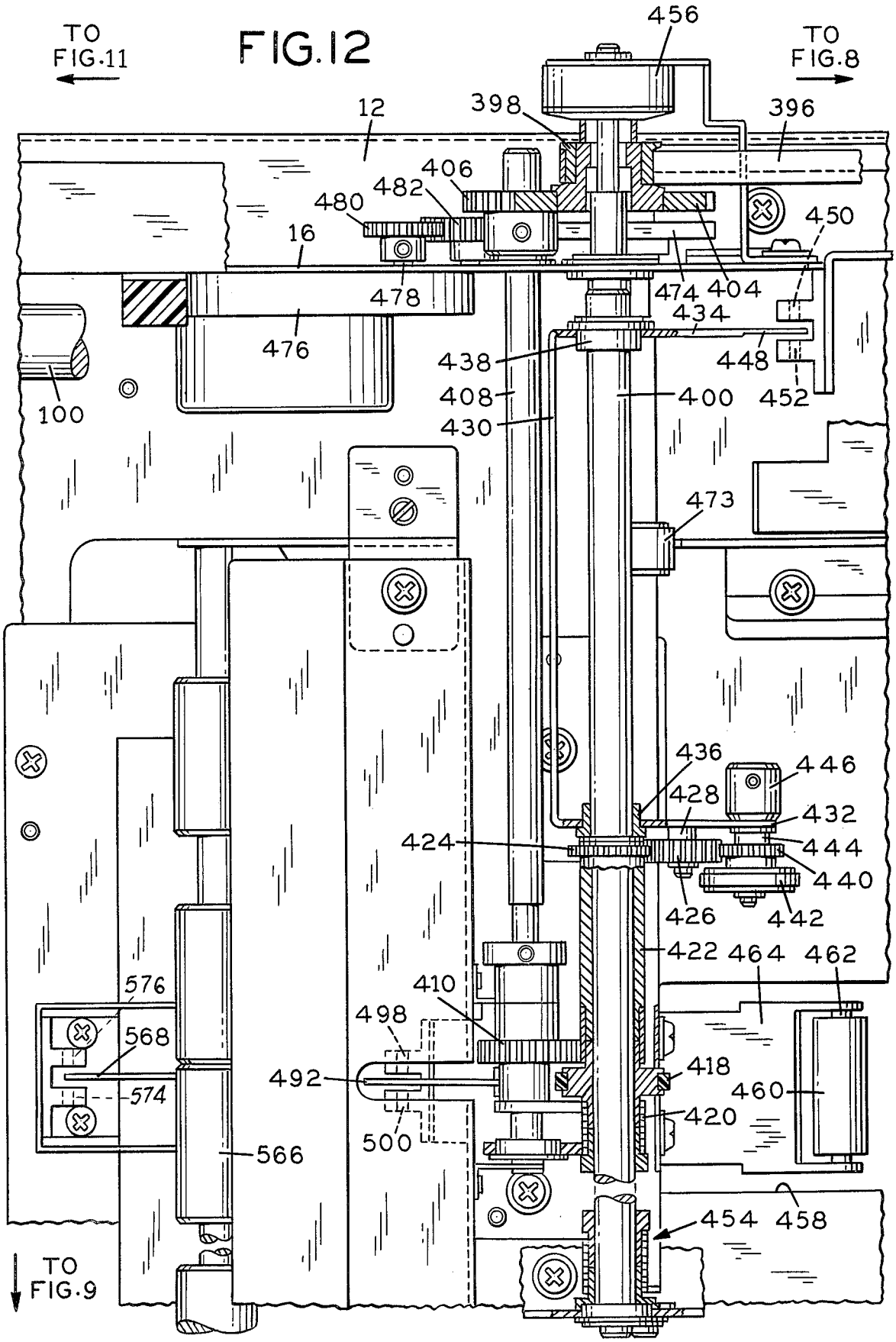

As will be apparent from the description hereinbelow, in the home position of the unit 106, the working parts thereof are adjacent to the center of the machine. In operation of the copier as the unit 104 moves from its home position toward the exit position of the machine, it picks up unit 106 and carries it toward the exit end of the machine. A pair of bumpers 293 on unit 104 engage the leg-connecting portions of brackets 294 and 296 as unit 104 picks up unit 106, as indicated in FIG. 10.

Figures 5, 6:
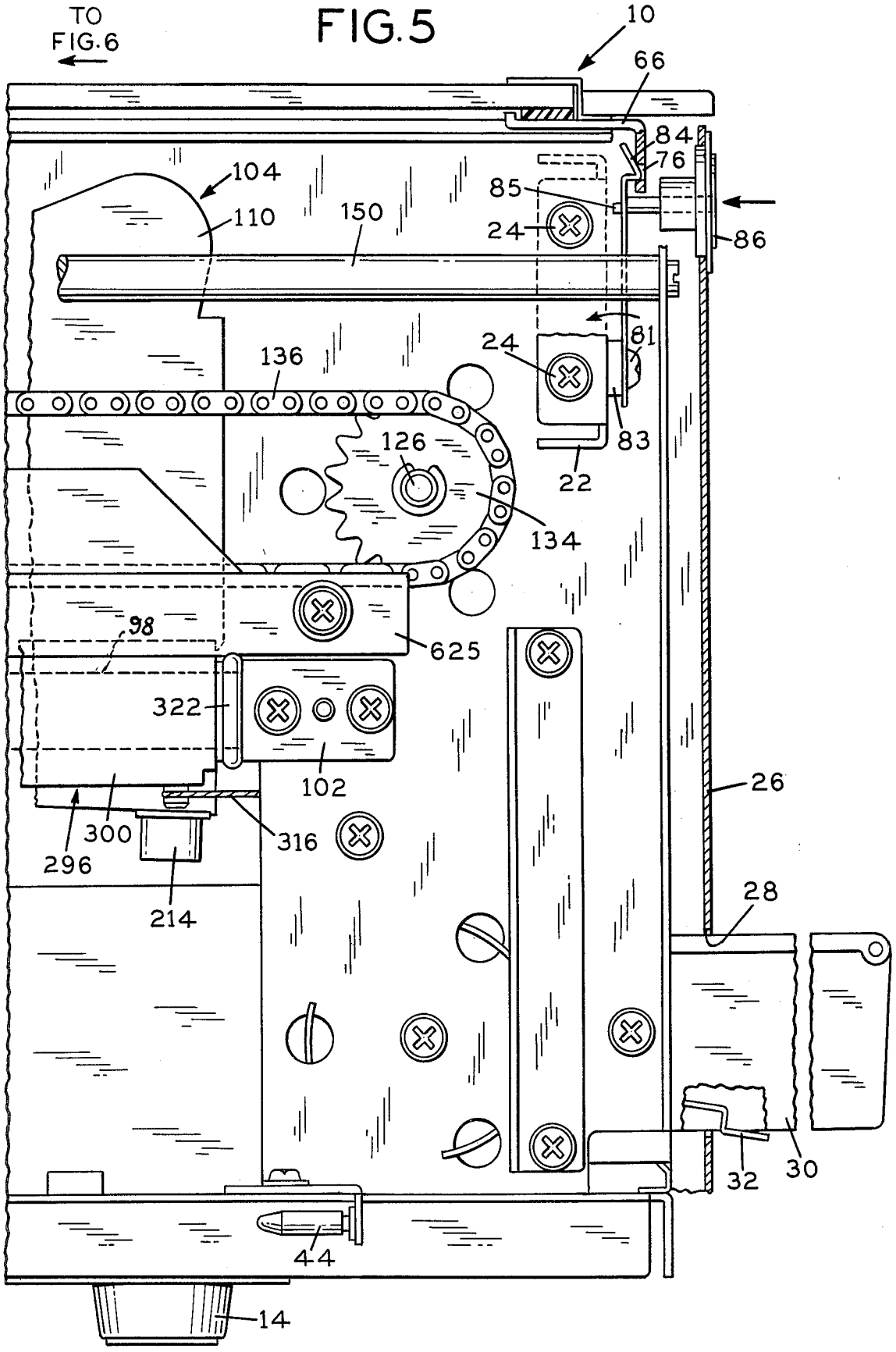
FIG. 5 is a fragmentary elevation of the right front of my improved apparatus for electrophotography drawn on an enlarged scale.
FIG. 6 is a fragmentary elevation of the front central portion of my improved apparatus for electrophotography drawn on an enlarged scale with some parts broken away.
Figure 6:
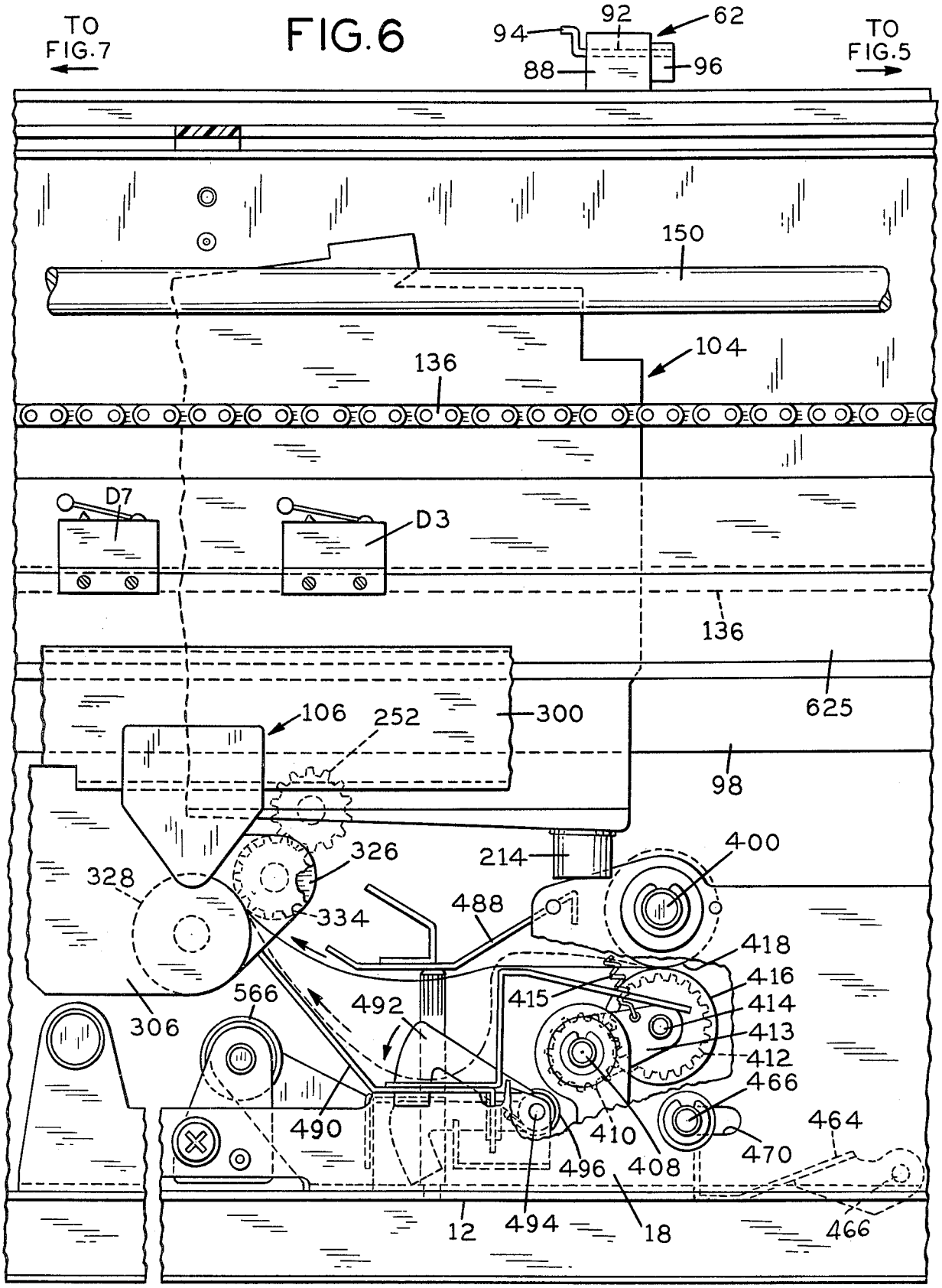

Respective cables 314 and 316 connected to the ends of the legs 298 and 300 are tensioned to bias the subassembly 106 toward its home position. More specifically, referring to FIGS. 5 and 9, cable 316, for example, extends from the end of leg 298 around an idler pulley 318 to a spring-loaded drum 320 which pulls on the cable normally to tend to move the assembly 106 toward its home position. I provide respective stops 322, one of which is shown in FIG. 5, at the right-hand ends of rods 298 and 300 for limiting the movement of the subassembly 106 under the influence of the tensioned cables 314 and 316 to its home position.

Referring again to FIGS. 18 and 19, the subassembly 106 includes an upper registration roller 326 and a lower registration roller 328 having respective shafts 330 and 332 rotatably supported in the shorter arms 304 and 306 of the members 294 and 298. As will be explained more fully hereinbelow, when the processing unit 104 picks up the transfer and pickoff unit 106 in the course of the forward scanning movement, unit 104 provides an input drive to a gear 334 carried by shaft 330 for rotation therewith. An upper registration roller drive gear 336 on shaft 330 engages a lower registration roller drive gear 338 carried by shaft 332 for rotation therewith. I provide my machine with a pair of respective registration roller arms 340 pivotally supported on the outside of the respective arms 304 and 306 and acted on by springs 342 in such a direction as to urge the lower registration roller 328 into engagement with the upper registration roller 326.

Input gear 334 also drives an idler gear 344 rotatably supported on arms 298 and 304 by a shaft which carries a pulley 346 for rotation therewith. Pulley 346 receives a drive belt 348 which extends around a belt-tensioning pulley 350 carried by a shaft 352 and around a pulley 354 carried by the lower exit roller shaft 356 for rotation therewith. Shaft 356 carries the lower exit roller 358 which cooperates with a plurality of spaced upper exit rollers 360 rotatably supported by a stationary upper exit roller support shaft 362 which is loosely supported in the arms 304 and 306 and biased into operative position by a spring 363.

In addition to rotatably supporting the upper exit rollers 360, shaft 362 also carries a plurality of paper guides 364 spaced along the shaft. Shaft 362 also carries the pickoff finger holder 366 carrying a pivot pin 368 which pivotally supports a pickoff finger 370 which engages the surface of the drum 172 when unit 104 is in cooperative relationship with unit 106 to initiate movement of the leading edge of the sheet of copy material from the drum 172. A spring 372 biases the finger 370 to a position against a stop pin 374, at which position it is adapted properly to engage the surface of the drum 172 to initiate the pickoff operation. In addition to the structure thus far described, the unit 106 carries the transfer corona assembly 376.

The unit 106 includes a bracket 378 which supports a paper jam microswitch 380 having a feeler 382 which is adapted to be actuated in response to the presence of a sheet of copy material being fed by the exit rollers so as to provide an indication of when the trailing edge leaves the unit 106.

Referring now to FIGS. 6, 12, 20, and 21, a shaft 400 rotatably supported in the rear and front walls 16 and 18 of the machine receives bushings 436 and 438 in the arms 432 and 434 of a paper pickoff roll bracket 430. Arm 432 supports a shaft 444 carrying the paper prefeed roller 442 which engages the uppermost sheet of paper in the cassette 30 in normal operation of the machine. A gear 424 carried by a sleeve 422 on shaft 400 is adapted to be driven in a manner to be described to drive a gear 426 carried by a shaft 428 on arm 432. Gear 426 drives a gear 440 on shaft 444 to drive roller 442. A weight 446 on shaft 444 biases the roller 442 downwardly.

I provide arm 434 with a shutter portion 448 adapted to move into the space between a light source 450 and a photosensitive element 452 when roller 442 is in its operative position.

I form the base 12 with an opening 458 below the cassette to permit a roller 460 carried by a pin 462 supported by an arm 464 carried by a pivot shaft 466 to move upwardly through the opening in a manner to be described to engage the cassette plate 32 to move the stack of sheets 5 therein to a position at which the uppermost sheet is in engagement with the paper prefeed roll 442. The ends of the shaft 466 are supported in a pair of slots 468 and 470 in walls 16 and 18 and springs 472, one of which is shown in the drawings, normally urge shaft 466 to corresponding ends of the slots 468 and 470.

A motor 476 is adapted to be energized to drive a shaft 478 carrying a gear 480 which meshes with an idler gear 482 supported on a shaft 484 and adapted to engage a segmental gear 474 carried by the shaft 466 for movement therewith.

In operation of the arrangement just described, springs 472 normally urge the pivot shaft 466 to a position in which the segmental gear 474 is out of engagement with gear 482 with no cassette in the machine. With the machine turned on and before a cassette is inserted into the machine, the motor 476 is energized. When a cassette is inserted into the machine, it engages a sleeve 473, shown in FIG. 4 on shaft 466 to move the ends of shaft 466 to the other ends of the slots 468 and 470 so that segmental gear 474 is in engagement with gear 482. Under these conditions the segmental gear 474 is driven in such a direction as to move the roller 460 upwardly and into engagement with the cassette paper support plate to move the stack of paper in the cassette upwardly to bring the uppermost sheet thereof into engagement with the prefeed roller 442. As this action takes place, the bracket 432 is pivoted until the arm portion 448 moves into the space between the light 450 and the photosensitive element 452. When that occurs, motor 476 is de-energized and the machine is ready to feed paper.

The main drive shaft 120 carries for rotation therewith a pulley 394 which drives a belt 396 to drive a pulley 398 loosely supported on the shaft 400. A gear 404 which rotates with the pulley 398 drives a gear 406 carried by a shaft 408. Shaft 408 carries a gear 410 which drives a gear 412 on a shaft 414 which supports the paper feed separation roller 416. An arm 413 on shaft 408 swingably supports shaft 414 for movement of separation roller 416 toward and away from a paper feed roller 418 supported on shaft 400. A torque limiting device (not shown) is disposed in the driving train between gear 406 and separation roller 416 to limit the torque with which the separation roller is driven in a manner to be described.

When a paper feeding operation is to take place, a clutch 456 is energized to couple pulley 398 to shaft 400 to release a torsion brake indicated generally by the reference character 454 and to engage a torsion clutch 420 to drive pickoff roller 418 and the sleeve 422. From the structure thus far described, it will be apparent that, in the course of a paper-feeding operation, the drive system tends to rotate both the separation roll 416 and the paper feed roll 418 in a clockwise direction as viewed in FIG. 6. The strength of spring 415 and the torque with which separation roller 416 is driven are such that with only one sheet of paper or no sheet between rollers 416 and 418 the drive of roller 418 overcomes the drive of roll 416 so that the latter is driven in a counterclockwise direction. If two sheets of paper are fed to the nip between rolls 416 and 418, the reverse drive of roller 416 prevents the second sheet from being fed. Paper feeding systems of the type I employ are more fully shown and described in my co-pending application Ser. No. 52,405, filed June 27, 1979.

A sheet of paper being fed from the cassette 30 in the manner just described initially follows the full line path indicated in FIG. 6 between an upper removable paper guide 488 and a lower paper guide 490. As the leading edge of the sheet moves toward the exit end of the machine, ultimately it reaches the nip between the registration rollers 326 and 328. At this point, the feeding operation continues to cause the paper to form a bow or bubble, as indicated by the broken line in FIG. 6. As the paper bubble forms, it engages a flag 492 pivotally supported on a shaft 494 and normally urged by a spring 496 to the full line position shown in FIG. 6. Ultimately the bubble moves the flag to a position at which it interrupts the passage of light from a source 498 to a photodetector 500 to de-energize the clutch 456. This formation of a bubble in the manner just described ensures that proper registration takes place. It also permits some movement of the assembly 106 under the action of the unit 104 before the registration rollers 326 and 328 are driven. That is to say, owing to the inherent resilience of the paper, the bubble causes the leading edge to remain in the nip between the registration rollers in the course of a small initial movement of unit 106.

Referring again to FIG. 4, my machine includes rear and front cassette guide assemblies 506 and 508 which guide the cassette 30 into its operative position in the machine in which it may be held, for example by magnets or the like carried by brackets 510 and 512 on the machine frame. As has been explained hereinabove, in this position of the cassette, it engages sleeve 473 to move the shaft 466 to a position at which the paper elevating operation takes place.

I provide respective rear and front paper guides 514 and 516 adjacent to the exit end of the machine for guiding a sheet onto a pair of tray-forming members 502 and 504 which receive the finished copy.

Referring now to FIGS. 4, 10, 25 and 25*a*, the developer liquid distribution system of my machine includes an elongated tank 518 extending in the direction of its length from right to left of the machine for somewhat more than the length of travel of the discharge tube 214 of the assembly 104. Respective supports 520 and 522 secured to the machine frame support the tank. I secure a cover 524 to the tank 518 by any suitable means.

Cover 524 supports a pump 526 adapted to be driven by a motor 528 to deliver developer liquid to a tube 530 leading upwardly to the developer liquid spray tube 188 on the unit 104. I provide the tube 530 with a branch 532 for supplying liquid to the cleaning roller 216 if desired. A short length of tubing 534 may connect the exit fitting from collector 222 to the collector 212 to direct liquid from the cleaning station to the outlet 214.

Figures 25, 25A:
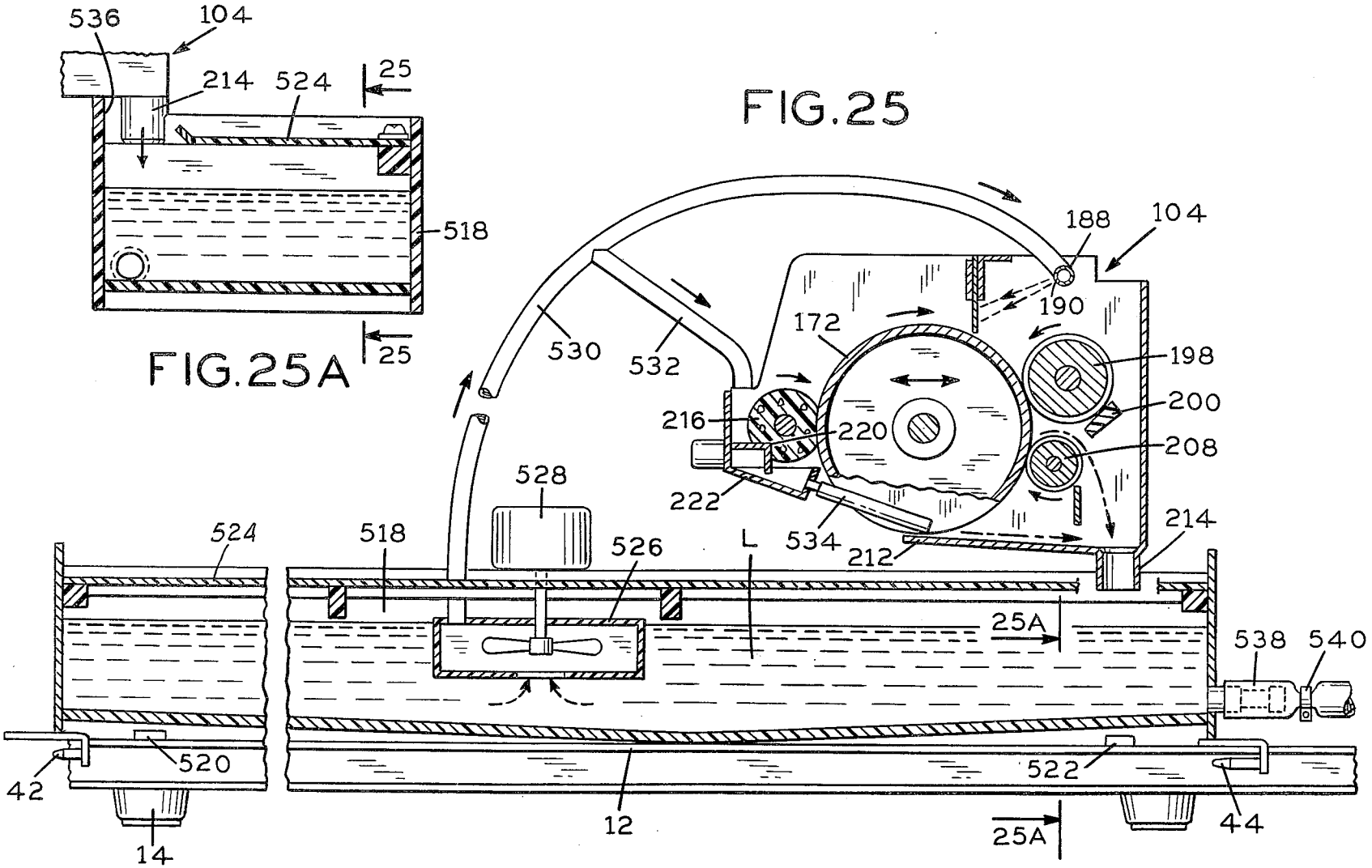
FIG. 25 is a partially schematic front elevation illustrating the liquid developer handling system of my improved apparatus for electrophotography.
FIG. 25A is a sectional view of the developer tank of my improved apparatus for electrophotography taken along the line 25A—25A of FIG. 25.

As can readily be seen by reference to FIG. 25*a*, the cover 524 extends rearwardly from the front of the tank 518 to a location spaced forwardly of the rear wall of the tank to form an elongated slot 536 at the back of the tank. Outlet 214 of the assembly 104 cooperates with the slot 536 so that liquid flowing outwardly of the outlet 214 passes into the tank 518 through slot 536 at all locations across the machine. If desired, the tank may be provided with a drain 538 normally closed by a clamp 540. It will readily be appreciated that one of the advantages of the tank construction which I have just described is that it readily lends itself to being constructed as a disposable unit. When the tank is so constructed, servicing of the machine is greatly facilitated for that the difficult job of cleaning the tank at relatively frequent intervals is eliminated.

Figure 3:
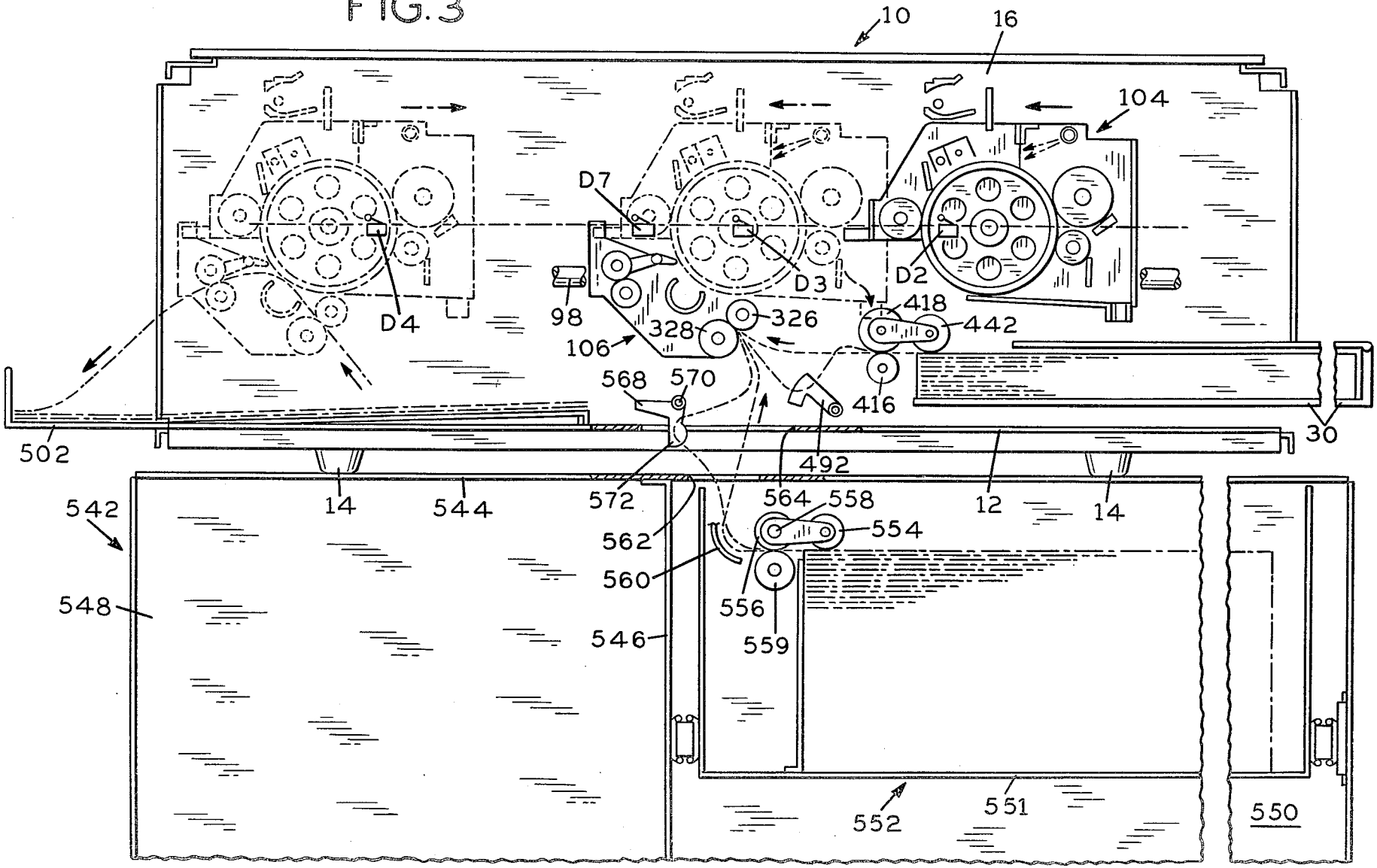
FIG. 3 is a partially schematic front elevation of my improved apparatus for electrophotography illustrating the relative positions of major components thereof at various stages of the copying operation and showing the relationship of the machine to a second copy paper supply system.
Figure 24:
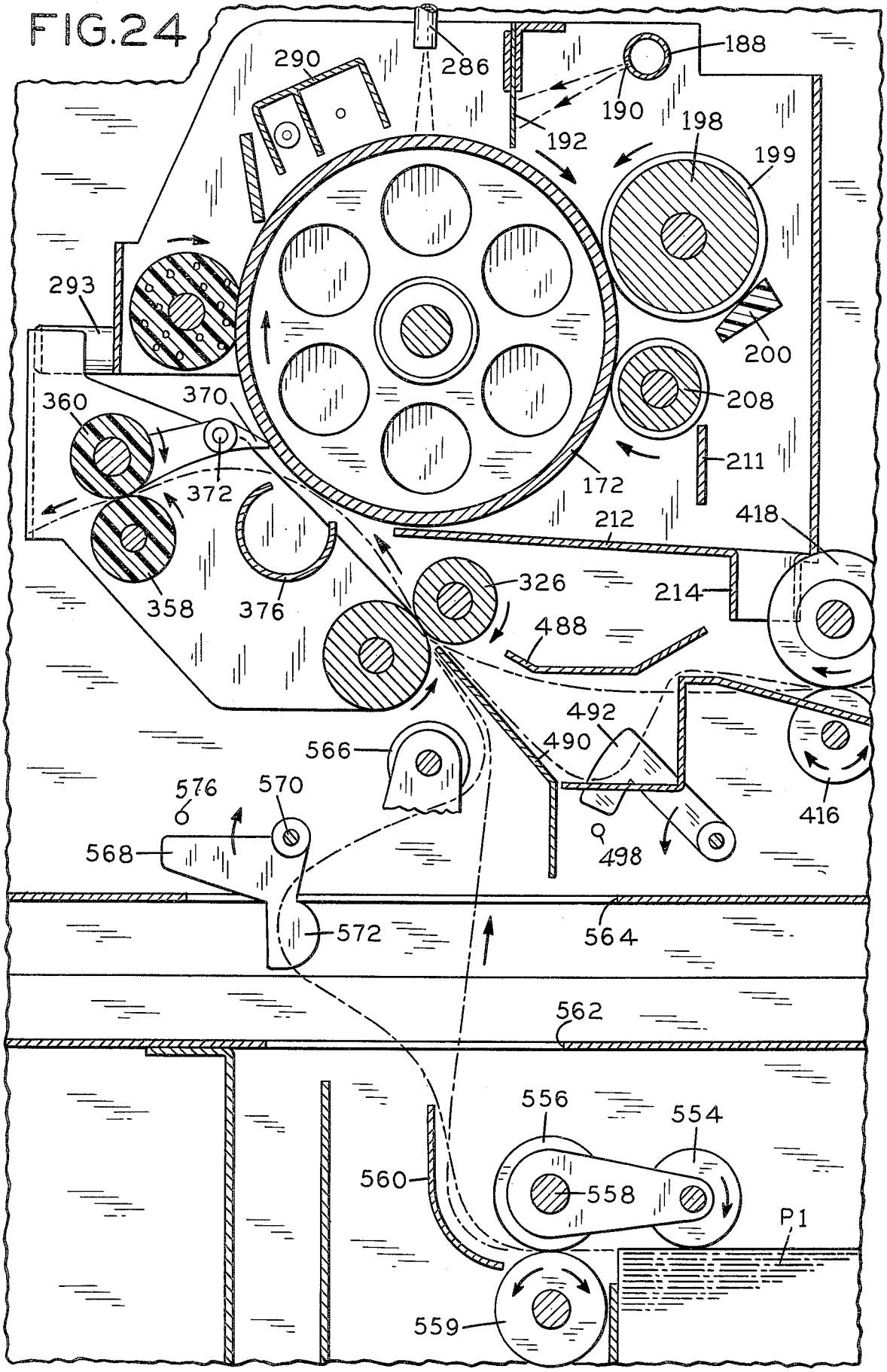
FIG. 24 is a partially schematic front elevation of my improved apparatus for electrophotography illustrating the relative positions of the parts as the traveling processing unit moves into a location at which it picks up the traveling paper handling unit.

One of the advantageous features of my copier is the ease with which it can be upgraded from what is basically an inexpensive or low end of the line copier. As has been pointed out hereinabove, most low end of the line copiers are capable of use with only a single supply of copy paper. If the size of the copy to be made on the machine is to be changed, the cassette holding the copy paper supply must be changed. My machine readily lends itself to use with two or more supplies of copy paper. Referring now to FIG. 3, 4, and 24, there are known in the art cabinets, such for example as the cabinet indicated generally by the reference character 542 which are sold by manufacturers of copiers to perform the dual function of supporting what is essentially a desk top copier at the proper height for use while at the same time providing storage space for supplies of paper and developer materials and the like. The cabinet 542 has a top 544 on which the copier 10 rests. A central partition 546 divides the cabinet 542 into a left-hand compartment 548 and a right-hand compartment 550.

By way of an example of one way in which my copier 10 can be upgraded, the right-hand compartment 550 may be provided with a suitable shelf 551 for supporting a high capacity magazine and copy sheet feeder indicated generally by the reference character 552. This large capacity sheet feeder 552 may be provided with any suitable stack elevating mechanism known to the art for bringing the uppermost sheet in the stack into engagement with a pre-feed roller 554. For example, magazine 552 may be provided with a stack elevating servomechanism similar to that provided by motor 476 associated with cassette 30 for bringing the top sheet in the stack into engagement with the pre-feed roller. The pre-feed roller 554 is adapted to be driven to advance the uppermost sheet of the stack of sheets in the magazine 552 toward the nip between a paper feed roller 556, carried by a shaft 558, and a retard roller 559. Feed roller 556 may be clutched to its own individual drive motor (not shown) or alternatively it might be clutched to a drive obtained from the main machine drive by a clutch similar to the clutch 456 associated with the shaft 400. Since the structure and operation of the pre-feed roller 554, the paper feed roller 556, and the retard roller 559, are substantially identical to that described hereinabove in connection with pre-feed roller 442, paper feed roller 418, and retard roller 416, they will not be described in further detail herein. The uppermost sheet fed from magazine 552 by roller 556 engages a guide 560 which directs the sheet upwardly through an opening 562 in the top 544 and through an opening 564 in the base 12 of the machine 10 so as to be directed by guide 490 toward the nip between rollers 326 and 328. After the leading edge engages the nip, the feeding operation continues and a guide roller assembly 566 constrains the sheet to form a bubble which engages an arm 572 of a bellcrank shaped flag 568 pivotally supported on a pin 570. When the bubble has formed to a predetermined extent, flag 568 moves into the space between a source 574 of light and a light responsive element 576 to indicate that the paper is in the registration position.

Another way in which my machine might be upgraded would be to provide it with an automatically lowering output tray for accommodating a very large number of copies. This could be achieved by cutting away portions of the base 12 and of the top 544 over the space 548. The machine could then be provided with a mechanism of the type shown and described in my co-pending application Ser. No. 167,462, filed July 11, 1980, for Large Capacity Sheet-Stacking Apparatus now U.S. Pat. No. 4,350,333 issued Sept. 21, 1982.

It will readily be appreciated that since my machine has a stationary platen it can accommodate any semi-automatic or automatic document feeder known to the art.

Figure 26:
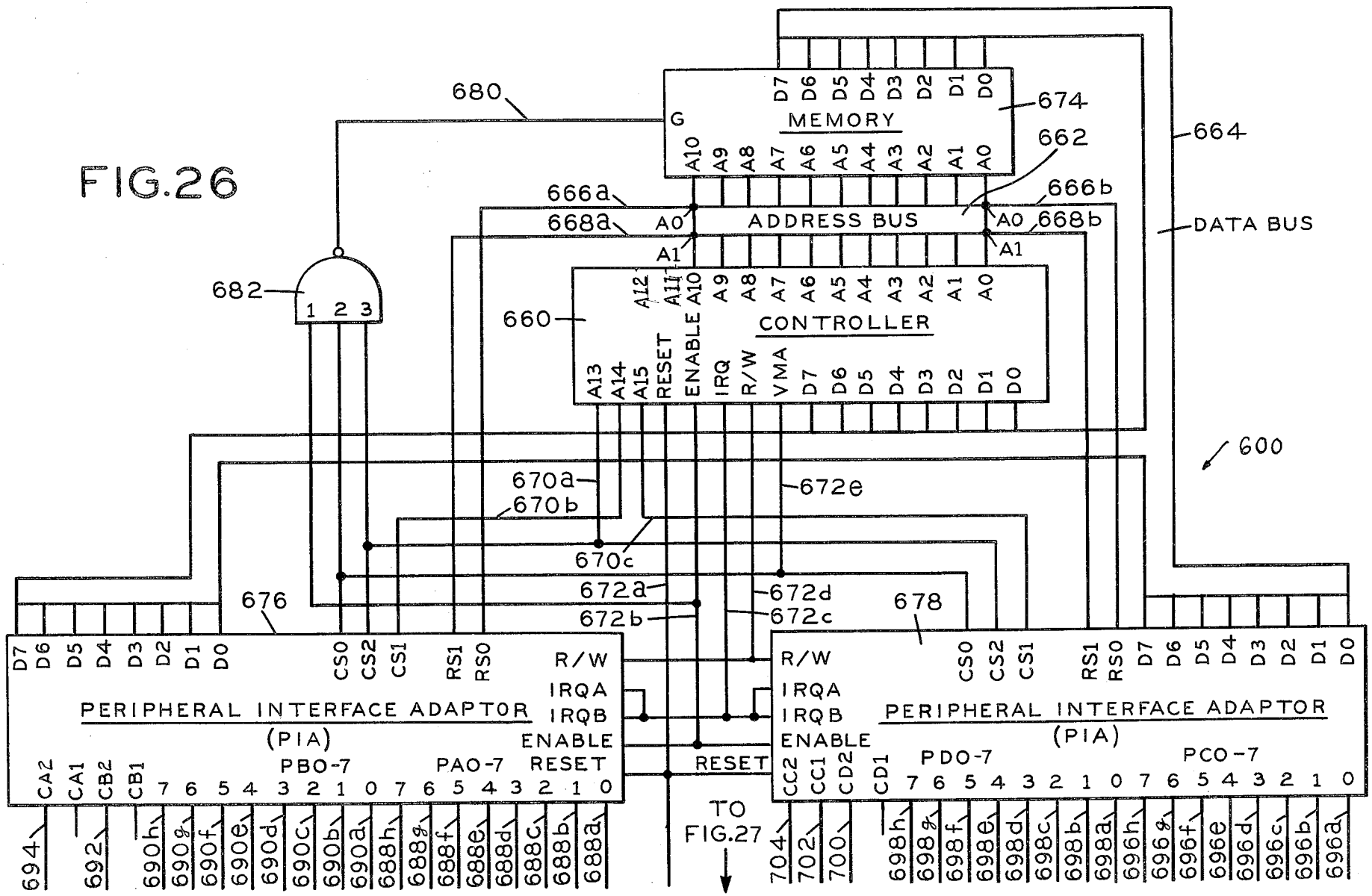
FIG. 26 is a schematic view illustrating the first portion of one form of control system which I may use to control the operations of my improved apparatus for electrophotography.
Figure 27:
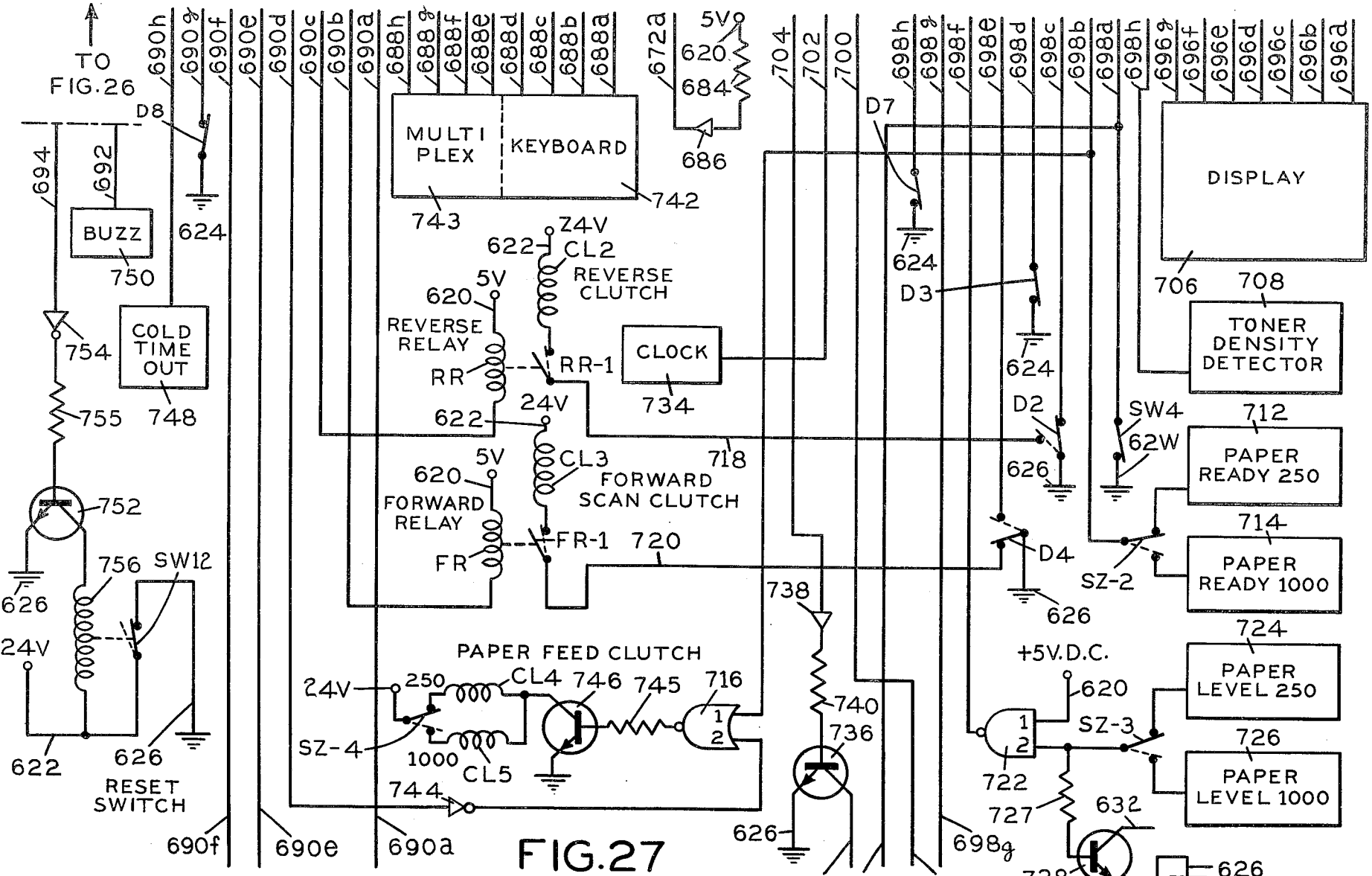
FIG. 27 is a schematic view of an intermediate portion of the control system which I may employ to control my improved apparatus for electrophotography.
Figure 28:
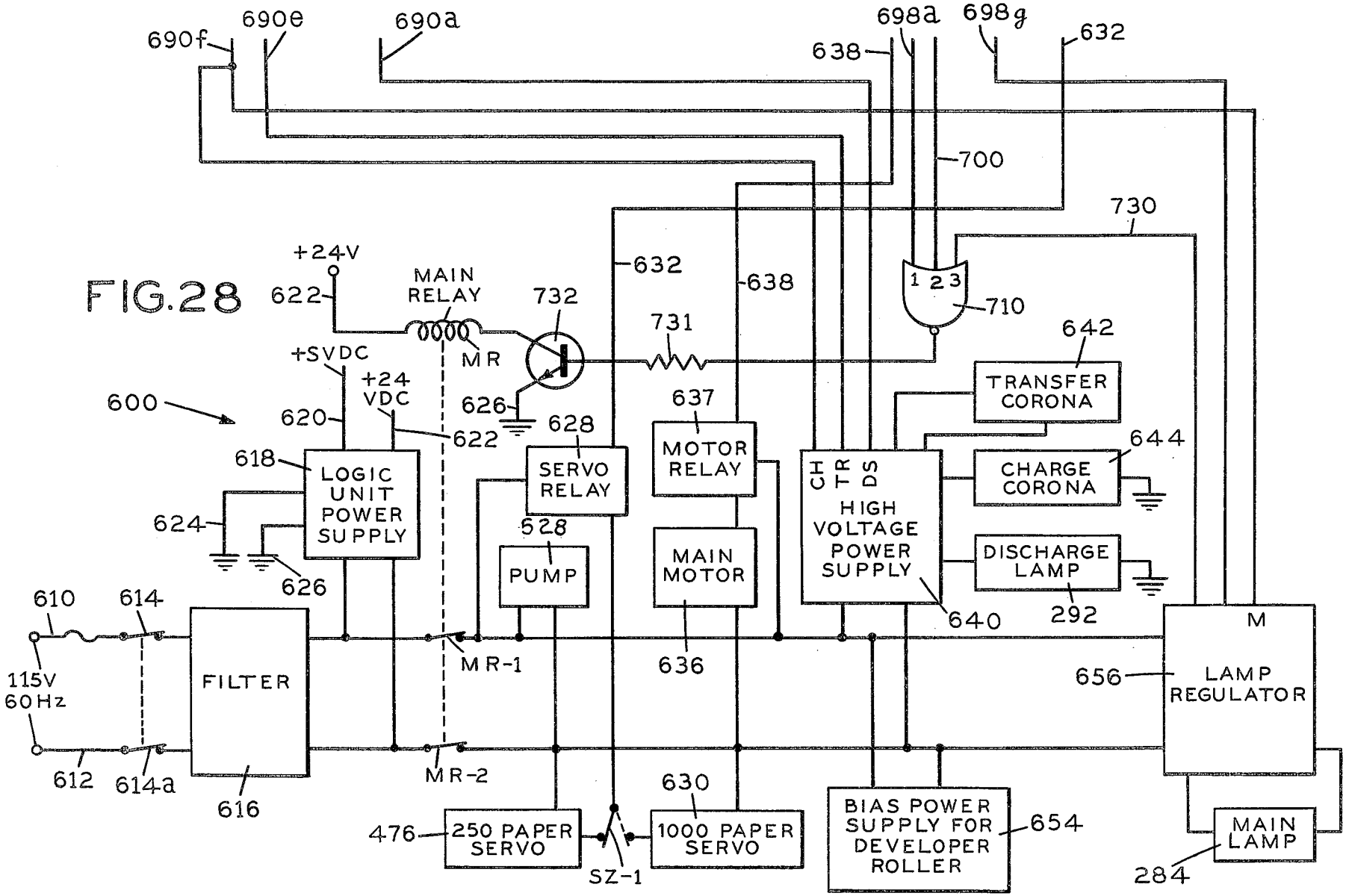
FIG. 28 is a schematic view illustrating the final portion of the control system which I may employ to control the operations of my improved apparatus for electrophotography.

Referring now to FIGS. 26, 27 and 28, one form of control circuit, indicated generally by the reference character 600, which I may employ to control my machine includes a source of voltage such, for example, as 115 v. 60 hz., having terminals 610 and 612, connected to the remainder of the circuit by operator-actuated, ganged "ON-OFF" switches 614 and 614*a*, through filter 616.

A power supply 618 fed by filter 616 provides the proper potentials for operating the logic units of the system. Supply 618 maintains lines 620 at 5 volts, line 622 at 24 volts and lines 624 and 626 at ground.

Ganged relay switches MR-1 and MR-2, adapted to be closed in response to current flow through the main relay MR, as will be more fully described hereinbelow, provide power for the 250 sheet cassette servomotor 476 and for a 1000 sheet cassette servomotor 630 through servo relay 628, which couples terminal 610 to the contact arm of paper size selection switch SZ-1 in response to the grounding of line 632. Power is supplied to the main motor 636 through motor relay 637 which connects terminal 610 to motor 636 in response to the grounding of line 638. When closed, relay switches MR-1 and MR-2 supply power to pump motor 528, to the high voltage power supply 640, to the developer roller bias power supply 654, and to the lamp regulator 656. The high voltage power supply 640 provides the proper operating potentials for the transfer corona 642 on unit 106, the charging corona 644 on unit 104, and the discharge or quench lamps 292 on unit 104 in response to respective high-level signals at input pins TR, CH and DS of supply 640. Regulator 656 provides power to the main exposure lamp 284 in response to a high-level signal at its input pin M.

Referring now more particularly to FIG. 26, my microprocessor control system includes a controller 660 having a 16-bit address port comprising pins A0 to A15, an 8-bit input-output port comprising pins D0 to D7 and a 5-bit control port comprising valid memory address pin VMA, read-write pin R/W, interrupt request pin IRQ, enable pin E and the RESET pin. Of these pins, I connect pins A0–A10 to an address bus 662, pins D0–D7 to a data bus 664, pin A0 to lines 666*a* and 666*b*, pin A1 to lines 668*a* and 668*b*, pins A13 to A15 to lines 670*a* to 670*c* and pins RESET, E, IRQ, R/W and VMA to lines 672*a* to 672*e*.

I couple address bus 662 to the ten-bit address port (pins A0–A10) of an erasable programmable, read-only memory 674. I connect data bus 664 to the 8-bit data port (pins D0–D7) of the memory and of two peripheral interface adaptors 676 and 678. The memory 674 is read by placing a low-level signal on its chip select pin G, which is connected by line 680 to the output pin of NAND gate 682. It will be readily appreciated that all inputs to the NAND gate must be high to select the memory 674. A low-level signal on any input will cause line 680 to go high, deselecting the memory, so that pins D0–D7 carry no output.

I couple line 672*a* to the reset pins of both peripheral interface adaptors (PIA) 676 and 678 and to 5-volt DC line 620 through pull-up resistor 684 and driver 686. This establishes a power-on reset to the controller 660 and the PIA's 676 and 678. I couple line 672*b* to the first input of NAND gate 682 and to the enable pins of the PIA's to provide a timing signal, and line 672*c* to pins IRQA and IRQB of both PIA's to allow either to make an interrupt request to the controller 660. In addition, I couple line 672*d* to the read-write pins (R/W) of both PIA's to control the direction of data transfer on the data bus 664. A low-level signal on line 672*d* (write mode) permits data flow from the controller 660 to the selected PIA, while a high-level signal (read mode) sets up the PIA for transfer of data to the bus.

I couple line 672*e* to the chip select pin CS0 of both PIA's and to the second input pin of the NAND gate 682. Line 672*e* carries a high-level signal to indicate a valid memory address, and a low-level signal to deactivate both PIA's and the memory. I couple line 670*a* to pin CS2 of both PIA's and to the third input pin of the NAND gate 682. Provided both lines 672*b* and 672*e* carry a high-level signal, a high state on line 670*a* deselects the PIA's and sets the memory in the read mode. A low-level signal on 670*a* deselects the memory and permits selection of either PIA 676 or 678 through respective lines 670*b* and 670*c*. Line 670*b* is connected to pin CS1 of PIA 676 and line 670*c* to pin CS1 of PIA 678. A high-level signal on either of these lines will select the corresponding PIA. It will be readily appreciated that in order to select a PIA, pins CS0 and CS1 must be high and pin CS2 low; and that either PIA is deselected when any of its chip select pins are in the inactive state.

I couple lines 666*a* and 668*a* to register select pins RS0 and RS1 of PIA 676, and lines 666*b* and 668*b* to pins RS0 and RS1 of PIA 678. The register select pins are used in conjunction with internal control registers to select a particular register in a PIA, to be written into or to be read. Each PIA has two 8-bit bi-directional registers through pins PA0 to PA7 and PB0 to PB7 for PIA 676 and through PC0 to PC7 and PD0 to PD7 for PIA 678. In addition, each have four interrupt-control lines CA1, CA2, CB1 and CB2 for PIA 676 and CC1, CC2, CD1 and CD2 for PIA 678. I connect pins PA0 to PA7 to lines 688*a* to 688*h*, pins PB0 to PB7 to lines 690*a* to 690*h*, pins CB2 to line 692, pin CA2 to line 694, pins PC0 to PC7 to line 696*a* to 696*h*, pins PD0 to PD7 to lines 698*a* to 698*h* and pins CD2, CC1 and CC2 respectively to lines 700, 702 and 704.

Referring now more particularly to FIG. 27, lines 696*a* to 696*g* provide the input to a display 706, the operation of which will be more fully described hereinbelow, which includes a digital read out of the number of copies desired, six internal diagnostic LED's, and six external front panel LED's. I connect line 696*h* to a toner density detector 708 which places a low-level signal on the line in response to a low supply of toner.

Line 698*a* provides an input from the safety switch SW4, shown in its normal position in which it connects ground line 624 to line 698*a*. The switch is adapted to open when the front cover of the machine is opened for servicing. Line 698*a* also provides one input to NOR gate 710 which controls the main relay MR. An inactive state (safety switch open) on line 698*a* prevents energization of the main relay.

Line 698*b* receives an input from the paper ready detectors 712, 714 for either the 250 or 1000 sheet paper cassettes, through the second pole of paper size selection switch SZ-2. From the description hereinabove, it will be apparent that detector 712 includes light source 498 and photosensitive element 500 while detector 714 includes light source 574 and detector 576. Line 698*b* also provides one input to NOR gate 716 which controls the paper-feed clutches CL4 and CL5. The selected paper-ready detector places a high-level signal on line 698*b* when the leading edge of paper has reached the nip formed by the registration rollers, deactivating the corresponding paper-feed clutch.

Line 698*c* receives an input from the scanner zero position switch D2, which is adapted to engage its upper contact, connecting ground line 626 to line 698*c*, when the processing unit 104 or scanner is in the zero or home position, and to engage its lower contact, connecting ground line 624 to line 718, once the unit has left its home position. This safety feature prevents the reverse scanner clutch CL2 from being energized when the processing unit is in the home position. Line 698*d* receives an input from the scanner registration position switch D3 which is adapted to close, connecting line 698*d* to ground line 624, when the processing unit 104 is in the registration position. Line 698*e* receives an input from the scanner maximum position switch D4, which is adapted to engage its upper contact, connecting ground line 626 to line 698*e*, when the scanner unit 104 is in the maximum position and to engage its lower contact, connecting line 626 to line 720 once the unit has left the maximum position. This safety feature prevents the forward scanner clutch CL3 from being energized when the processing unit 104 is in the maximum position. A bracket 625 extending across the front of the machine supports switches D2, D3, D7 and D4 at respective positions indicated in FIG. 3 at which they will be actuated by element 149 on unit 104 at the proper times.

I connect input line 698*f* to the output pin of NAND gate 722 which receives a first input from five-volt line 620 and a second input from paper level detectors 724 and 726 for either the 250 or 1000 sheet paper cassettes, through the third pole of paper size selection switch SZ-3. In response to a low paper level in the selected cassette, the corresponding paper level detector will place a high-level signal on the second input of NAND gate 722 and on the base terminal of transistor 728 through resistor 727. This causes the output of NAND gate 722 to go low. Under these conditions, transistor 728 grounds line 632 to energize the corresponding paper cassette servomotor 476 or 630 through relay 628 thus raising the paper level in the selected cassette. If, however, the cassette is empty, the output of NAND gate 722 will remain at ground.

Line 698*g* receives an input from the lamp regulator 656, which places a low-level signal on the line in the event of main lamp 284 failure. Line 698*h* receives an input from the scanner jam-check position switch D7, which is adapted to close, connecting line 698*h* to ground line 624 when the processing unit 104 is in the jam-check position.

I connect output line 700 to the second input of NOR gate 710, which controls the main relay MR. The NOR gate 710 receives a first input from the safety switch SW4 through line 698*a*, and a third input from the lamp regulator 656 through line 730. The output pin of gate 710 is connected to the base terminal of transistor 732 through resistor 731. In order to energize the main relay, all inputs to the NOR gate must be low to supply a high-level signal to the base terminal of transistor 732, which then permits current flow from 24 volt line 622 to ground line 626, through the main relay MR.

I connect line 702 to a clock 734 which provides, at timed intervals, an interrupt request signal which is transferred by peripheral interface adaptor 678 through pin IRQA to the controller 660. The interrupt request is serviced, by the controller completing its current instruction, halting the main program and then jumping to the clock interrupt service routine, as will be more fully described hereinbelow.

Output line 704 controls the main motor 636 through line 638. I connect line 704 to the base terminal of transistor 736 through driver 738 and resistor 740. A high-level signal on line 704 causes transistor 736 to couple line 638 to ground line 626 to energize the main motor 636, through motor relay 637.

Lines 688*a* to 688*d* receive an input from keyboard 742. Lines 688*e* to 688*h* supply an output to the multiplex 743, as will be more fully described hereinbelow. I connect output line 690*a* to pin DS of the high-voltage power supply 640 which, in response to a high-level signal on line 690*a*, energizes the discharge lamp 292.

I connect output line 690*b* to five-volt line 620 through the scanner forward relay FR. A high-level signal on line 690*b* de-energizes relay FR, closing switch FR-1 to energize the forward clutch CL3, so long as the processing unit 104 is not in its maximum position. I connect output line 690*c* to five-volt line 620 through the scanner reverse relay RR. A high-level signal on line 690*c* de-energizes relay RR, closing switch RR-1 to energize the reverse clutch CL2, provided the processing unit 104 is not in the zero position.

I connect output line 690*d* through inverter 744 to the second input of NOR gate 716, which controls the paper feed clutches CL4 and CL5 for the 250 and 1000 sheet paper cassettes. The NOR gate 716 receives a first input from the paper ready detectors 712 and 714 through line 698*b*. A resistor 745 connects the output pin of gate 716 to the base terminal of transistor 746. In order to energize either paper-feed clutch, both inputs to the NOR gate must be low, to supply a high-level signal to the base terminal of the transistor. In response, the transistor couples 24 volt line 622 to ground line 626 through the selected paper-feed clutch CL4 or CL5, as determined by the setting of the paper size selection switch SZ-4. When the paper reaches the registration rollers, the appropriate paper-ready detector will place a high-level signal on line 698*b*, which will in turn deactivate the selected paper-feed clutch.

I couple line 690*e* to pin TR of the high-voltage power supply 640, which in response to a high-level signal on the line energizes the transfer corona 642. I couple line 690*f* to pin CH of the high-voltage power supply 640 and to pin M of the lamp regulator 656. In response to a high-level signal on line 690*f*, the high-voltage power supply energizes the charge corona 644 and the lamp regulator energizes the main lamp 284.

Line 690*g* receives an input from the paper output detector switch D8 located on the paper handling unit 106, and designated by the reference character 380 in FIG. 18, which is adapted to close, connecting line 690*g* to ground line 624, while the paper is present in the paper handling unit. Line 690*h* receives an input from the cold time out timer 748 which is adapted to place a high-level signal on line 690*h* after an initial delay to allow the machine to "warm up" after long periods of inactivity. Line 692 provides an output to a buzzer 750 which is activated by a high-level signal on the line.

I connect output line 694 to the base terminal of transistor 752 through inverting driver 754 and resistor 755. In response to a low-level signal on line 694, inverting driver 754 supplies a high-level signal to the base terminal of transistor 752 which then couples 24 volt line 622 to ground line 626 through the reset relay 756. The relay 756, when energized, opens the reset switch SW12 which then must be closed by the operator.

Figure 29:
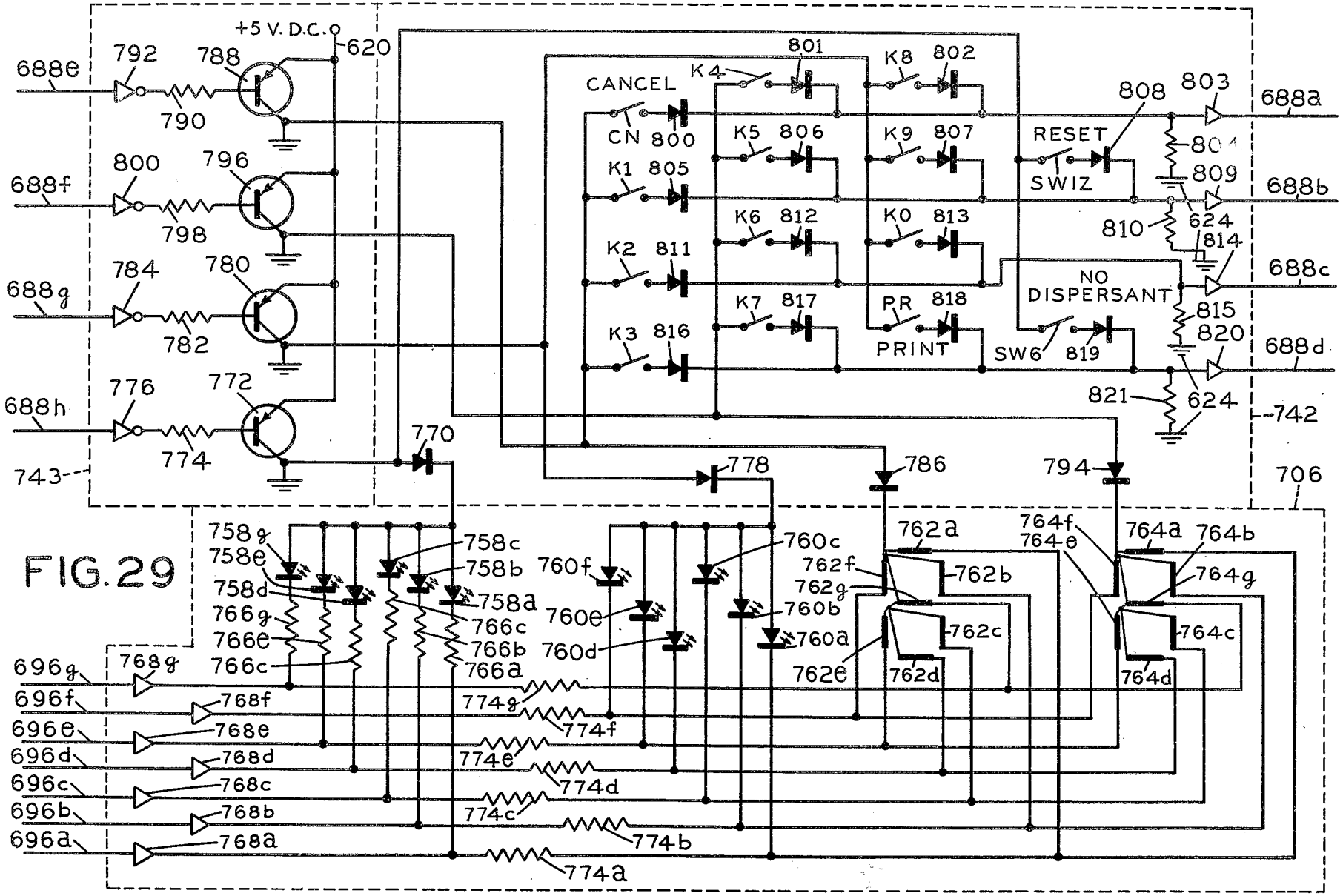
FIG. 29 is a schematic view of one form of electrical circuit for the keyboard and display unit of my improved apparatus for electrophotography.

Referring now to FIG. 29, the display 706 includes six internal diagnostic LED's including "waiting for scanner at zero position" LED 758*a*, "waiting for scanner at registration position" LED 758*b*, "waiting for scanner at jam-check position" LED 758*c*, "waiting for scanner at maximum position" LED 758*d*, "noise on keyboard lines" LED 758*e*, and "lamp regulator failure" LED 758*g*. Display 706 has six front panel LED's which are provided on the panel 46 including "add paper" LED 760*a*, "add toner" LED 760*b*, "add dispersant" LED 760*c*, "paper jam" LED 760*d*, "print ready" LED 760*e*, and "please wait" LED 760*f*; a first seven-segment LED digit display formed from LED's 762*a* to 762*g* and a second seven-segment LED digit display formed by LED's 764*a* to 764*g*.

LED's 758*a* to 758*g* connect lines 696*a* to 696*g*, through resistors 766*a* to 766*g* and drivers 768*a* to 768*g*, to one terminal of diode 770, the other terminal of which is connected to the collector of transistor 772, which is part of the multiplex 743. I connect the base terminal of transistor 772 to the output line 688*h* through resistor 774 and inverting driver 776, and I connect the emitter terminal to five-volt line 620. A low-level signal on line 688*h* grounds the collector terminal and, if accompanied by high-level signals on any of the lines 696*a* to 696*g*, illuminates the corresponding diodes 758*a* to 758*g*. A high-level signal on line 688*h* causes the collector terminal to go high, thus deactivating LED's 758*a* to 758*g* and providing an input to line 688*b* through the reset switch SW12 and to line 688*d* through the "no dispersant" switch SW6.

LED's 760*a* to 760*f* connect lines 696*a* to 696*f* through resistors 774*a* to 774*f* and drivers 768*a* to 768*f*, to one terminal of diode 778, the other terminal of which is connected to the collector of transistor 780. I connect the base terminal of transistor 780 through output line 688*g*, through resistor 782 and inverting driver 784, and I connect the emitter terminal to five-volt line 620. A low-level signal on line 688g grounds the collector terminal and, if accompanied by a high-level signal on any of the lines 696a to 696f, illuminates the corresponding diodes, 760a to 760f. A high-level signal on line 688g causes the collector terminal to go high, deactivating LED's 760a to 760f and providing an input to line 688a through switch K8, to line 688b through switch K9, to line 688c through switch K0 and to line 688b through print switch PR.

LED's 762a to 762g connect lines 696a to 696g through resistors 774a to 774g and drivers 768a to 768g to one terminal of diode 786, the other terminal of which is connected to the collector of transistor 788. I connect the base terminal of transistor 788 to output line 688e through resistor 790 and inverting driver 792, and I connect the emitter terminal to five-volt line 620. A low-level signal on line 688e grounds the collector terminal and, if accompanied by a high-level signal on any of the lines 696a to 696g illuminates the corresponding diodes 762a to 762g to form a visual display of a first digit. A high-level signal on line 688e causes the collector terminal to go high, deactivating LED's 762a through 762g, and providing an input to line 688a through cancel switch CN, to line 688b through switch K1, to line 688c through switch K2 and to line 688d through switch K3.

LED's 764a to 764g connect lines 696a to 696g through the resistors 774a to 774g and drivers 768a to 768g, to one terminal of diode 794, the other terminal of which is connected to the collector of transistor 796. I connect the base terminal of transistor 796 to output line 688f through resistor 798 and inverting driver 800, and I connect the emitter terminal to five-volt line 620. A low-level signal on line 688f grounds the collector terminal and, if accompanied by a high-level signal on any of the lines 696a to 696g, illuminates the corresponding diodes 764a to 764g to form a visual display of a second digit. A high-level signal on line 688f causes the collector terminal to go high, deactivating LED's 764a to 764g, and providing an input to line 688a through switch K4, to line 688b through switch K5, to line 688c through switch K6 and to line 688d through switch K7.

Cancel switch CN, copy number switches K1 to K0 and print switch PR form a push-button keyboard which is located on the front panel 46 of the machine and indicated generally by reference character 48 in FIG. 1. Switches K0 to K9 are adapted to be actuated by the operator to inform the machine of the number of copies desired, the print button 50 to begin the copying cycle, and the cancel button to prematurely terminate it. The reset switch SW12 is located within the machine and once tripped (opened) must be closed by the operator, while the "no dispersant" switch SW6 is closed in response to a low-level of dispersant.

Switches CN, K4 and K8 are connected to input line 688a through respective diodes 800, 801, and 802, and driver 803. Line 688a is also connected to ground line 624, by resistor 804. Switches K1, K5, K9 and SW12 are connected to input line 688b through respective diodes 805, 806, 807 and 808 and driver 809. A resistor 810 connects line 688b to ground line 624. Switches K2, K6, and K0 are connected to input line 688c through respective diodes 811, 812, and 813, and driver 814. Line 688c is also connected to ground line 624 by resistor 815. Switches K3, K7, PR, and SW6 are connected to input line 688d through respective diodes 816, 817, 818, and 819, and driver 820. A resistor 821 connects line 688d to ground line 624 through driver 820.

Figure 30A:
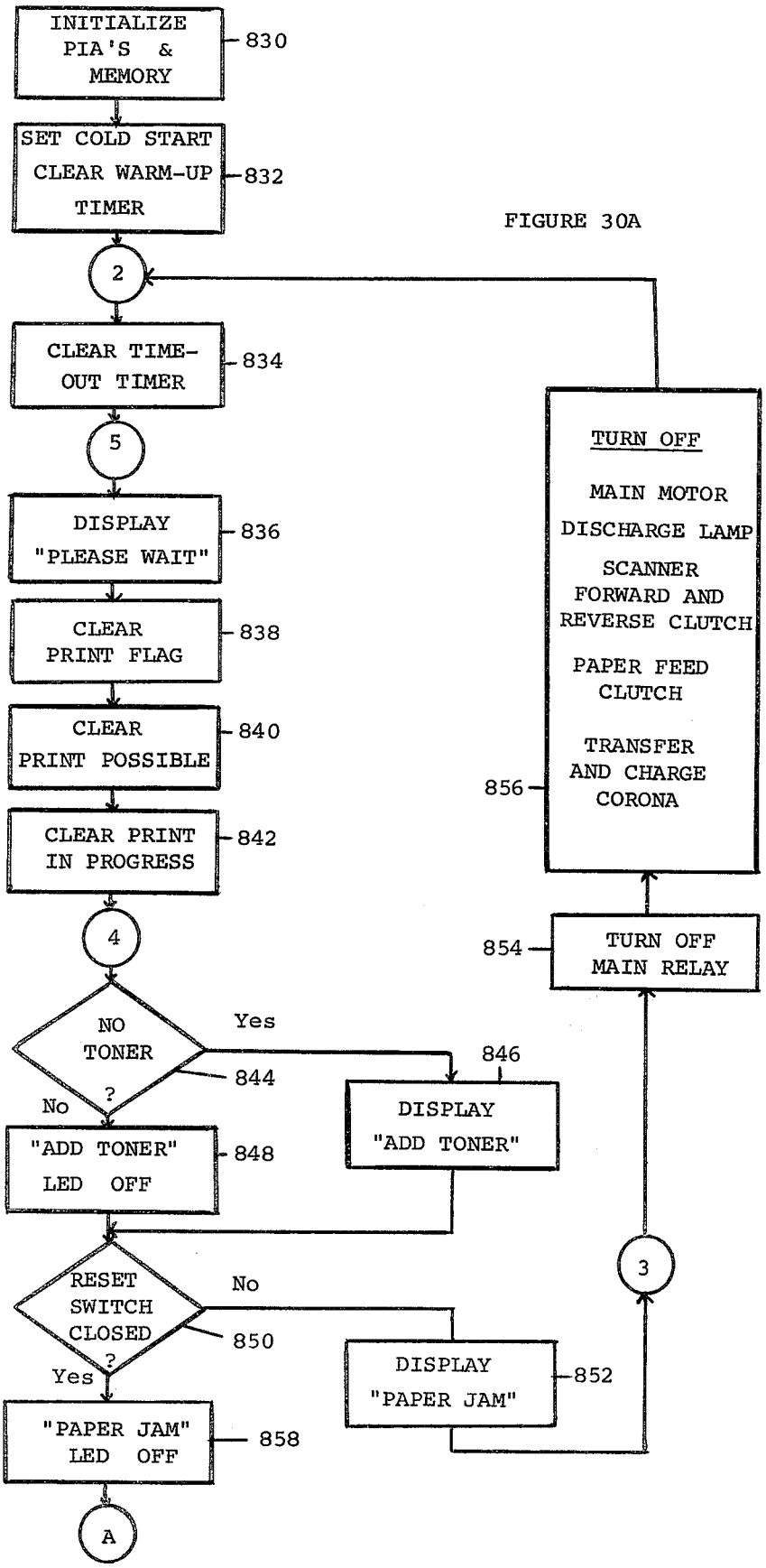
FIG. 30A is a flow chart of the first portion of the "idle" program of operation of my improved apparatus for electrophotography.
Figure 30B:
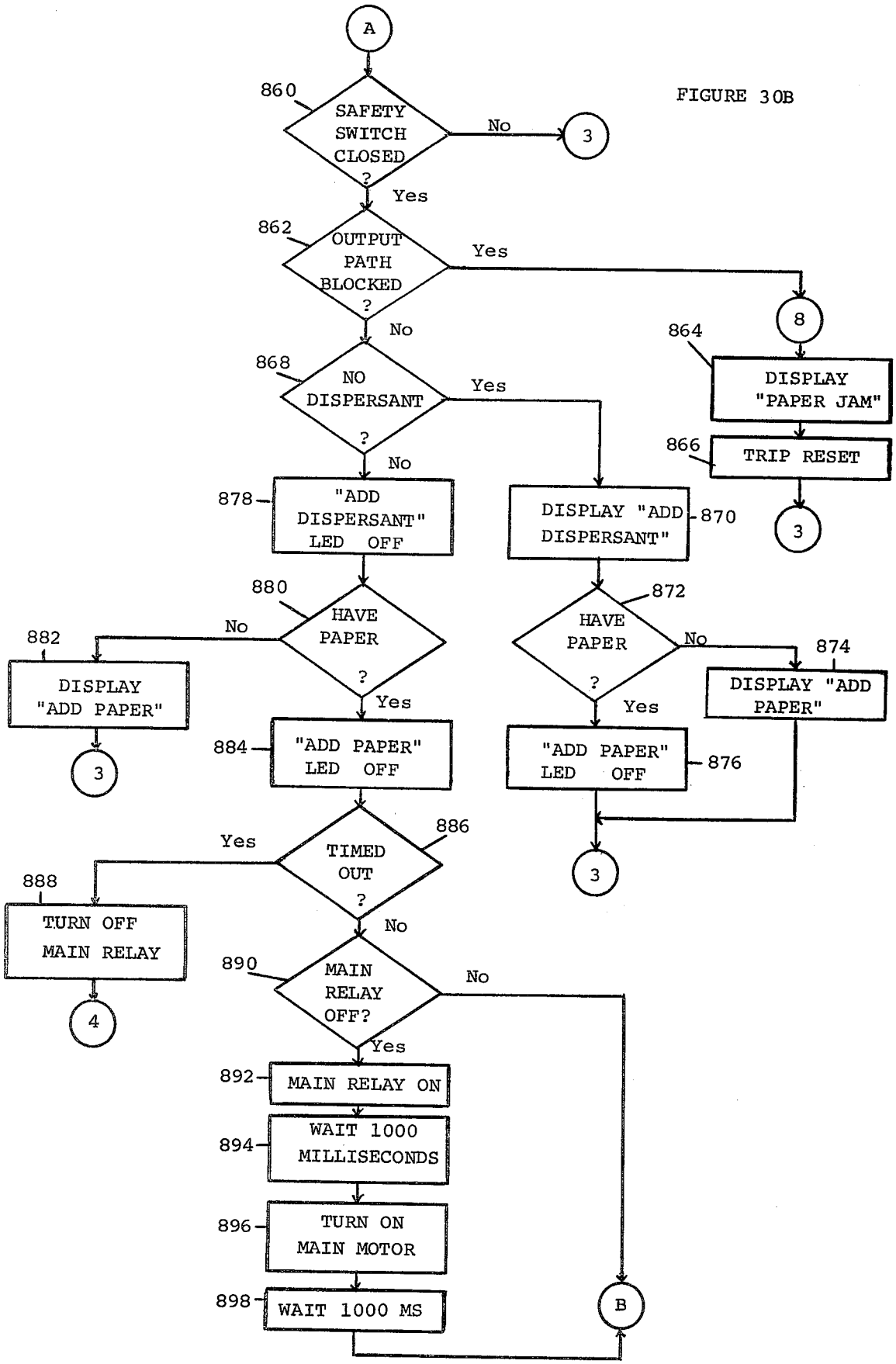
FIG. 30B is a continuation of the flow chart of the idle portion of the program of operation of my improved apparatus for electrophotography.

The operation of the control system for my copier can best be understood by reference to FIGS. 30 to 32. Referring now to FIGS. 30A to 30C, the main program of my control system starts at block 830 when power is first supplied to the machine. As indicated by block 830, the control circuit prepares for normal operation by initializing the peripheral interface adapters 676 and 678 and the memory 674. The cold start status bit is then set and an internal warm-up timer is cleared (block 832). A general time-out timer which provides a maximum amount of time the program counter should not exceed, is also cleared (block 834).

At this point, line 688g is grounded and line 696f is raised to logic one to illuminate the "please wait" LED 760f (block 836). The print flag, print possible and print in progress status bits are cleared (blocks 838, 840, and 842), and line 696h is examined to check the supply of toner (block 844). If toner is needed, as indicated by a low-level signal on line 696h, line 696b will be raised to logic one and line 688g will be grounded to illuminate the "add toner" LED 760b (block 846). If not, the program will make sure LED 760b is off and then continue (block 848).

A determination is then made as to whether the reset switch SW12 is closed, by placing a high-level signal on line 688h while scanning line 688d (block 850). If closed, as indicated by a high-level signal on line 688b, the program makes sure the "paper jam" LED 760d is off (block 858) before continuing to block 860. If the switch is open, line 688g is grounded and line 696d is raised to logic one to illuminate the "paper jam" LED (block 852) and line 700 is raised to logic one to de-energize the main relay MR (block 854). The program then turns off the main motor 636 by grounding line 704, the discharge lamp 292 by grounding line 690a, the scanner forward CL3 and reverse CL2 clutches by grounding lines 690b and 690c, the paper feed clutches CL4 and CL5 by grounding line 690d and the transfer 642 and charge 644 coronas by grounding lines 690e and 690f, before looping back to block 834 (block 856).

As indicated by block 860, the safety switch SW4 is checked by scanning line 698a. If the line is inactive, the switch is open and the program will loop back to block 854, turning off all output devices. If the line is at ground, the switch is closed and line 690g is examined to determine whether the paper output path in the paper handling unit 106 is blocked (block 862). If blocked, as indicated by a low-level signal on line 690g, line 688g is grounded and line 696d is raised to logic one to illuminate the "paper jam" LED 760d (block 864). A low-level signal is then placed on line 694 to trip (open) the reset switch SW12 (block 866) and the program loops back into block 854. If the output path is clear, a high-level signal is placed on line 688h and line 688d is scanned to check the supply of dispersant (block 868). If insufficient, as indicated by a high level signal on line 688d, the "add dispersant" LED 760c is illuminated by grounding line 688g and raising line 696c to logic one (block 870) and line 698f is scanned to check the paper supply in the selected cassette (block 872). If the cassette is empty, the "add paper" LED 760a is illuminated by maintaining line 688g at ground and raising line 696a to logic one (block 874). If there is paper, the program makes sure the "add paper" LED is off (block 876) and then loops back to block 854.

If the supply of dispersant is adequate, the program makes sure the "add dispersant" LED 760c is off (block 878) and then checks the paper supply. Again, if the selected cassette is empty, the "add paper" LED 760*a* is illuminated (block 882) and the program loops back to block 854. If, however, there is paper, the program makes sure the "add paper" LED is off (block 884), and checks the time-out timer (block 886). If the timer has expired, line 700 is raised to logic one to de-energize the main relay MR (block 888) and the program loops back to block 844. If the timer has not expired, and line 700 is at ground, the program jumps directly to block 900 (block 890). If line 700 is at logic one, it is grounded (block 892) to energize the main relay MR, and the program then waits one thousand milliseconds for the pump 634 to start (block 894) before placing a high-level signal on line 704 to turn on the main motor 636 (block 896), rotating the drum. The program then waits another one thousand milliseconds to allow a minimum cleaning time for the drum (block 898) and then continues to block 900.

As indicated by block 900, the lamp regulator 656, is checked by scanning line 698*g*. In the event of failure, the regulator places a high-level signal on line 698*g* and in response the program grounds lines 688*g* and 688*h* and raises lines 696*g* and 696*f* to logic one to illuminate the "lamp regulator failure" diagnostic LED 758*g* and the "please wait" front panel LED 760*f* (blocks 902 and 904). The program then clears the print possible status bit, raises line 700 to logic one to turn off the main relay MR and waits in a loop for servicing (blocks 906 and 908).

If no failure is detected, the program continues to block 910 and line 698*c* is examined to determine whether the processing unit 104 (scanner) is in the zero or home position. If the unit is in the zero position, as indicated by low-level signal on line 698*c*, the program jumps directly to block 920. If not, line 690*c* is raised to logic one to energize the reverse clutch (block 912), the waiting for scanner at zero position diagnostic LED 758*a* is illuminated by grounding line 688*h* and placing a high-level signal on line 696*a*, and the program waits for line 698*c* to be grounded (block 914) indicating the return of the processing unit. Line 690*c* then goes low to deactivate the reverse clutch (block 916) and the program waits 20 milliseconds (block 918) before turning off LED 758*a* and continuing to block 920.

At this point, if the cold start status bit is set, the cold time out timer 748 is checked by scanning line 690*h*. If the timer has not expired, as indicated by a low-level signal on line 690*h*, the program loops back to block 834 (blocks 920 and 922). If the timer has expired or the cold start status bit was not set, the bit is cleared and the warm start timer is examined (blocks 924 and 926). Again, if the timer has not expired, the program loops back to block 834. If the timer has expired, the program continues to block 928.

As indicated by block 928, the "print ready" LED 760*e* is illuminated by grounding line 688*g* and raising line 696*e* to logic one. The print possible status bit is then set (block 930) and the print flag is checked to see if the print key PR has been pressed (block 932). If the flag is clear, the program loops back to block 844. If, however, the flag is set, the program clears the print possible status bit (block 934), sets the print in progress status bit (block 936) and clears the print and cancel flags (block 938) before continuing to the print routine which begins at block 940.

Figure 31B:
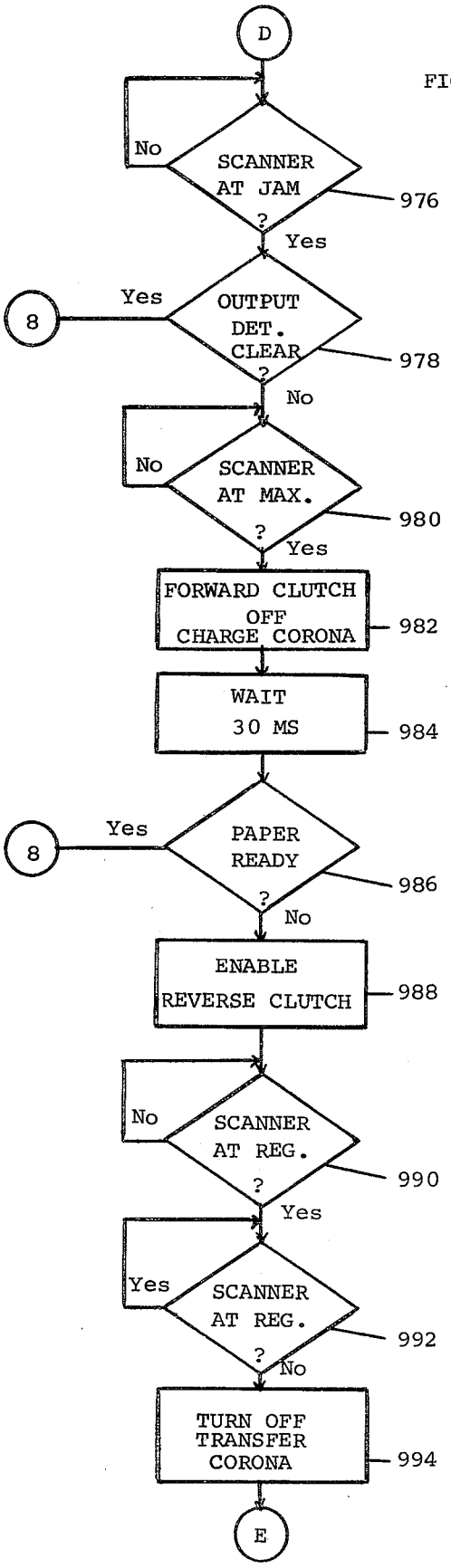
FIG. 31B is a flow chart illustrating the intermediate portion of the "print" program of operation of my improved apparatus for electrophotography.
Figure 31C:
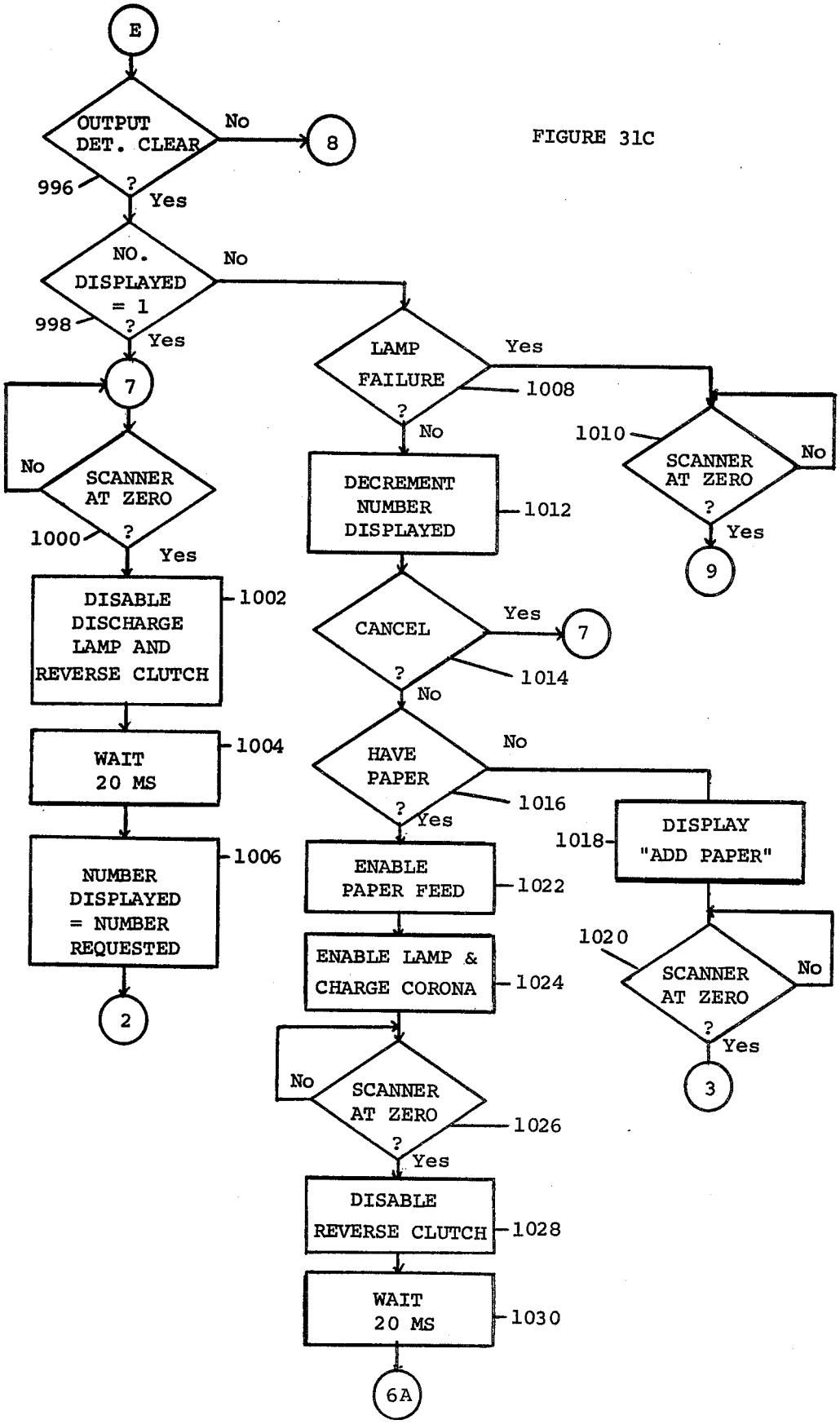
FIG. 31C is a flow chart of the final portion of the print program of operation of my improved apparatus for electrophotography.
Figure 32A:
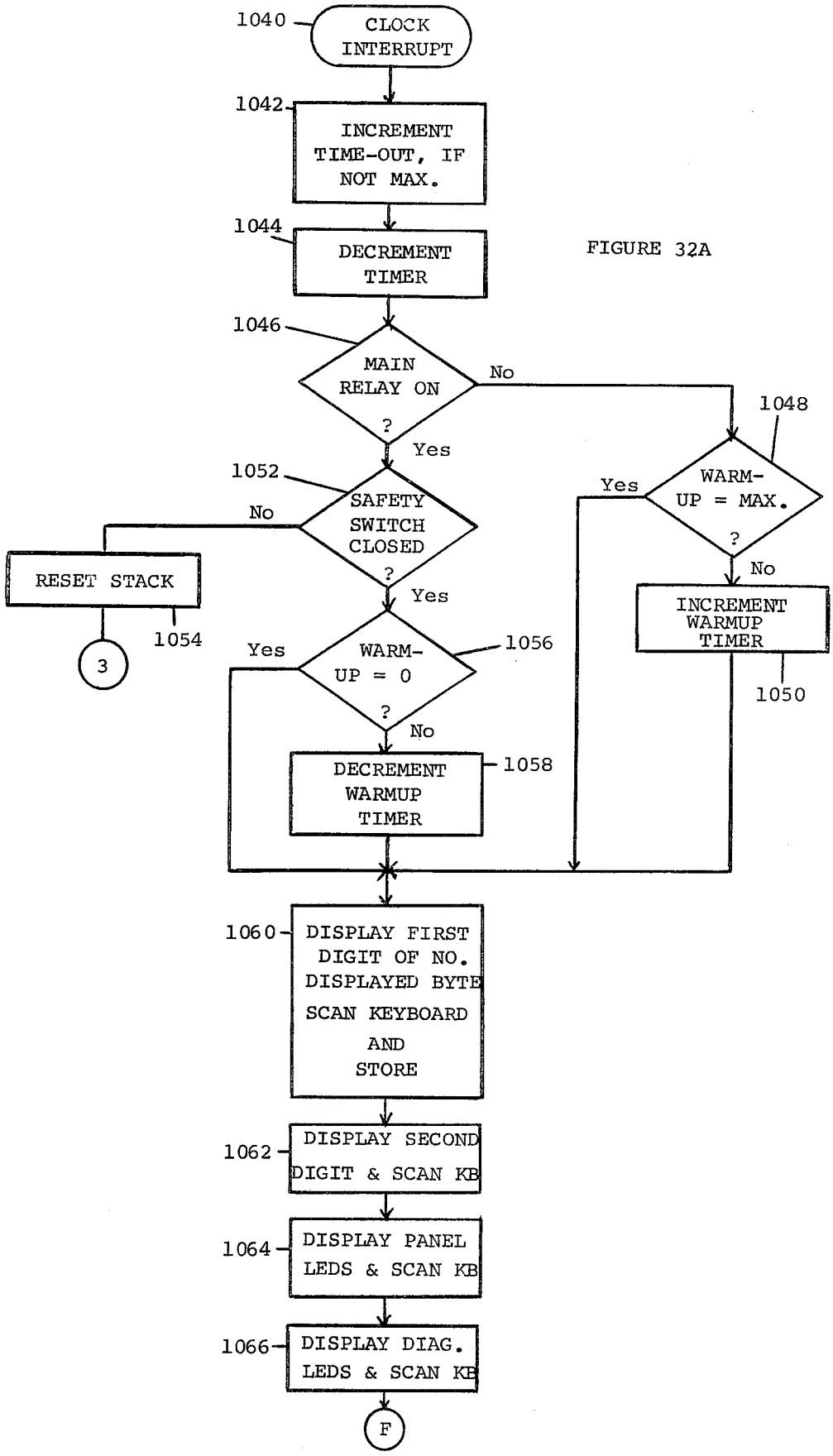
FIG. 32A is a flow chart of the initial part of the "clock interrupt" program of operation of my improved apparatus for electrophotography.
Figure 32C:
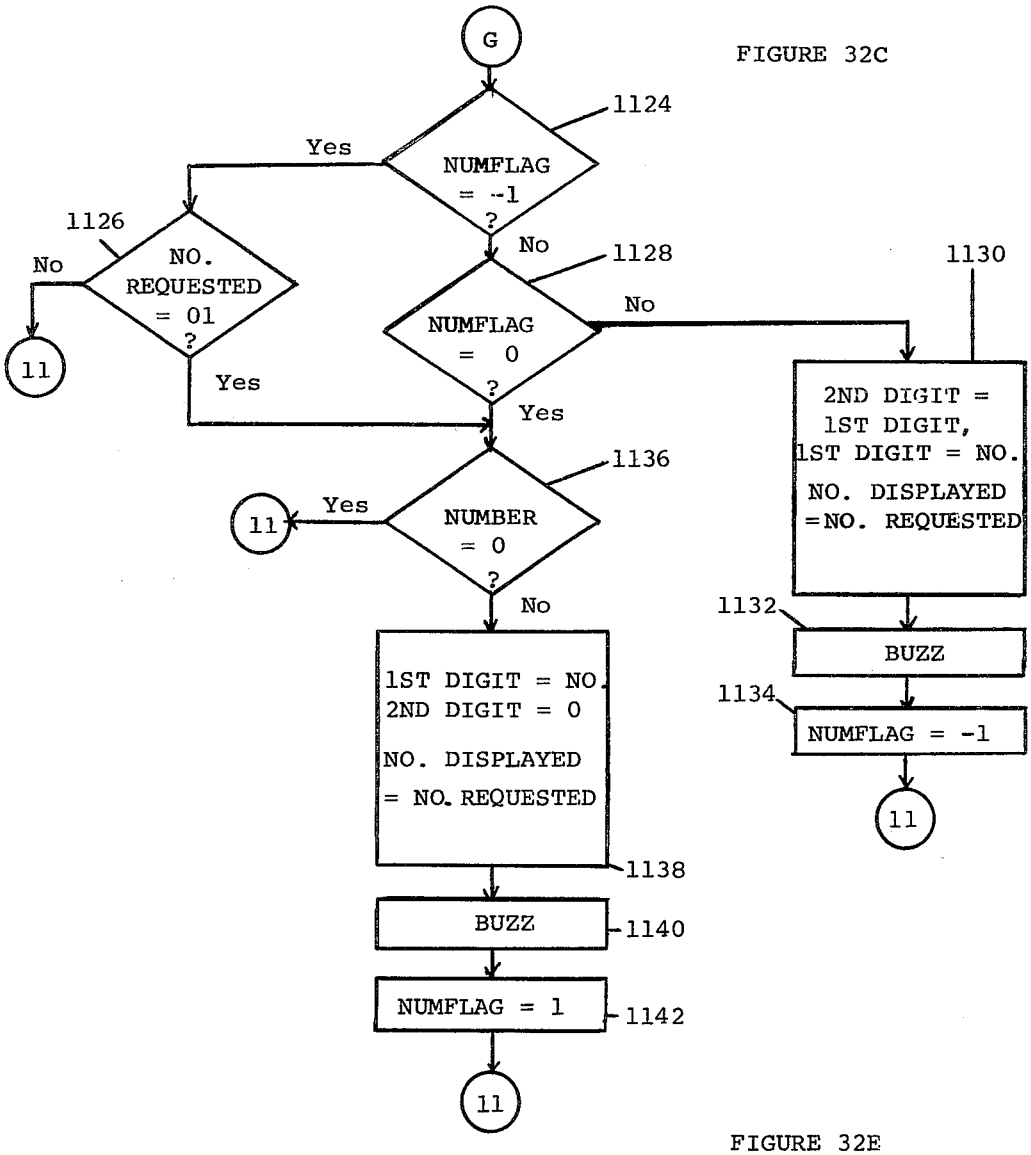
FIG. 32C is a flow chart of a possible further portion of the clock interrupt program of operation of my improved apparatus for electrophotography.
Figure 32D:
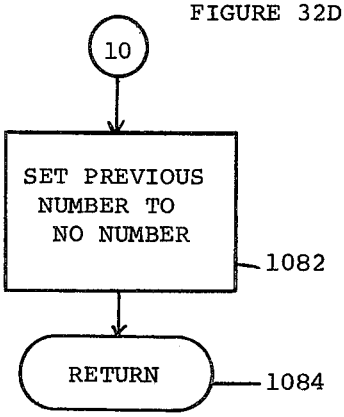
FIG. 32D is a flow chart of one possible termination of the clock interrupt program of operation of my improved apparatus for electrophotography.
Figure 32E:
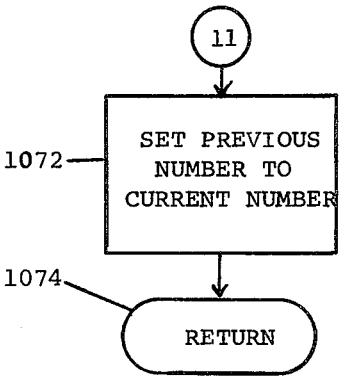
FIG. 32E is a flow chart of another possible ending of the clock interrupt program of operation of my improved apparatus for electrophotography.

Referring now to FIGS. 31A to 31C, the print routine to which the main program jumps when all necessary conditions for making a copy have been established and the print key pressed, begins at block 940. Line 688*g* is grounded and line 696*f* is raised to logic one to illuminate the "please wait" LED 760*f* (block 942). Line 690*d* is then raised to logic one to energize the paper feed clutch CL4 or CL5 associated with the selected paper cassette to advance a sheet of paper from the cassette to the nip formed by the registration rollers in the paper handling unit 104 (block 944), and the main lamp 284 and charge corona 644 are activated by a high-level signal on line 690*f* (block 946). The program then waits 220 milliseconds (block 948), allowing the lamp and corona to warm up, before placing a high-level signal on line 690*b* to energize the forward scanner clutch CL3, moving the processing unit 104 toward the paper handling unit 106 (block 950) to begin the copying cycle.

When the processing unit 104 reaches the paper handling unit 106, the scanner at registration position switch D3 is closed, and line 698*d* is grounded (block 952). In response, line 698*b* is examined to determine if the leading edge of the sheet of paper has reached the nip formed by the registration rollers (block 954). If the paper is in place, the program continues to block 972. If not, line 690*b* and 690*f* are grounded, deactivating the main lamp and charge corona, and disengaging the forward clutch CL3 (block 956), aborting the copying cycle. The program then waits 30 milliseconds before placing a high-level signal on line 690*c* to energize the reverse clutch (blocks 958 and 960), to bring the processing unit 104 back to the zero position. When the unit returns, as indicated by a low level signal on line 698*c*, line 690*c* goes low to disengage the reverse clutch (blocks 962 and 964) and the program waits 20 milliseconds to ensure that the unit is in the zero position (block 966). After an additional 500 milliseconds (block 968), line 698*b* is again examined to determine if the leading edge of the paper has reached the registration rollers (block 970). If the paper is in place, the program loops back to block 946 to reattempt the copying cycle. If not, the program returns to the main routine at block 864.

At block 972, as the leading edge of the paper is between the registration rollers and the processing unit 104 has reached the paper handling unit 106, the line 690*d* is grounded to disable the appropriate paper feed clutch CL4 or CL5, and line 690*e* is raised to logic one to activate the transfer corona 642 through the high voltage power supply 640 (block 974). The developed image on the drum is then transferred to the copy paper as the processing and paper handling units move together toward the exit tray. When the units reach the jam check position (block 976), switch D7 is closed, grounding line 698*h* as an indication of such and the program examines line 690*g* to determine whether the leading edge of the paper has reached and closed the output detector switch D8 positioned at the paper exit location of the paper handling unit 106 (block 978). The jam check position switch is located between the registration position and the maximum position at the point where the leading edge of the copy paper should reach and close the output detector switch D8. If the switch is open at this point, most likely the result of a paper jam, the program returns to the main routine at block 864. If the switch is closed, as indicated by the grounding of line 690*g*, the program waits for the processing unit 102 to reach the maximum position (block 980) and then grounds lines 690*b* to de-energize the forward clutch CL3 and 690*f* to deactivate the main lamp 284 and charge corona 644 (block 982).

As indicated by block 984, the program waits 30 milliseconds and then examines line 698*b* to determine if there is a paper jam at the registration position. If there is a jam, as indicated by a low-level signal on line 698*b*, the program will not activate the reverse clutch and will return to the main routine at block 864 (block 986), leaving the processing and paper handling units 102 and 104 at the maximum position, to prevent damage to the units and to aid in clearing the paper jam. If however, no jam is detected, line 690*c* is raised to logic one to energize the reverse clutch CL2, bringing the processing unit 102 back to the zero position and permitting the paper handling unit 104 to be pulled back to the registration position by springs (block 988). The program then waits for the processing unit 102 to pass the registration position (blocks 990 and 992) before deactivating the transfer corona 642 by grounding line 690*e* (block 994). At this point the trailing edge of the copy paper should have left the paper handling unit 104, and output detector switch D8 should be open as an indication of such (block 996). If the switch is closed, as indicated by a low-level signal on line 690*g*, the program will return to the main routine at block 864 to report the paper jam.

It should be noted that as the processing unit 102 moves from the zero position to the registration position, to the jam-check and maximum positions, and then back again, the "waiting for scanner at zero position" diagnostic LED 758*a*, the "waiting for scanner at registration position" LED 758*b*, the "waiting for scanner at jam-check position" LED 758*c* and the "waiting for scanner at maximum position" LED 758*d* are illuminated accordingly.

As indicated by block 998, the number displayed byte is examined to determine the number of copies still to be done. If the number in the byte is greater than one, indicating that more copies are to be made, the program continues to block 1008. If, however, the number in the byte is one, indicating that the last copy has just been made, the program waits for the processing unit 104 to return to zero position (block 1000), and then deactivates the discharge lamp 292 by grounding line 690*a* and the reverse clutch CL2 by grounding line 690*c* (block 1002). After a delay (block 1004), the number in the number requested byte is placed into the number displayed byte (block 1006) and the program returns to the main routine at block 834.

At block 1008, line 698*g* is examined to check the lamp regulator 656. In response to a high level signal on line 698*g*, indicating lamp failure, the program waits for the processing unit 104 to return to the zero position (block 1010) and then returns to the main routine at block 902 to report the failure. If, however, no failure is detected, the number displayed byte is decremented by a one (block 1012) and the cancel flag is checked (block 1014). If the cancel key CN has been actuated, the flag will be set and the program will loop back to block 1000. Otherwise, line 698*f* is examined to determine if there is paper in the selected cassette (block 1016). If not, as indicated by a low-level signal on line 698*f*, the "Add Paper" LED 688*a* is illuminated (Block 1018), and the program waits for the processing unit 104 to return to the zero position before looping back to the main routine at block 854 (block 1020).

If there is paper, line 690*b* is raised to logic one to activate the appropriate paper feed clutch CL4 or CL5 for the selected cassette, advancing a sheet of copy paper towards the registration rollers (block 1022), and line 690*f* is also raised to logic one to activate the main lamp 284 and charge corona 644 (block 1024). The program then waits for the processing unit 104 to return to the zero position (block 1026), grounds line 690*c* to disengage the reverse clutch CL2 (block 1020) and waits 20 milliseconds before looping back to block 950.

Referring now to FIGS. 32A through 32E, the clock interrupt service routine which controls the display and monitors the keyboard and to which the main program jumps after an interrupt request signal generated by clock 734 is received by the controller 660, begins at block 1040. Initially, the time-out timer is incremented and the wait timer is decremented (blocks 1042 and 1044). Line 700 is then examined to determine whether the main relay MR is energized (block 1046). If it is not, as indicated by a high-level signal on line 700, the warm-up timer is incremented, provided that it is not already at its maximum, and the program jumps to block 1060 (blocks 1048 and 1050). If the relay is energized, line 698*a* is examined to determine whether the safety switch SW4 is closed (block 1052). An inactive state on line 698*a*, indicating both an open safety switch and an open front cover, will cause the program to reset the stack (block 1054) and return to the main program at block 854. If, however, the safety switch is closed, the warm-up timer is decremented, provided that it is not at zero (blocks 1056 and 1058), and the program continues.

As indicated by block 1060, the program examines the first digit of the number displayed byte and places the appropriate signals on lines 696*a* to 696*g*. The program then uses a first timing cycle on line 688*e* to create a blanking frequency to form a seven segment LED display (762*a*–762*g*) of the first digit and to provide an input to lines 688*a* to 688*d* through respective pushbutton key switches CN, K1, K2 and K3. Each of the lines 688*a* to 688*d* are scanned during the timing cycle to detect key response, and the results are stored. The second digit of the number displayed byte is then examined, the appropriate signals are placed on lines 696*a* to 696*g* and a second timing cycle is used on line 688*f* to form a seven-segment LED display (764*a*–764*g*) of the second digit and to provide an input to lines 688*a* to 688*d* through push-button key switches K4, K5, K6 and K7. Each of the lines 688*a* to 688*d* are scanned during the timing cycle and valid responses are stored (block 1062).

The front panel LED's 760*a* to 760*f*, set during the main routine, are then illuminated by placing the appropriate signals on lines 696*a* to 696*f* and applying a third-timing cycle to line 688*g*, which also provides input to lines 688*a* to 688*d* through respective switches K8, K9, KO and PR. Each line 688*a* to 688*d* is scanned during the timing cycle and valid responses are stored (block 1064). Next, the diagnostic LED's 758*a* to 758*g*, set during the main routine, are illuminated by placing the appropriate signals on lines 696*a* to 696*g* and applying a fourth timing cycle to line 688*h*, which also provides input to lines 688*b* and 688*d* through respective switches SW12 and SW6. Again, lines 688*b* and 688*d* are scanned during the timing cycle and valid responses are stored (block 1066). If, during the timing cycles, excessive bounce or noise is detected, the "noise on keyboard lines" diagnostic LED 758*e* is illuminated (blocks 1068 and 1070) and the program returns to the main routine at the point of interruption after setting the previous number byte (the number seen on the keyboard on the previous scan) to the value within the number byte (the number seen on the keyboard on the current scan) (blocks 1072 and 1074, FIG. 32E).

As indicated by block 1076, if the print switch PR has been actuated, the program clears the time-out timer (block 1078) and examines the print possible status bit (block 1080). If the bit is not set (no print is possible), the previous number byte is set to contain no number and the program returns to the main routine at the point of interruption (blocks 1082 and 1084, FIG. 32D). If the print possible bit is set, the print in progress bit is examined (block 1086) and, if set, the program jumps to block 1082, to return to the main routine. If the print in progress bit is not set, the print flag is checked (block 1088), and if set, the program jumps immediately to block 1082. If not, the print flag is set (block 1090), the buzzer 750 is actuated by raising line 692 to logic one (block 1092), the number flag is set to minus one (block 1094) and the program jumps to block 1082. The setting of the number flag (NUMFLAG) indicates whether the number seen on the current scan of the keyboard (number byte) can be placed into the number requested byte. If the NUMFLAG equals minus one, the number is not accepted unless the number requested byte is set to one. If the NUMFLAG equals zero, the number will be accepted as the first digit of the number requested byte. If the NUMFLAG equals one, the first digit of the number requested byte becomes the second digit and the number currently on the keyboard becomes the new first digit.

If, on the other hand, the print button PR has not been actuated (block 1076), the cancel key CN is checked (block 1096) and, if actuated, the time-out timer is cleared (block 1098). If the cancel flag is set, the program jumps immediately to block 1082 (block 1100). If the flag is clear, the buzzer 750 is actuated (block 1102) and the print in progress status bit is examined (block 1104). If the bit is set, the cancel flag is also set (block 1106) and the program then jumps to block 1082. If the print in progress bit is not set, the number requested byte and the number displayed byte are set to one (block 1108), the number flag is set to zero (block 1110), and the program jumps to block 1082. If the cancel key has not been actuated (block 1096), the program determines whether any of the number keys K1 to K0 have been actuated (block 1112), and if at least one number key is actuated, the time-out timer is cleared (block 1114) and the program continues to block 1116. If not, the program loops back to block 1082.

As indicated by block 1116, the print in progress bit is checked and, if set, the program loops back to block 1082. If the bit was not set, but more than one number key was pressed, the program again loops back to block 1082 (block 1118). Otherwise, the number on the keyboard is compared to the number seen on the previous keyboard scan (block 1120), which is contained in the previous number byte and, if the values are equal, the program jumps to block 1072, returning to the main routine. If not, the cancel flag is cleared (block 1122) and the number flag is examined. If the number flag equals minus one, the program jumps to block 1072 (block 1124) unless the number requested byte equals one (block 1126), in which case the program continues to block 1136. If the number flag equals zero (block 1128), the program continues directly to block 1136. If the number flag equals one, the first digit of the number requested byte becomes the second digit and the number currently on the keyboard becomes the new first digit. This two-digit number is then stored in the number requested byte and displayed (block 1130). Buzzer 750 is then activated (block 1132), the number flag is set to minus one (block 1134) and the program jumps to block 1072.

As indicated by block 1136, if the number on the keyboard is zero, the program jumps to block 1072. If not, the number becomes the first digit of the number requested byte, the second digit of which is set to zero and the number is displayed (block 1138). Buzzer 750 is then activated (block 1140), the number flag is set to one (block 1142) and the program jumps to block 1072, to return to the main program.

Figure 23:
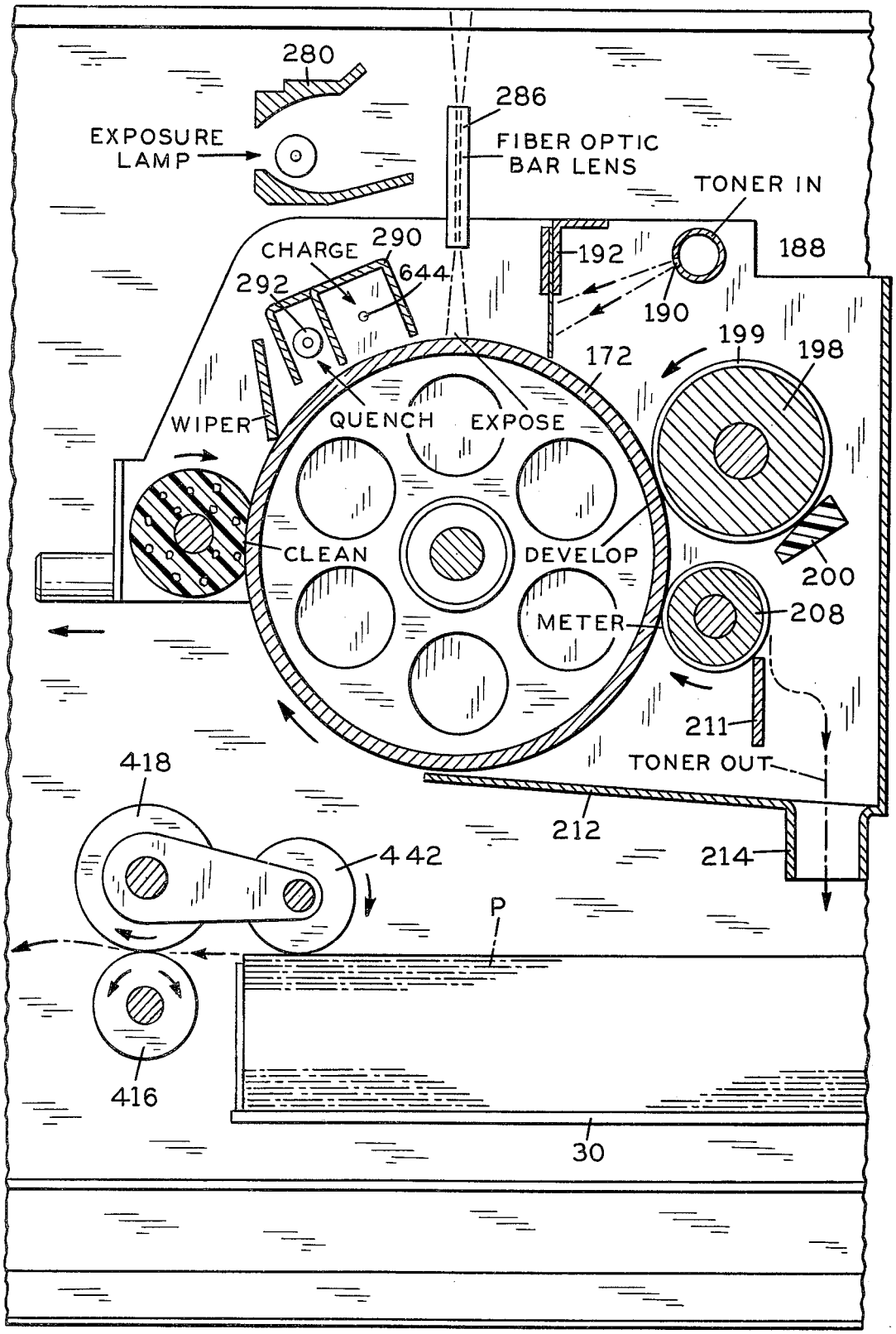
FIG. 23 is a partially schematic front elevation of the traveling processing unit of my improved apparatus for electrophotography in the initial position thereof.

The overall operation of my improved apparatus for electrophotography will readily be apparent from the description hereinabove. First, when the machine is turned on power is supplied to the pump motor, the main motor and the selected cassette paper level motor. As can best be seen by reference to FIGS. 3, 23 and 24, when a copying operation is initiated, depending upon which of the two cassettes is selected, the uppermost sheet thereof is moved to a position at which the leading edge is in the nip between the upper and lower registration rolls 326 and 328 of the unit 106. The scanning processing unit 104 begins to move from its home position toward the unit 106. In the course of this movement, the drum 172 rotates in a clockwise direction, as viewed in the FIGURES, and the lens system 286 focuses a line image of the original on the surface of the drum. As the thus formed latent image moves past the developer roller 198, the image is developed. Excess developer is removed by the reverse roller 208 and liquid from the unit 104 flows out of the discharge port 214 and back into the developer tank through the slot 536 formed between the rear wall of the tank and the tank cover 518.

As the scanning unit 104 moves into the registration position, it picks up the paper handling unit 106 and provides a drive for the elements thereof in the manner pointed out hereinabove. The sheet of copy material, the leading edge of which was in the nip between the registration rollers 326 and 328 is moved through the transfer position and is picked off by the pick-off 370 and moved into the nip of the delivery rollers 360 and 358. The two units 104 and 106 continue to move together toward the discharge end of the machine. Ultimately, the limit position is reached at which time the scanning drive reverses. At the same time, the drum 172 continues to be driven in the same direction. The arrangement of parts is such that the leading edge of the copy sheet engages the end of the delivery tray as the reversal takes place. During this time, the copy sheet has zero relative movement with relation to the base 12 of the machine while the copying operation is being completed. In the particular embodiment of my machine shown in the drawings, the image is completely developed in the maximum position of unit 104 and only the transfer and delivery operations remain incomplete. It is possible in other embodiments that the developing operation might not be complete in the maximum position of the unit 104 in other embodiments, although it is obvious that latent image formation will be complete in the maximum position of unit 104 in all embodiments. The copying operation is completed prior to the time the unit 106 returns to its initial position under the action of the spring loaded cables. Unit 104 then continues to its home position. It will readily be appreciated that the paper jam checks and the like discussed in detail hereinabove are carried out in the course of operation of the machine.

It will be seen that I have accomplished the objects of my invention. I have provided an improved method and apparatus for electrophotography. My method and apparatus results in the production of the first copy in an extremely short time. My improved apparatus for electrophotography is inexpensive to manufacture, while at the same time readily adapting itself to being up-graded. My improved apparatus is extremely simple in its construction and in its operation. I have provided an improved liquid developer electrophotographic apparatus in which the transfer station is conveniently located below both the developing station and the cleaning station, while all operations are carried out in a single continuous cycle of operation of the machine. I so construct my machine as to permit ready access to all points along the copy paper path without removal of any of the machine parts. All of the major components of my improved electrophotographic apparatus are readily removable and replaceable for servicing. My machine provides a positive control of a copy from the time at which the leading edge stops in the output tray until the trailing edge is deposited in the tray. My apparatus produces a stack of copies, leading edges of which are precisely aligned, even where mixed size copies are being produced. My apparatus includes a reciprocating processing unit provided with means for reversing movement of the unit without appreciable vibration. I provide my machine with a lid adapted to be opened and with a gravity sensitive lock for preventing the platen cover from falling away from the platen when the lid is moved to a fully opened position.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. Electrophotographic apparatus for producing a copy of a document on a sheet from a sheet supply location and for delivering said copy at a location remote from said supply location including in combination, means for moving a sheet from said supply location to said delivery location, and electrophotographic means for producing the initial portion of said copy in the course of movement of said sheet from said supply location to said delivery location and the terminal portion of said copy with the leading edge of said sheet stopped at said delivery location.

2. Electrophotographic apparatus for producing a copy of a document on a sheet from a sheet supply location and for delivering said copy at a delivery location remote from said supply location including in combination, means for electrophotographically producing a developed image of said document on said sheet at a certain process speed, means for transporting said sheet from said supply location to said delivery location at twice said process speed in the course of formation of the initial portion of said image, and means for disabling said transport means prior to the completion of said developed image to cause said developed image producing means to produce the terminal portion of said image with the leading edge of said sheet stopped at said delivery location.

3. Electrophotographic apparatus for producing a copy of a document in the course of a copying operation comprising the steps of forming a developed image of said document on a photoconductor and transferring the developed image to a sheet of copy material and delivering said sheet at a delivery location, said apparatus including in combination a platen for supporting a document to be copied, a photoconductor, means for forming a developed image of said document on said photoconductor, means for transferring said developed image to a sheet to produce said copy, means mounting said photoconductor and said image forming means and said transferring means for reciprocating movement below said platen with a forward stroke and a return stroke and means for actuating said image forming means and said transferring means to initiate said copying operation in the course of said forward stroke and to complete said copying operation in the course of said return stroke with the leading edge of said sheet stationary at said delivery location.

4. Electrophotographic apparatus including in combination a platen for supporting a document to be copied, a processing subassembly comprising means for forming a latent electrostatic image of said document and means for developing said latent image, means for supporting said processing subassembly for translatory movement across said platen from an initial position to a maximum position to form a developed image of said document, a sheet handling subassembly comprising sheet registration means, image transfer means, sheet pick-off means and sheet delivery means, means mounting said sheet handling subassembly for translatory movement independently of said processing subassembly from a registration position intermediate said initial and maximum positions to said maximum position, a supply of sheets, means for feeding a sheet from said supply to said registration means, means for moving said processing subassembly from said initial position to said maximum position, and means responsive to movement of said processing subassembly from said registration position to said maximum position for moving said sheet handling subassembly from said registration position to said maximum position and for actuating said sheet handling subassembly.

5. Electrophotographic apparatus for producing a copy of a document in the course of a copying operation comprising the steps of forming a developed image of said document on a photoconductor and transferring the developed image to a sheet of copy material, said apparatus including in combination a platen for supporting a document to be copied, a photoconductor, means for forming a developed image of said document on said photoconductor, first means mounting said photoconductor and said image-forming means below said platen for reciprocating movement as a unit with a forward stroke and with a return stroke, means for transferring said developed image to a sheet of material to produce said copy, second means mounting said transferring means below said platen for reciprocating movement independently of said unit with a forward stroke and a return stroke, the strokes of said transfer means being shorter than and common with portions of the strokes of said unit, means for actuating said image-forming means during the forward stroke of said unit to initiate said copying operation, and means for actuating said transferring means during its forward stroke.

6. Electrophotographic apparatus for producing a copy of a document in the course of a copying operation comprising the steps of forming a developed image of said document on a photoconductor and transferring the developed image to a sheet of copy material, said apparatus including in combination a platen for supporting a document to be copied, a photoconductor, means for forming a developed image of said document on said photoconductor, first means mounting said photoconductor and said image-forming means below said platen for reciprocating movement as a unit with a forward stroke and with a return stroke, means for transferring said developed image to a sheet of material to produce said copy, second means mounting said transferring means below said platen for reciprocating movement independently of said unit with a forward stroke and a return stroke, the strokes of said transfer means being shorter than and common with portions of the strokes of said unit, means for actuating said image-forming means during the forward stroke of said unit to initiate said copying operation, and means for actuating said transferring means during its forward stroke and during at least a portion of its return stroke to complete said copying operation.

7. Electrophotographic apparatus including in combination a platen for supporting a document to be copied, a processing subassembly, first means mounting said processing subassembly for translatory movement below said platen between an initial position and a maximum position, said processing subassembly comprising a photoconductor mounted for rotary movement, an optical system for focusing an image of said document on said photoconductor as said subassembly moves between said positions to form a latent image of said document on said photoconductor, a developer system for subjecting said image to teh action of a developer to produce a developed image of said document, a sheet handling subassembly comprising sheet registration means, transfer means, sheet pick-off means and sheet delivery means, second means mounting said sheet handling subassembly for translatory movement independently of said processing subassembly below said platen between a registration position intermediate said initial and maximum positions, a supply of sheets, means for feeding a sheet from said supply to said registration means, means for moving said processing subassembly while synchronously rotating said photoconductor to form a latent image thereon, means responsive to movement of said processing subassembly from said registration position to said maximum position for moving said sheet handling subassembly to said maximum position and for actuating said transfer means.

8. Electrophotographic apparatus including in combination, a platen for supporting a document to be copied, a pair of spaced slides extending across the space below said platen, a processing subassembly comprising means for forming a latent electrostatic image of said document and means for developing said latent image, means for supporting said processing subassembly on said slides for translatory movement across said platen from an initial position to a maximum position to form a developed image of said document, a sheet handling subassembly comprising sheet registration means, image transfer means, sheet pick-off means and sheet delivery means, means mounting said sheet handling subassembly on said slides for translatory movement independently of said processing subassembly from a registration position between said initial and maximum positions to said maximum position, a supply of sheets, means for feeding a sheet from said supply to said registration means, means for moving said processing subassembly from said initial position to said maximum position, and means responsive to movement of said processing subassembly from said registration position to said maximum position for moving said sheet handling subassembly from said registration position to said maximum position and for actuating said sheet handling subassembly.

9. Electrophotographic apparatus including in combination, a platen for supporting a document to be copied, a processing subassembly comprising means for forming a latent electrostatic image of said document and means for developing said latent image, means for supporting said processing subassembly for reciprocating movement across said platen with a forward stroke from an initial position to a maximum position to form a developed image of said document and with a return stroke, a sheet handling subassembly comprising sheet registration means, image transfer means, sheet pick-off means and sheet delivery means, means mounting said sheet handling subassembly for reciprocating movement independently of said processing subassembly with a forward stroke from a registration position between said initial and maximum positions to said maximum position and with a return stroke, resilient means biasing said sheet handling subassembly to said registration position, a supply of sheets, means for feeding a sheet from said supply to said registration means, means for moving said processing subassembly from said initial position to said maximum position, and means responsive to movement of said processing subassembly from said registration position to said maximum position for moving said sheet handling subassembly from said registration position to said maximum position against the action of said resilient means and for actuating said sheet handling subassembly, said sheet handling subassembly carrying out its return stroke as a unit with said processing subassembly under the action of said resilient means.

10. Electrophotographic apparatus including in combination, a platen for supporting a document to be copied, a processing subassembly comprising a photoconductive drum mounted for rotary movement around a generally horizontal axis, an exposure system and a developer system, means for supporting said processing subassembly for reciprocating movement across said platen with a forward stroke from an initial position to a maximum position and with a return stroke, a sheet handling subassembly comprising sheet registration means, image transfer means, sheet pick-off means and sheet delivery means, means mounting said sheet handling subassembly for movement independently of said processing subassembly with a forward stroke from a registration position between said initial and maximum positions and said maximum position and with a return stroke, a supply of sheets, means for feeding a sheet from said supply to said registration means, means for reciprocating said processing subassembly, means for rotating said drum during said forward stroke of said processing subassembly and during at least a portion of the return stroke thereof, means including first interengageable means on said subassemblies for reciprocating said paper handling subassembly in response to reciprocation of said processing subassembly and second interengageable means on said subassemblies for coupling said drum rotating means to said registration and delivery means in the course of reciprocation of said sheet handling subassembly.

* * * * *